US007520967B2

(12) United States Patent
Maruyama et al.

(10) Patent No.: US 7,520,967 B2
(45) Date of Patent: Apr. 21, 2009

(54) FLUID APPLYING APPARATUS

(75) Inventors: Teruo Maruyama, Hirakata (JP); Takashi Sonoda, Ritto (JP); Yoshimasa Takii, Takatsuki (JP)

(73) Assignee: Panasonic Corporation, Osaka (JP)

( * ) Notice: Subject to any disclaimer, the term of this patent is extended or adjusted under 35 U.S.C. 154(b) by 701 days.

(21) Appl. No.: 10/847,441

(22) Filed: May 18, 2004

(65) Prior Publication Data

US 2006/0163759 A1 Jul. 27, 2006

(30) Foreign Application Priority Data

May 19, 2003 (JP) ..... 2003-140302

(51) Int. Cl.
*B05C 5/00* (2006.01)

(52) U.S. Cl. ..... 204/212; 204/280; 222/322; 222/411

(58) Field of Classification Search ..... None
See application file for complete search history.

(56) References Cited

U.S. PATENT DOCUMENTS 4,106,032 A * 8/1978 Miura et al. ..... 347/21
4,514,742 A * 4/1985 Suga et al. ..... 347/85
4,621,268 A * 11/1986 Keeling et al. ..... 347/82
6,770,320 B2 * 8/2004 Yamauchi et al. ..... 427/8
6,820,973 B2 * 11/2004 Ujita ..... 347/85
6,860,976 B2 * 3/2005 Andrews et al. ..... 204/225
7,059,538 B2 * 6/2006 Maruyama et al. ..... 239/4

FOREIGN PATENT DOCUMENTS

| | | |
|---|---|---|
| JP | 54-134970 | 10/1979 |
| JP | 57-021223 | 8/1983 |
| JP | 58-139390 | 8/1983 |
| JP | 10-027543 | 1/1998 |
| JP | 2000-246887 | 9/2000 |
| JP | 2001-137760 | 5/2001 |

* cited by examiner

*Primary Examiner*—Ashok Patel
(74) *Attorney, Agent, or Firm*—Wenderoth, Lind & Ponack, L.L.P.

(57) ABSTRACT

A meniscus of applying fluid is controlled by applying a voltage to a discharge-nozzle side electrode and a counter electrode placed downstream of the discharge nozzle and by increasing or decreasing fluid pressure inside a pump chamber with use of a mechanism for rotational motion or rectilinear motion.

11 Claims, 29 Drawing Sheets

FLUID APPLYING APPARATUS

BACKGROUND OF THE INVENTION

The present invention relates to very small-flow-range fluid applying apparatus and fluid applying method required in such fields as information/precision equipment, machine tools, and FA (Factory Automation); or in various production processes of semiconductors, liquid crystals, displays, surface mounting, and the like, and also relates to a plasma display panel formed by the fluid applying method and a pattern formation method therefor.

Issues related to conventional printing techniques are explained below by taking as an example a technique for forming the fluorescent substance layer of plasma display panels (hereinafter, referred to as PDPs).

A PDP that performs color display has, on its front-face plate/rear-face plate, a fluorescent substance layer composed of fluorescent substance materials that emit light in RGB (red, green, blue) colors, respectively. This fluorescent substance layer is so structured that three stripes which are filled with fluorescent substance materials of RGB colors, respectively, are formed between partition walls formed in parallel lines on a front-face plate/back-face plate (i.e., on an address electrode), and arrayed in a multiplicity with the three sets of the stripes parallelized in adjacency. This fluorescent substance layer is formed by a screen printing method, or photolithography method or the like.

With the conventional screen printing method, a large-scale screen makes it hard to achieve high-precision alignment of the screen printing plate, and in filling the fluorescent substance materials, the materials might be placed even on the top portions of the partition walls. As a result, it has been necessary to take measures such as introduction of a polishing process for removing the placed materials. Further, since the amount of filled fluorescent substance material varies depending on the difference in squeegee pressure, pressure control therefor is extremely subtle work, which largely depends on the degree of the skill of the operator. Thus, it is quite hard to obtain a constant filling amount over the entire front-face plate/back-face plate.

It is also possible to form the fluorescent substance layer by the photolithography method with the use of photosensitive fluorescent substance materials. However, this necessitates exposure and development steps, involving a number of steps larger than that of the screen printing method, giving rise to an issue of increased manufacturing cost.

Now, "direct patterning method" has recently been receiving attention in various fields in view of simplification, cost reduction, environmental load reduction, resources saving, energy saving, and the like of manufacturing processes. For example, there have been proposed engineering techniques taking advantages of individual methods including:

① Dispenser method,

② Ink jet method,

③ Electric-field jet method, etc.

A direct patterning method using a dispenser has already been proposed to solve the above-described issues in order to form the screen stripes in manufacturing processes of PDPs, CRTs, and the like in Japanese examined patent publication No. S57-21223 and Japanese unexamined patent publication No. H10-27543. According to this proposal, only setting numerical values of substrate specifications allows fluorescent substance to be discharged from a nozzle moving on the substrate and to be applied into grooves between ribs without the use of any conventional screen mask, so that the fluorescent substance layer can be formed with high precision for substrates of arbitrary sizes, while changes in substrate specifications can readily be managed. In the case of dispensers, the line width of drawing lines is restricted by the size of the inner diameter of the discharge nozzle. Since reducing the nozzle diameter to thin the line width would cause the clogging to more frequently occur, the line width would be limited to at most 70 to 100 μm.

Meanwhile, it has been under development that the ink jet method developed for consumer printers is applied to applying apparatuses for industrial equipment. However, this method is, at the present stage, capable of treating only low-viscosity fluids of about 10 mPa·s and incapable of managing high-viscosity fluids from the driving method and structural constraints. Further, the powder diameter that can be prevented from clogging of the flow passage is limited to about 0.1 μm, posing large constraints in terms of material. In addition, the fluid to be used as the applying material is, in many cases, a high-viscosity powder and granular material containing fine powder with its outer diameter ranging from 0.1 micron to tens of microns, such as electrode material, fluorescent substance material, solder, and electrically conductive capsules. With a view to draw fine electrode lines by using the ink jet method, there has been developed a nanopaste in which Ag particles having a mean particle size of about 5 nm are independently dispersed with the Ag particles covered with a dispersant.

However, also in this case, because the ink jet method is only capable of treating a low-viscosity nanopaste, the drawing lines would result in smaller thicknesses, causing the wiring resistance to become high. As a result, overstrikes would be required to ensure the thickness, posing an issue in terms of production cycle time.

In order to solve the above-described issues related to the dispenser method and the ink jet method, there have been proposed applying apparatuses for high-viscosity fluids called electric-field jet method (see Japanese unexamined patent publications No. 2000-246887 and No. 2001-137760). This method is based on the discharge method using electric field reported by Zeleny in 1917.

Referring to a principle view of FIG. 31, reference numeral 500 denotes a high-viscosity fluid, 501 denotes a control section, 502 denotes a container, 503 denotes an opening, 504 denotes an electrode, 505 denotes a power supply, 506 denotes an application-object base material (a substrate which is an object of application), 507 denotes an elongated portion of the applying fluid having flowed out from a nozzle, and 508 denotes a pressurization device. This applying apparatus has the opening 503 such as a circular or polygonal orifice or nozzle with a hole diameter of about 50 μm to 1 mm ϕ, at a lower portion of the container 502, and the electrode 504 is placed at a portion of this opening 503. Within the container 502 is filled the high-viscosity fluid 500 with a high-viscosity substance of 1,000 to 1,000,000 cps as a liquid applying material. In order to pressurize the high-viscosity fluid 500 filled in the container 502, the pressurization device 508 by high-pressure air is provided so as to be connected to the container 502. First, pressure is applied to the high-viscosity fluid 500 within the container 502, by which a meniscus of the high-viscosity fluid 500 is formed at the opening 503. Next, a first specified pulse voltage is applied to between the electrode 504 of the nozzle opening 503 and the application-object base material 506 that is the counter electrode so that the meniscus of the high-viscosity fluid 500 is elongated longitudinally at the opening 503, thereby forming the elongated portion 507, in which state the high-viscosity fluid 500 is let to drop from the tip end of this elongated portion. In this state, moving the nozzle and the application-object base material 506 relative to each other allows ultrafine lines of 10 μm or less to be drawn because the tip end of the meniscus has become sufficiently thinner than the nozzle diameter.

Further, applying a second specified pulse voltage to between the opening 503 and the application-object base material 506 allows the elongated portion 507 to be partly separated from its tip end, by which the application of the high-viscosity fluid 500 can be interrupted. By this electric-field jet method, it becomes possible to draw ultrafine lines equivalent to those of the ink jet method by using high-viscosity fluids that could not be treated by the ink jet method.

However, this electric-field jet method has had the following issues. With the electric-field jet method, since a small rate of flow is transported from the container 502 to the nozzle tip end by the capillary phenomenon, the discharge of fluid can be achieved only by the electric field without using the pressurization device 508. Nevertheless, in the case where application lines of a fluorescent substance or electrode material are continuously applied onto a substrate (e.g., front-face plate or back-face plate of a PDP) placed, for example, on a stage (see, e.g., a mount plate 50 and an X-Y stage 50*x* in FIG. 26) that runs at high speed, it is necessary to apply both electric field and air pressure to ensure the flow rate. In this case, this method has two types of characteristics, those of the air type dispenser and those of the electric-field jet method, in combination at the same time. That is, the method bears the following shortcomings of the air type dispenser:

① Poor stability of application flow rate; and

② Incapability of forming starting and terminating ends of continuous lines at high grade.

The above ① is due to a reason that the discharge flow rate of the air type dispenser is inversely proportional to the viscosity of the applying fluid. Also, the viscosity of the fluid depends largely on temperature. For example, in the case of a standard calibration liquid, the viscosity changes to 50% due to a 5° C. change of the fluid temperature. In the case of the air type dispenser, as great care is necessary to maintain the liquid temperature constant in order to reduce flow rate drifts, so similar care is necessary also for the electric-field jet method that uses air as an auxiliary pressure source.

The above ② is due to poor responsivity of the air type dispenser. This shortcoming can be attributed to the compressibility of air encapsulated in a cylinder and the nozzle resistance resulting when the air is let to pass through a narrow gap. That is, with the air method, because of a large time constant of the hydraulic circuit that depends on the cylinder capacity and the nozzle resistance, a time lag of 0.07 to 0.1 second has to be allowed for a time period which, after application of an input pulse, lasts from when the fluid starts to be discharged until when the fluid is transferred onto the substrate, or until when the fluid is interrupted during continuous application.

In the case of the electric-field jet method, as described before, the discharge can be interrupted only by electric field without the use of the pressurization device 508 using air pressure. However, with the use of the pressurization device 508 using air pressure for obtainment of larger application flow rates, starting and terminating ends of the continuous application line cannot be drawn at high grade because of the poor response of the air type. For example, at a starting end of a drawing line, even if an air pressure is applied simultaneously with application of a voltage at a start of application, the air pressure cannot be immediately increased to a specified pressure. As a result, there occurs 'thinning' or 'cut' at the starting point of the drawing line. Otherwise, at the terminating end of a drawing line, even if the air pressure is lowered simultaneously with turn-off of the voltage at a start of application, the air pressure cannot be immediately dropped to a specified pressure. As a result, there occurs 'thickening' or 'gathering' at the terminating end of the drawing line.

An object of the present invention is to provide fluid-applying apparatus and fluid-applying method as well as a plasma display panel and a pattern forming method therefor all of which are good at stability of application flow rate and capable of forming starting and terminating ends of application lines at high grade.

SUMMARY OF THE INVENTION

In order to accomplish the above object, the present invention has the following constitutions.

According to a first aspect of the present invention, there is provided a fluid applying apparatus comprising:

a housing having a suction port for sucking an applying fluid and a discharge port for discharging the applying fluid;

a moving member which forms a pump chamber for the applying fluid in combination with the housing and which is enabled to make rotational motion or rectilinear motion relative to the housing;

a moving-member driving device for driving the moving member to make the housing perform the rotational motion or the rectilinear motion so that applying-fluid pressure inside the pump chamber is increased or reduced;

a housing-side electrode placed in proximity to at least the discharge port of the housing; and a power supply for applying a voltage to the housing-side electrode to form an electric field between the housing-side electrode and a substrate, wherein the applying fluid is sucked through the suction port into the pump chamber, and discharged and applied through the discharge port onto the substrate which is an application object placed on an opposing surface of the discharge port by the rotational motion or the rectilinear motion of the moving member by the moving-member driving device, while a suction force for the applying fluid at the discharge port with a negative pressure generated by pressure-reducing the pump chamber by the rotational motion or the rectilinear motion, and a force of making the applying fluid projected at the discharge port by an electric field formed by applying the voltage to the housing-side electrode are controlled, whereby the application is stopped when the force of making the applying fluid projected for applying the applying fluid becomes smaller than the suction force for the applying fluid.

According to a second aspect of the present invention, there is provided the fluid applying apparatus according to the first aspect, further comprising a counter electrode placed on a substrate or in proximity to the substrate, wherein the voltage is applied from the power supply to between the housing-side electrode and the counter electrode, whereby an electric field can be formed.

According to a third aspect of the present invention, there is provided the fluid applying apparatus according to the first aspect, wherein a thread groove is provided on a relative movement surface of the moving member and the housing, and the applying fluid is sucked through the suction port into the thread groove and fed into the pump chamber by the rotational motion of the moving member.

According to a fourth aspect of the present invention, there is provided the fluid applying apparatus according to the first aspect, wherein the moving member is a piston, and the housing is capable of housing the piston, and the moving-member driving device is a piston-axis-direction driving device for driving the piston into the rectilinear motion within the housing, thereby increasing and decreasing the pump chamber defined between the piston and the housing, whereby the fluid pressure inside the pump chamber is increased or decreased.

According to a fifth aspect of the present invention, there is provided the fluid applying apparatus according to the first aspect, wherein either one of the moving member or the housing is made of a nonconductive material.

According to a sixth aspect of the present invention, there is provided the fluid applying apparatus according to the first aspect, wherein the moving member is a piston, and the housing is capable of housing the piston, and the moving-member driving device is an electro-magnetostriction device for putting the piston into rectilinear motion in its axial direction.

According to a seventh aspect of the present invention, there is provided the fluid applying apparatus according to the second aspect, wherein the counter electrode is placed between the housing-side electrode and the substrate.

According to an eighth aspect of the present invention, there is provided the fluid applying apparatus according to the seventh aspect, wherein the counter electrode is hollow and axisymmetric.

According to a ninth aspect of the present invention, there is provided the fluid applying apparatus according to the second aspect, further comprising:

a cylindrical portion for storing therein the applying fluid having flowed out from the discharge port, which defines a discharge passage having a mean passage inner diameter larger than a passage inner diameter of the discharge port; and a lower housing which covers the cylindrical portion with a gap, thereby defining a flow passage which communicates with the discharge passage and which is used for a supply fluid other than the applying fluid, wherein the counter electrode is placed in proximity to the discharge passage.

According to a 10th aspect of the present invention, there is provided the fluid applying apparatus according to the ninth aspect, wherein the supply fluid is a gas.

According to a 11th aspect of the present invention, there is provided the fluid applying apparatus according to the third aspect, the moving member and the housing constitute a thread groove pump.

According to an 12th aspect of the present invention, there is provided a fluid applying method comprising:

driving a moving member which is capable of making rotational motion or rectilinear motion relative to a housing to put the moving member into rotational motion or rectilinear motion relative to the housing, and thus, increasing or decreasing an applying-fluid pressure inside an applying-fluid pump chamber defined between the housing and the moving member, whereby the applying fluid is sucked through a suction port of the housing into the pump chamber, and discharged and applied through a discharge port of the housing onto a substrate which is an application object placed on an opposing surface of the discharge port;

applying a voltage to a housing-side electrode placed in proximity to at least the discharge port of the housing to form an electric field between the housing-side electrode and the substrate; and controlling a suction force for the applying fluid at the discharge port with a negative pressure generated by pressure-reducing the pump chamber by the rotational motion or rectilinear motion, and a force of making the applying fluid projected at the discharge port by an electric field formed by applying a voltage to the housing-side electrode, whereby the application is stopped when the force of making the applying fluid projected for applying the applying fluid becomes smaller than the suction force for the applying fluid.

According to a 13th aspect of the present invention, there is provided the fluid applying method according to the 12th aspect, wherein a voltage of the housing-side electrode is controlled by applying the voltage to the housing-side electrode, while discharge of the applying fluid is started or interrupted by increasing or decreasing the flow passage inside the pump chamber.

According to a 14th aspect of the present invention, there is provided the fluid applying method according to the 12th aspect, wherein the pump chamber is defined by two surfaces for moving relative to each other along a gap direction, and an internal pressure of the pump chamber is increased by contracting the pump chamber while the internal pressure is decreased by expanding the pump chamber.

According to a 15th aspect of the present invention, there is provided the fluid applying method according to the 14th aspect, wherein after the voltage is dropped, the pressure of the pump chamber is reduced by enlarging the pump chamber, whereby an application line is interrupted.

According to a 16th aspect of the present invention, there is provided the fluid applying method according to the 12th aspect, wherein meniscus is maintained generally identical in shape during intervals of application rest by giving both an action of making a meniscus of the applying fluid projected from the discharge port, and an action of reducing the fluid pressure of the pump chamber to suck the applying fluid through the discharge port into the pump chamber.

According to a 17th aspect of the present invention, there is provided the fluid applying method according to the 12th aspect, wherein the applying fluid is applied onto the substrate by giving both an action of making the meniscus of the applying fluid projected from the discharge port, and an action of reducing the fluid pressure of the pump chamber to suck the applying fluid through the discharge port into the pump chamber and by making the meniscus approach a substrate side, and thereafter, the application is interrupted by making the meniscus separated from the substrate side.

According to an 18th aspect of the present invention, there is provided the fluid applying method according to the 12th aspect, wherein after the applying fluid is flown from a discharge nozzle, a voltage is applied to between the housing-side electrode and a space electrode placed downstream of the discharge nozzle, whereby the fluid is applied onto the substrate.

According to a 19th aspect of the present invention, there is provided the fluid applying method according to the 16th aspect, wherein reduction in the fluid pressure inside the pump chamber is performed by a thrust dynamic seal formed by a discharge-side end face of the moving member and its opposing surface.

According to a 20th aspect of the present invention, there is provided a pattern formation method for plasma display panels, comprising:

driving a moving member capable of making rotational motion or rectilinear motion relative to a housing to put the moving member into rotational motion or rectilinear motion relative to the housing, and thus, increasing or decreasing a paste pressure in a pump chamber of a paste as an applying fluid defined between the housing and the moving member, whereby the paste is sucked through a suction port of the housing into the pump chamber, and discharged through the discharge port of the housing onto a PDP substrate, which is an application object, placed at an opposing surface of the discharge port, thereby applying and forming an application line, so that a paste layer is formed into a pattern;

performing the formation of this paste layer while applying a voltage to a housing-side electrode placed in proximity to at least the discharge port of the housing to form an electric field between the housing-side electrode and a PDP substrate, within an effective display area of the PDP substrate and/or within terminal portions neighboring the effective display area;

thereafter, controlling a suction force for the paste at the discharge port with a negative pressure generated by pressure-reducing the pump chamber by the rotational motion or rectilinear motion, and a force of making the paste projected at the discharge port by an electric field formed by applying a voltage to the housing-side electrode, whereby the application is stopped when the force of making the paste projected for applying the paste becomes smaller than the suction force for the paste.

According to a 21st aspect of the present invention, there is provided the pattern formation method for plasma display panels according to the 20th aspect, wherein after the voltage is dropped, the pressure of the pump chamber is reduced, whereby the application line is interrupted.

According to a 22nd aspect of the present invention, there is provided the pattern formation method for plasma display panels according to the 21st aspect, wherein given a time $t=t_{ve}$ at which the voltage drop is started, and a time $t=t_{pe}$ at which the pressure of the pump chamber is started to be reduced, it holds that $0<t_{pe}-t_{ve}<3$ msec.

According to a 23rd aspect of the present invention, there is provided the pattern formation method for plasma display panels according to the 20th aspect, wherein a supply source for supplying the paste to the pump chamber is a pump which is driven by a motor, and rotation of the motor is stopped before the pressure of the pump chamber is reduced.

According to a 24th aspect of the present invention, there is provided the pattern formation method for plasma display panels according to the 20th aspect, wherein in the formation of the paste layer, terminal-portion electrode lines inclined with respect to a main electrode line are formed so as to cross the main electrode line in the terminal portion neighboring the effective display area of the PDP substrate.

According to a 25th aspect of the present invention, there is provided the pattern formation method for plasma display panels according to the 24th aspect, wherein by a dispenser having a plurality of nozzles each having the discharge port and disposed at an equal pitch, terminal-portion electrode lines having an identical inclination angle are selected from among the plurality of terminal portions and the selected terminal-portion electrode lines are simultaneously formed by application.

According to a 26th aspect of the present invention, there is provided a plasma display panel having main electrode lines formed in a plural number and parallel to one another in an effective display area of a PDP front-face plate, and terminal-portion electrode lines formed so as to be connected to the main electrode lines and inclined with respect to the main electrode lines in terminal portions neighboring this effective display area, wherein given a pitch P between the main electrode lines and a distance ΔP of a portion of a terminal end of the terminal-portion electrode line projecting from the main electrode line, it holds that $(\Delta P/P)<(1/3)$.

According to a 27th aspect of the present invention, there is provided a plasma display panel having main electrode lines formed in a plural number and parallel to one another in an effective display area of a PDP front-face plate, and terminal-portion electrode lines formed so as to be connected to the main electrode lines and inclined with respect to the main electrode lines in terminal portions neighboring this effective display area, wherein given a pitch P between the terminal-portion electrode lines and a distance ΔP of a portion of a terminal end of the main electrode line projecting from the terminal-portion electrode line, it holds that $(\Delta P/P)<(1/3)$.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
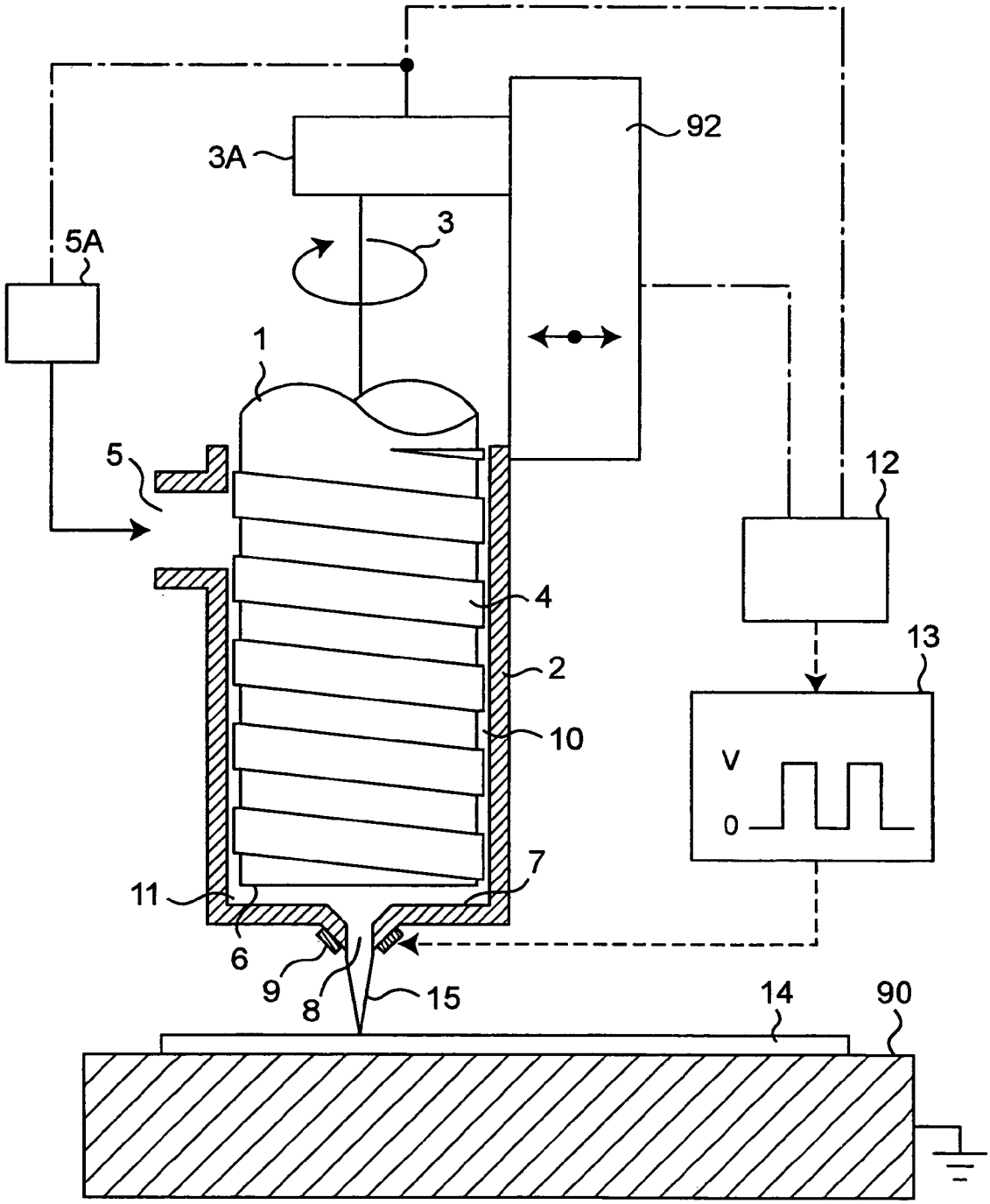
FIG. 1 is a partial cross-sectional schematic view for explaining a fluid applying apparatus according to a first embodiment of the present invention.

Before the description of the present invention proceeds, it is to be noted that like parts are designated by like reference numerals throughout the accompanying drawings.

Hereinbelow, embodiments according to the present invention are described in detail based on the accompanying drawings.

I. Basic Applicative Examples

First Embodiment

FIG. 1 is a partial cross-sectional schematic view for explaining a fluid applying apparatus capable of embodying a fluid applying method according to a first embodiment of the present invention.

Figure 29:
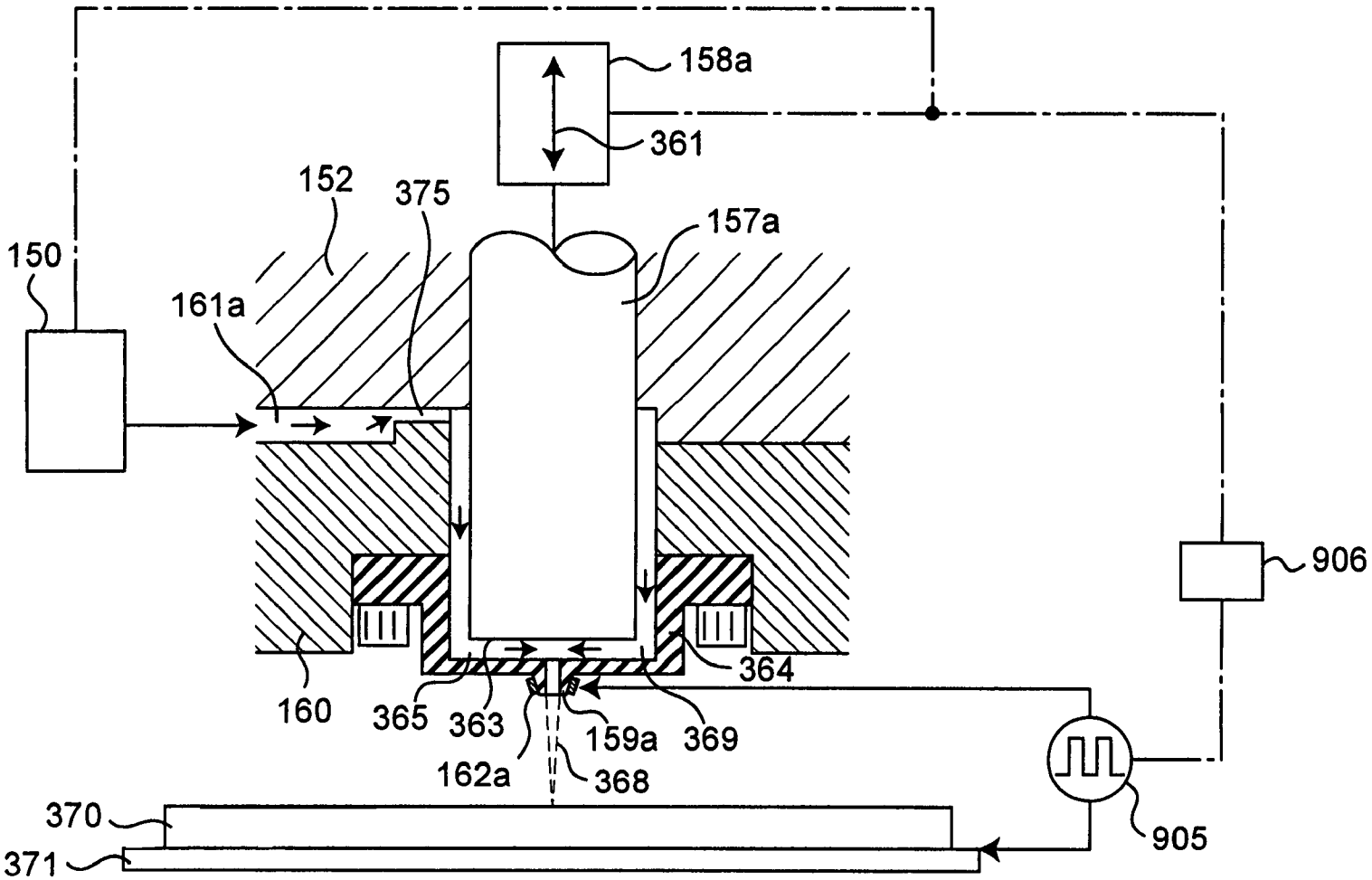
FIG. 29 is an enlarged sectional view in a case where a throttle is formed on a flow passage in the vicinity of the piston portion in the fluid applying apparatus according to the second embodiment of the present invention of FIGS. 11A and 11B.

Reference numeral 1 denotes a piston, and 2 denotes a housing for housing this piston 1 therein. In the case where the applying material can be treated as a nonconductive one, the housing 2 may be made of either an insulative material or a conductive material. When a conductive material is used for the whole housing 2, the nozzle tip end, which is the closest to the substrate, is the highest in electric field strength, so that the function of electric field control has no obstacles. However, when it is not desirable to apply high voltage to the whole housing 2 in terms of safety, a concrete example is shown in FIG. 29, it is appropriate to use an insulative material only for a discharge portion (364 in FIG. 29) where the electrode is to be provided, and to use a conductive material for the other places. Further, the piston 1 may be made of either a conductive material or an insulative material.

The piston 1 is rotatably housed in the fixed-side housing 2. The piston 1 is driven into forward and reverse rotation in a rotational direction indicated by arrow 3 by a rotation transmission device 3A such as a motor.

Reference numeral 4 denotes a thread groove formed on a relative movement surface of either an outer peripheral surface of the piston 1 or an inner peripheral surface of the housing 2, e.g., on the outer peripheral surface of the piston 1, 5 denotes an inlet port of applying fluid, 6 denotes an end face of the piston 1, 7 denotes its fixed-side opposing surface, 8 denotes a discharge nozzle formed at a center portion of the fixed-side opposing surface 7, and 9 denotes a ring-plate shaped housing-side electrode (referred to also as nozzle-side electrode) provided at an outer peripheral portion of the discharge nozzle 8. Numeral 10 denotes an applying fluid which is fed to a space between the thread groove 4 of the piston 1 and the inner peripheral surface of the housing 2 and discharged from the discharge nozzle 8, and 11 denotes a pump chamber formed between the end face 6 of the piston 1 and the fixed-side opposing surface 7 of the housing 2. Numeral 12 denotes a control section for controlling fluid application operation of the fluid applying apparatus, 13 denotes a power supply which is controlled by the control section 12 to apply a voltage to the housing-side electrode 9, 14 denotes a grounded application-object base material (which is an object of application of the applying fluid 10; hereinafter, referred to as substrate as an example), and 15 denotes an elongated portion of the meniscus of the applying fluid 10 having flowed out from the discharge nozzle 8. Rotational motion by the rotation transmission device 3A and move operation of a later-described lateral movement device (e.g., X-Y robot) 92 are each controlled by the control section 12.

In the fluid applying apparatus and method according to the first embodiment of the present invention, the thread groove type is adopted as a pressurization method for the applying fluid 10. In the case of the thread groove type, a pumping pressure $P_p$ is generated by relative rotation between the piston 1, on which the thread groove 4 is formed, and the housing 2. In the case of the electric-field jet method, with a voltage applied to between the electrode 9 provided at the discharge nozzle 8 and the counter-electrode substrate 14, the applying fluid 10 forms a meniscus that projects out from the discharge nozzle 8. Therefore, the applying fluid 10 within the pump chamber 11 has an effect of being sucked (suction pressure $P_e$) toward the discharge nozzle by the capillary phenomenon. The pumping pressure $P_p$ by the thread groove 4 can be made sufficiently larger than the suction pressure $P_e$ by electric field, so that the flow rate can be determined predominantly from use conditions of the thread groove 4. In the case of the thread groove type, the pumping pressure $P_p$ is proportional to the viscosity of the applying fluid 10, and fluid resistance $R_n$ of the discharge nozzle 8 is also proportional to the viscosity of the applying fluid 10. Because the flow rate Q's equation is $Q=P_p/R_n$, the viscosity is canceled by the denominator and the numerator of the flow rate's equation, thus the flow rate is independent of the viscosity.

Even in the case of the thread groove type dispenser, an auxiliary air pressure for introducing the applying fluid to the thread groove portion needs to be applied from an auxiliary-air-pressure feed device 5A under control of the control section 12 as shown in FIG. 1. However, the auxiliary air pressure in this case is sufficiently small relative to the pumping pressure of the thread groove. For example, if the pumping pressure is 1 to 3 MPa, then the auxiliary air pressure may be about 0.05 to 0.2 MPa, which does not result in a large effect.

Accordingly, a stable ultrafine-line application, in which the flow rate is less dependent on viscosity changes due to environmental temperature changes or the like, can be achieved by a combination of thread groove type and electric-field jet method dispensers thanks to the control of the rotation transmission device 3A and the power supply 13 by the control section 12.

Hereinbelow, an example of the fluid applying method, from the start of application to continuous application to be executed under the control of the control section 12, is explained.

At first, a specified voltage V is applied from the power supply 13 to between the housing-side electrode 9 and the counter-electrode substrate 14 under the control of the control section 12, by which an electric field is formed between the housing-side electrode 9 and the substrate 14. By using a conductive base plate 90 set at the lower face of the substrate 14, the substrate-side electrode may be grounded through this base plate 90. A high voltage (e.g., 0.5 to 3 kV) is applied to the housing-side electrode 9. When the rotation of the thread groove 4 is started by the rotation transmission device 3A under the control of the control section 12, the pumping pressure $P_p$ is generated by the thread groove 4, causing the applying fluid 10 to flow out from the opening of the nozzle 8 toward the substrate 14, by which a generally conical shaped meniscus 15 of the applying fluid 10 is formed so as to extend from near the nozzle opening toward the substrate 14. From this point on, the meniscus 15 of the applying fluid 10 promptly comes into a longitudinally and generally conically elongated state due to the effects of both the electric field, formed between the electrode 9 and the substrate 14, and the pumping pressure $P_p$ generated by the thread groove 4. By providing a state in which the applying fluid 10 is allowed to drop down from the tip end (lower end) of the elongated portion of the meniscus 15, since the tip end of the meniscus 15 is sufficiently thinner than the nozzle diameter, ultrafine lines that are sufficiently smaller than the nozzle diameter can be drawn by making the discharge nozzle 8 and the substrate 14 move relative to each other under the control of the control section 12 (for example, by making the housing 2 and the rotation transmission device 3A and the like integrally moved along the substrate surface and in two orthogonal directions by the drive of the lateral movement device 92 such as an X-Y robot under the control of the control section 12 against the fixed substrate 14).

Next, in the state in which a continuous application line of the applying fluid 10 is being drawn, the application line can be interrupted in the following way. The rotation of thread groove 4 is rapidly stopped by the rotation transmission device 3A while the voltage applied from the power supply 13 to between the electrode 9 and the substrate 14 is kept ON under the control of the control section 12 while the continuous application line is being drawn. Further, after the rapid stop, the piston 1, on which the thread groove 4 is formed, is reversely rotated a slight amount by the rotation transmission device 3A under the control of the control section 12. In this way, the meniscus 15 of the applying fluid 10 formed from the discharge nozzle tip end toward the substrate 14 can be separated and cut off from the substrate 14 side, so that the terminating end of the drawing line upon an end of application can be drawn at high grade. Conversely, the application can be started by exerting such control that the rotational speed of the thread groove 4 slightly overshoots its steady-state rotational speed immediately after a start of rotation, i.e., that the discharge pressure reaches a peak pressure immediately after the start. By doing so, the applying fluid 10 that has penetrated deep inside the discharge nozzle 8 by negative pressure can be rapidly discharged. In the case where a long time is taken from an end of application until a start of application, it is appropriate that while the voltage to be applied to the housing-side electrode 9 is turned OFF after an end of application, the voltage is turned ON simultaneously with the rotation of the thread groove 4 at the start of the application. Also, as is applicable to later-described other embodiments, the tip end of the discharge nozzle 8 may be set sufficiently closer to the substrate 14 at the start of application (e.g., the distance δ between the tip end of the discharge nozzle 8 and the substrate 14 is set to δ=50 to 100 μm), and in this state, the distance δ may be returned to the steady state (e.g., δ=1.0 to 2.0 mm) immediately after the starting end of the application line has been drawn.

In this way, the starting end of a drawing line at the start of application can be drawn at high grade.

Figure 31:
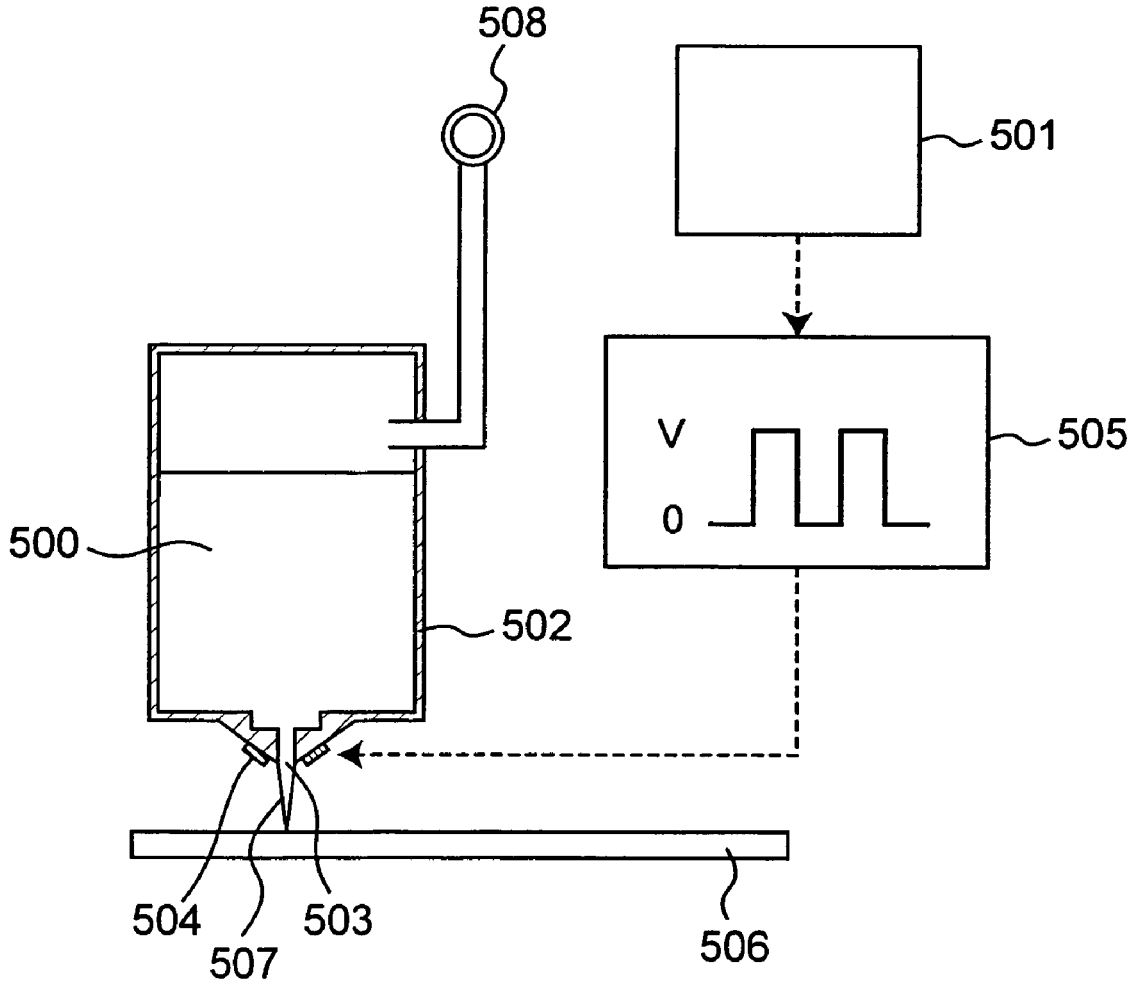
FIG. 31 is a partial cross-sectional schematic view showing the conventional electric-field jet method.

In the conventional example of the electric-field jet method, as described before, it has been necessary to apply a large air pressure (e.g., 1.5 to 3 MPa or more) to the pressurization device 508 (FIG. 31) when a sufficiently large flow rate is required. In this case, it has been difficult to draw starting and terminating ends of drawing lines at high grade because of the poor responsivity on account of the issues similar to those of the air type dispenser.

In contrast to this, when the starting and terminating ends of drawing lines are drawn by the thread groove type as in the fluid applying apparatus of the first embodiment, it becomes possible to adopt such methods as (1) interposing an electromagnetic clutch between a motor and a pump shaft to connect or release this electromagnetic clutch for turn-ON or -OFF of discharge, and (2) using a DC servomotor to perform a rapid rotation start or a rapid stop of a pump shaft, in which cases the control responsiveness for treating high-viscosity powder and granular materials becomes more advantageous as compared with the air type. In addition, under the control of the control section 12, when the application is interrupted, the voltage applied between the housing-side electrode 9 and the substrate 14 by the power supply 13 may be turned OFF simultaneously with the stop of the rotation of the motor 3A. Otherwise, the voltage may be turned OFF by the power supply 13 at a timing slightly delayed under the control of the control section 12, taking into consideration that the responsiveness of the motor rotational-speed control is slower than the electric field control.

Figure 2:
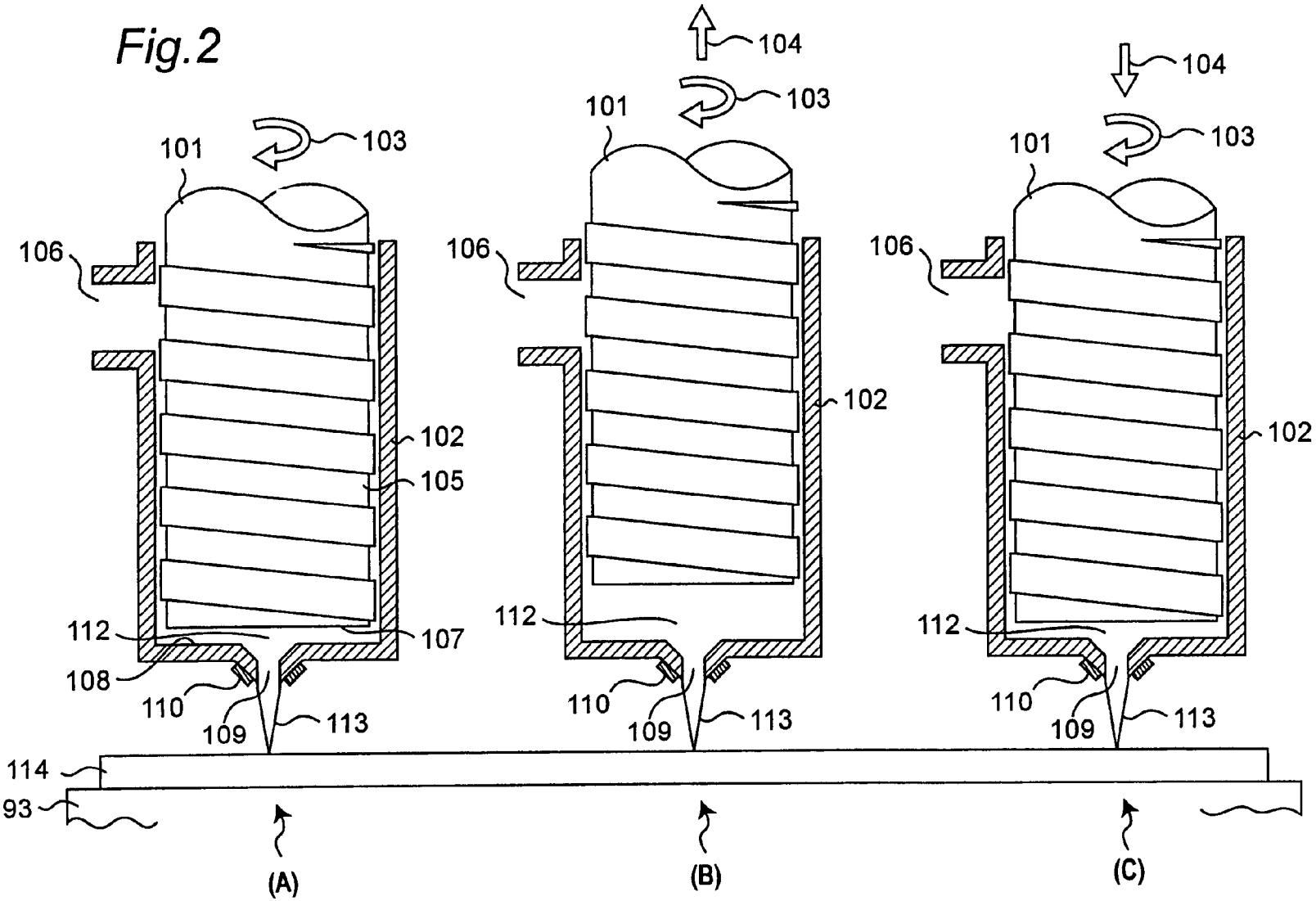
FIG. 2 is a partial cross-sectional schematic view for explaining a fluid applying apparatus according to a second embodiment of the present invention, where part (A) shows a state of continuous application, (B) shows a state of application halt, and (C) shows a state of application interruption.
Figure 3A:
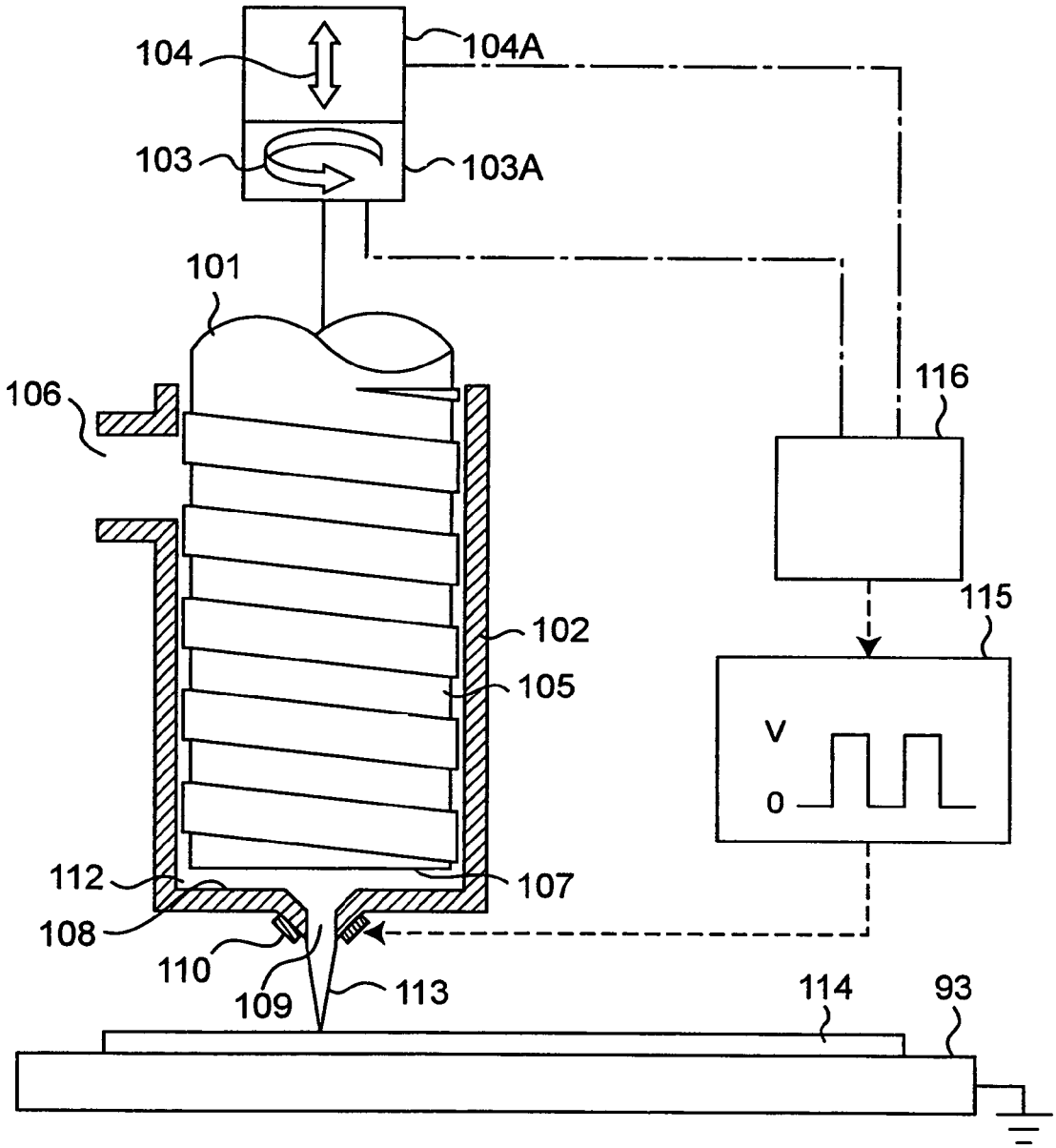
FIGS. 3A and 3B are partial cross-sectional views for explaining the fluid applying apparatus according to the second embodiment of the present invention and a partly enlarged view of the part (B) of FIG. 2, respectively.
Figure 3B:
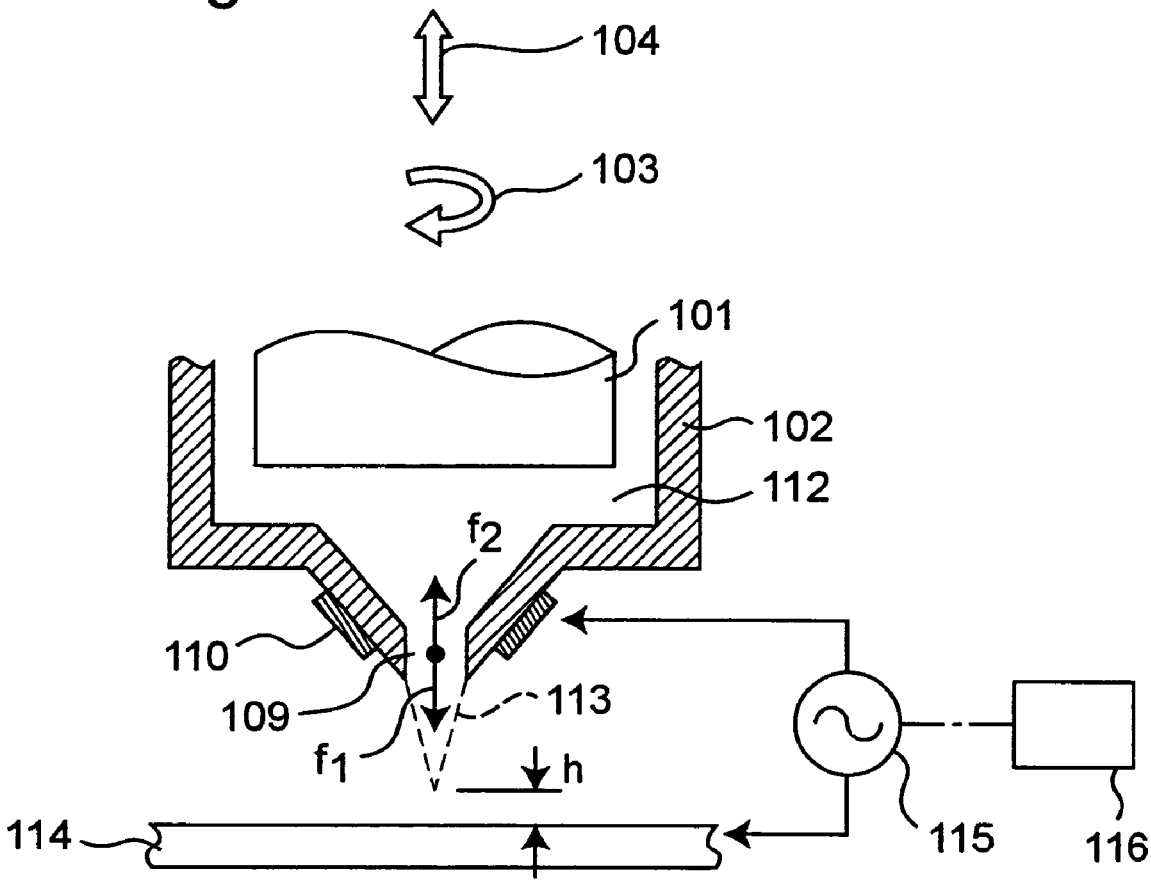
Figure 10:
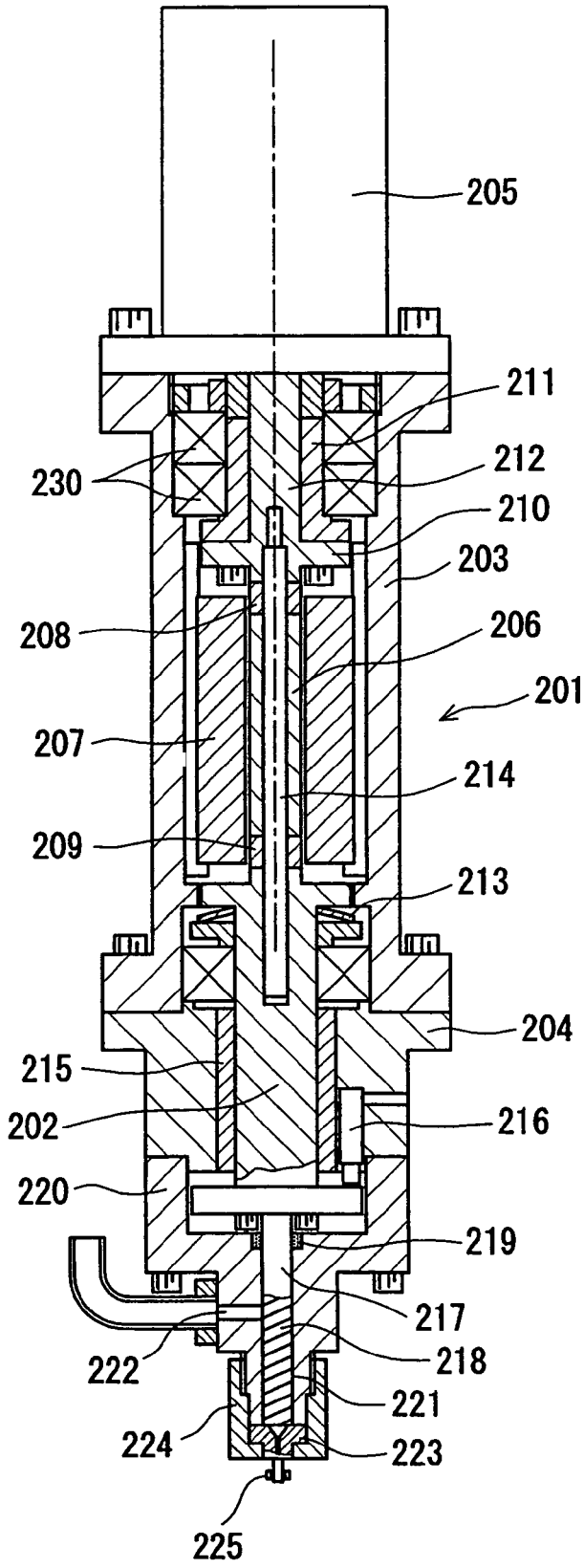
FIG. 10 is a front sectional view showing a dispenser having a structure of a two-degrees-of-freedom actuator as a modification of the second embodiment of the present invention.

FIG. 2 and FIGS. 3A and 3B are partial cross-sectional schematic views for explaining a fluid applying apparatus that can carry out a fluid applying method according to a second embodiment of the present invention, where (A), (B), and (C) of FIG. 2 show processes from a state of continuous application to a state of application interruption and further to a state of application start, respectively. The piston shaft of the dispenser used in the fluid applying apparatus and method according to the second embodiment is so structured as to be capable of making rotation and rectilinear motion at the same time by virtue of its two-degrees-of-freedom actuator as a concrete example is shown in FIG. 10.

Reference numeral 101 denotes a piston, and 102 denotes a housing for housing this piston 101 therein. The piston 101 is housed so as to be capable of making rotational motion and rectilinear motion independently of each other against the fixed-side housing 102. In the case where the applying material can be treated as a nonconductive one, the housing 102 may be made of either an insulative material or a conductive material. When a conductive material is used for the whole housing 102, the nozzle tip end, which is the closest to the substrate, is the highest in electric field strength, so that the function of electric field control has no obstacles. However, when it is undesirable to apply any high voltage to the whole housing 102 in terms of safety, as a concrete example is shown in FIG. 29, it is appropriate to use an insulative material only for the discharge portion (364 in FIG. 29) where the electrode is to be provided, and to use a conductive material for the other places. Further, the piston 101 may be made of either a conductive material or an insulative material. For the rotational motion, the piston 101 can be driven into rotational motion in a direction of arrow 103 by a rotation transmission device 103A such as a motor, and for the rectilinear motion, driven forward and backward in a direction of arrow 104 by an axial-direction movement device 104A such as an air cylinder. These rotational motion and rectilinear motion and the voltage application operation by a power supply 115 are controlled by a control section 116. That is, the control section 116 controls fluid application operation of the fluid applying apparatus.

Reference numeral 105 denotes a thread groove formed on a relative movement surface of either an outer peripheral surface of the piston 101 or an inner peripheral surface of the housing 102, e.g., on the outer peripheral surface of the piston 1, 106 denotes an inlet port of applying fluid, 107 denotes an end face of the piston 101, 108 denotes its fixed-side opposing surface, 109 denotes a discharge nozzle formed at a center portion of the fixed-side opposing surface 108, and 110 denotes a ring-plate shaped housing-side electrode (referred to also as nozzle-side electrode) provided at an outer peripheral portion of the discharge nozzle 109. Numeral 111 denotes an applying fluid which is fed to a space between the thread groove 105 of the piston 101 and the inner peripheral surface of the housing 102 and discharged from the discharge nozzle 109, 112 denotes a pump chamber formed between the end face 107 of the piston 101 and the fixed-side opposing surface 108 of the housing 102, 113 denotes an elongated portion of the applying fluid 111 having flowed out from the discharge nozzle 109, and 114 denotes a substrate (which is an example of the application object) placed on a grounded conductive base plate 93. To between the housing-side electrode 110 side and the substrate 114 side, a specified voltage V is applied by the power supply 115 (FIGS. 3A and 3B) controlled by the control section 116.

FIG. 2 (A) shows a state in which the applying fluid 111 is being continuously applied onto the substrate 114. In this state, under the control of the control section 116, the applying fluid 111 is allowed to flow out from the discharge nozzle 109 by a pumping pressure that is generated by the rotation of the piston 101, which is the thread groove shaft, in the direction of arrow 103 by the rotation transmission device 103A, whereas the meniscus 113 of the applying fluid 111, which is a dielectric applying material, is simultaneously formed into an increasingly-thinning and generally conical tapered shape by an effect of an electric field that has been generated between the electrode 110 and the substrate 114 by the power supply 115 under the control of the control section 116. Therefore, an application line whose line width is smaller than the inner diameter of the discharge nozzle 109 can be drawn on the substrate 114.

FIG. 2 (B) shows a case in which the continuous application line is interrupted. A detailed view of FIG. 2 (B) is shown in FIG. 3B. Under the control of the control section 116, when the piston 101 is rapidly moved up relative to the cylinder 102 along a direction of upward arrow 104 by the axial-direction movement device 104A with the rotation of the piston 101 in the direction of arrow 103 maintained, the pressure in the pump chamber 112, which is upstream of the discharge nozzle 109, rapidly drops, resulting in a negative pressure. In this case, since the thread groove pump composed of the thread groove 105 of the piston 101 and the inner circumferential surface of the housing 102 is used as the fluid supply source for the applying fluid 111, the fluid cannot be fed to the pump chamber 112 at flow rates more than a maximum flow rate $Q_{max}$, which depends on the rotational speed and the thread groove shape. Therefore, given a volumetric increment $Q_p$ per unit time of a gap portion generated by a rapid up of the piston 101, setting the piston diameter and the piston speed so that $Q_p > Q_{max}$ allows a sufficiently large negative pressure to be generated in the pump chamber 112. This negative pressure is referred to as "inverse squeeze pressure."

If a voltage is applied to between the electrode 110 and the substrate 114 by the power supply 115 under the control of the control section 116 while the piston 101 is moving up, then the applying fluid 111, which is present on the substrate side from the discharge nozzle 109 is subjected to a force $f_1$ of such an action as to be projected toward the substrate side by an electric field. At the same time, the applying fluid 111 is subjected to such a suction force $f_2$ as to tend to return to the inside of the discharge nozzle 109 by a negative pressure generated in the pump chamber 112. These projecting force $f_1$ and suction force $f_2$ are balanced with each other, by which the meniscus 113 of the applying fluid 111 is enabled to maintain a constant shape. The magnitude of the projecting force $f_1$ of the applying fluid 111 and the shape of the meniscus 113 can be controlled by the control section 116 depending on the magnitude of the voltage or on frequency selection with the use of alternating current. The magnitude of the suction force $f_2$ can be controlled by the control section 116 by setting the speed of rapid up of the piston 101 as described before. For example, after the piston 101 is rapidly moved up to make the tip end position of the meniscus 113 released from the substrate 114, the piston 101 may be moved up slowly. Using such a method makes it possible that a distance h between the substrate 114 and the tip end of the fluid meniscus 113 can be maintained at a constant value while the application is at interruption.

FIG. 2 (C) shows a case where the application is started from an interrupted state. In this case, converse to FIG. 2 (B), the piston 101 is moved down by the axial-direction movement device 104A under the control of the control section 116. When the piston 101 is moved down, a positive squeeze pressure is generated in the pump chamber 112. If the down speed of the piston 101 is too high, the squeeze pressure becomes too large, giving rise to a risk that a 'thickening' may be formed at an application starting portion of a drawing line. Therefore, the down speed of the piston 101 may be set within such a range as not to cause this 'thickening'. A continuous application or an intermittent application having short line lengths can be implemented by repeating the operations of the continuous application, the application interruption, and the application start of above FIG. 2 (A) to (C) in a short cycle. Now given a line width 'b' of application lines and a length L of application lines, a relationship that L>b is defined as a continuous application, and a relationship that L≈b or that L<b is defined as an intermittent application.

As a method other than above FIG. 2 (B) and (C), it is also possible to interlock the rapid up operation of the piston 101 by the axial-direction movement device 104A and the operation of nullifying the electric field (zeroing the voltage) by turn-off of the power supply 115 by means of the control section 116, in which case the applying fluid 111 projected from the discharge nozzle 109 can be sucked at once by the interior of the discharge nozzle 109 so that the application can be interrupted. For start of the application, the down operation of the piston 101 by the axial-direction movement device 104A and the operation of applying a voltage by turn-on of the power supply 115 may be interlocked by the control section 116.

Although the above description has been given on a case where starting and terminating ends of continuous drawing lines are applied for coating at high grade, yet effects of the present invention can be utilized also for ultrafast intermittent application. With the use of a two-degree-of-freedom actuator (more specifically, rotation transmission device 103A and axial-direction movement device 104A) such as shown FIGS. 2 to 3B, when the piston 101 is put into reciprocating motion at a high frequency, there occurs a positive squeeze pressure having a sharp peak pressure. The reason of this is as follows. When the piston 101 moves down at high speed, the applying fluid 111 that has no escape way in a confined gap portion, given a large fluid resistance of the discharge nozzle 109, flows back toward the thread groove pump. However, because of the high internal resistance of the thread groove pump, there is generated a pressure proportional to the amount of this back flow and the internal resistance. Now, forming an electric field between the nozzle-side electrode 110 and its counter-electrode substrate 114 enables the meniscus 113 at the nozzle tip end to maintain an axially symmetric shape at all times. Further, surface tension between a fluid mass sticking to the nozzle tip end and the nozzle 109 is apparently decreased by the action that the applying fluid 111 is projected by an electric field. By generation of a pressure waveform of a high frequency having a sharp peak pressure as a result of these two actions, an ultrafast intermittent application becomes implementable regardless of a low absolute value of the pressure and a very small flow rate.

Figure 11A:
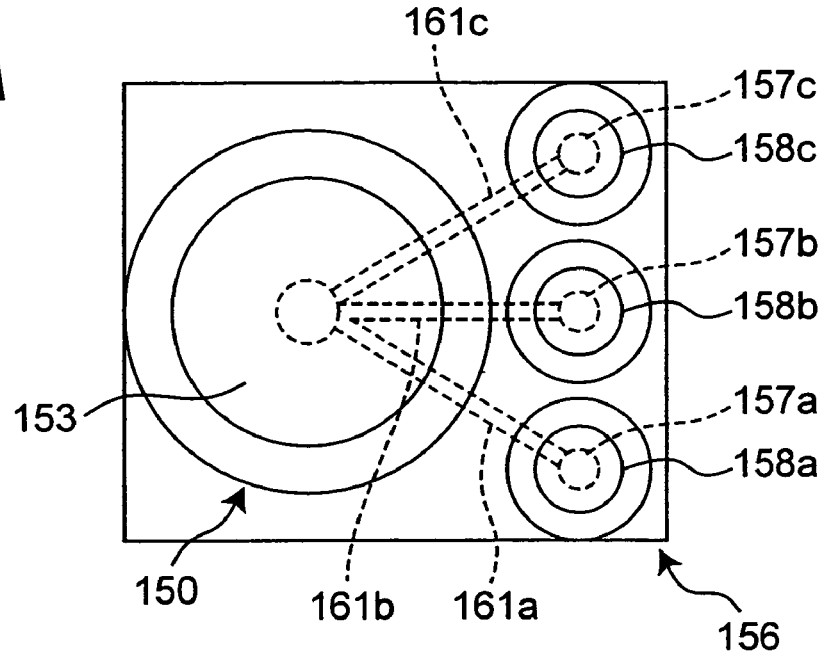
FIGS. 11A and 11B are a top view and a front sectional view, respectively, showing a dispenser having a thread groove-and-piston separate structure as the fluid applying apparatus according to the second embodiment of the present invention.
Figure 11B:
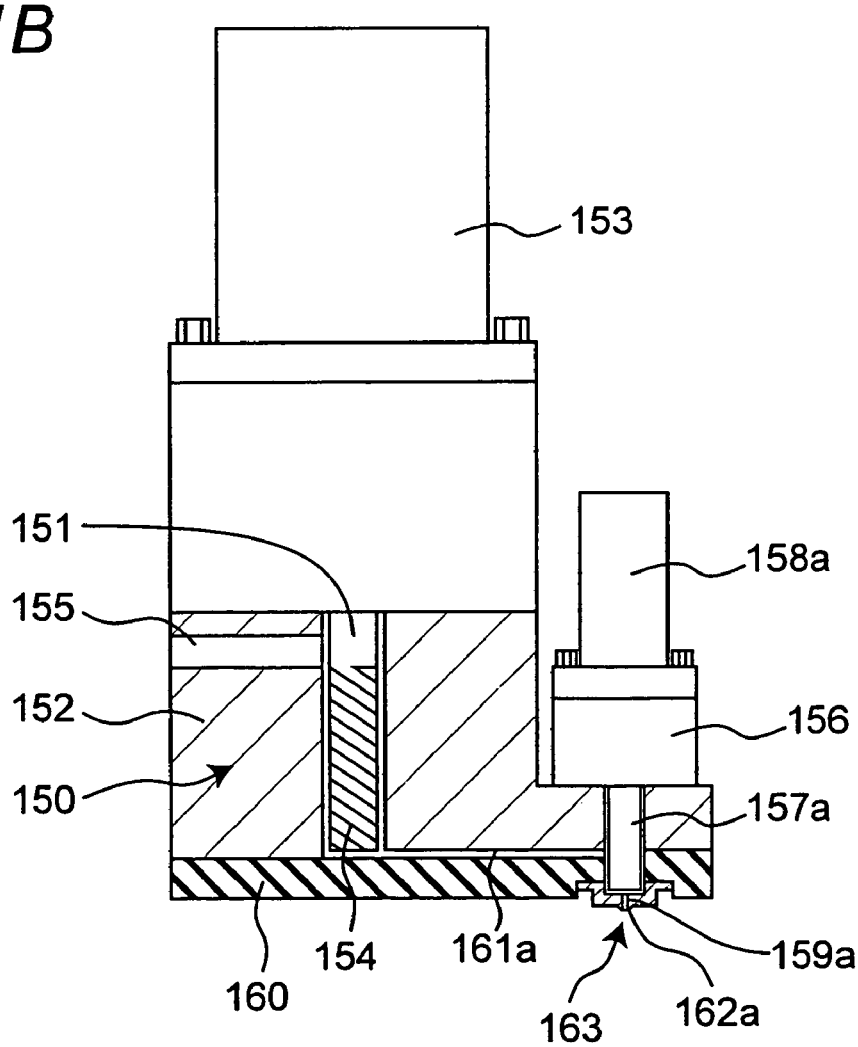

In addition, by the above-described fluid applying apparatus and method related to continuous application according to the second embodiment, rotational motion and rectilinear motion by using a two-degree-of-freedom actuator (more specifically, rotation transmission device 103A and axial-direction movement device 104A) are given to the piston 101 on which the thread groove 105 is formed. Other than this method, it is also possible to use a dispenser which is so structured that a fluid supply source (e.g., thread groove pump) and a piston that makes rectilinear motion are separated from each other, as a concrete example is shown in FIGS. 11A and 11B. Also for intermittent application, a separate type dispenser may be used likewise.

Third Embodiment

Figure 4A:
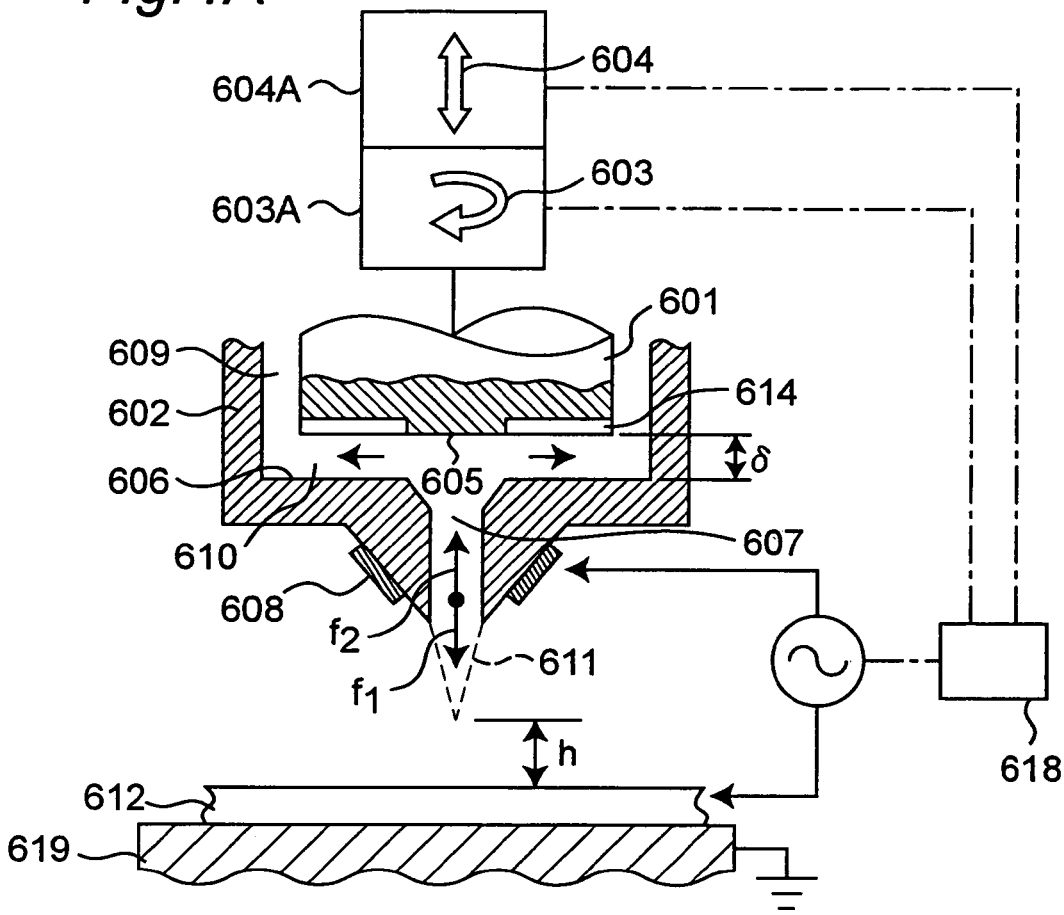
FIG. 4A is a partial cross-sectional schematic view for explaining a fluid applying apparatus according to a third embodiment of the present invention.
Figure 4B:
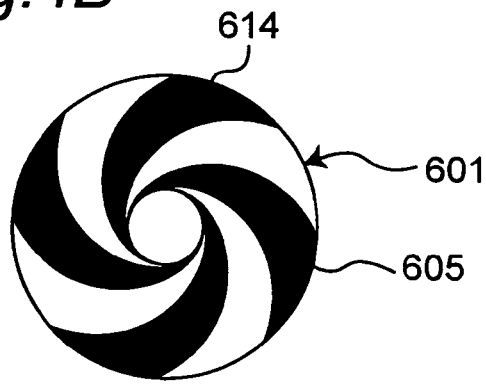
FIG. 4B is a bottom view showing a thrust dynamic seal of the fluid applying apparatus according to the third embodiment.

FIGS. 4A and 4B are partly cross-sectional schematic views for explaining a fluid applying apparatus capable of carrying out a fluid applying method according to a third embodiment of the present invention, showing a case where a thrust dynamic seal is used as another example of the device for generating the suction force $f_2$ of tending to return to the interior of the discharge nozzle. The piston shaft of a dispenser used in the fluid applying apparatus and method according to this third embodiment, like the fluid applying apparatus and method according to the second embodiment, is so structured that the piston shaft is enabled to make rectilinear motion simultaneously with rotational motion by a two-degree-of-freedom actuator (more specifically, rotation transmission device 603A and axial-direction movement device 604A). A thrust dynamic seal is formed between a discharge-side end face of the piston shaft and its opposing surface.

Reference numeral 601 denotes a piston having a thread groove like the piston 101, and 602 denotes a housing having an inlet port for applying fluid and serving for housing the piston 101 therein, like the housing 102. The piston 601 is housed so as to be capable of making rotational motion and rectilinear motion independently of each other against the fixed-side housing 602. In the case where the applying material can be treated as a nonconductive one, the housing 602 may be made of either an insulative material or a conductive material. When a conductive material is used for the whole housing 602, the nozzle tip end, which is the closest to the substrate, is the highest in electric field strength, so that the function of electric field control has no obstacles. However, when it is undesirable to apply any high voltage to the whole housing 602 in terms of safety, as a concrete example is shown in FIG. 29, it is appropriate to use an insulative material only for the discharge portion (364 in FIG. 29) where the electrode is to be provided, and to use a conductive material for the other places. Further, the piston 601 may be made of either a conductive material or an insulative material. For the rotational motion, the piston 601 can be driven into rotational motion in a direction of arrow 603 by a rotation transmission device 603A such as a motor, and for the rectilinear motion, driven forward and backward in a direction of arrow 604 by an axial-direction movement device 604A such as an air cylinder. These rotational motion and rectilinear motion are controlled by a control section 618.

Reference numeral 605 denotes an end face of the piston 601, 606 denotes its fixed-side opposing surface, 607 denotes a discharge nozzle formed at a center portion of the fixed-side opposing surface 606, and 608 denotes a ring-plate shaped housing-side electrode (referred to also as nozzle-side electrode) provided at an outer peripheral portion of the discharge nozzle 607. Numeral 609 denotes an applying fluid which is fed to a space between the thread groove of the piston 601 and the inner peripheral surface of the housing 602 and discharged from the discharge nozzle 607, 610 denotes a pump chamber formed between the end face 605 of the piston 601 and the fixed-side opposing surface 606 of the housing 602, 611 denotes an elongated portion of the applying fluid 609 having flowed out from the discharge nozzle 607, and 612 denotes a substrate (which is an example of the application object) placed on a grounded conductive base plate 619. To between the housing-side electrode 608 side and the substrate 612 side, a specified voltage V is applied by the power supply 613 controlled by the control section 618 that controls the fluid application operation of the fluid applying apparatus. Numeral 614 denotes a groove portion of the thrust dynamic seal formed on a relative movement surface of either the end face 605 of the piston 601 or its opposing surface 606 (e.g., end face 605 of the piston 601). It is noted that the groove portion 614 of the thrust dynamic seal is blackened in FIG. 4B. The magnitude of the suction force $f_2$ by the thrust dynamic seal becomes increasingly larger as a gap δ between the piston end face 605, on which the groove portion 614 of the thrust dynamic seal is formed, and its opposing surface 606 becomes narrower and moreover as the rotational speed N of the piston 601 becomes larger. Therefore, the distance h between the tip end of the meniscus 611 and the substrate 612 can be controlled by adjusting the applied value V and the frequency f, as well as the gap δ and the rotational speed N.

In this third embodiment, after an end of application, the distance h between the tip end of the meniscus and the substrate can be maintained constant in an application standby state, and moreover the tip end of the meniscus can be maintained at a position close to the substrate. Therefore, starting ends of application lines can be drawn at high grade at a start of application.

Fourth Embodiment

Figure 5A:
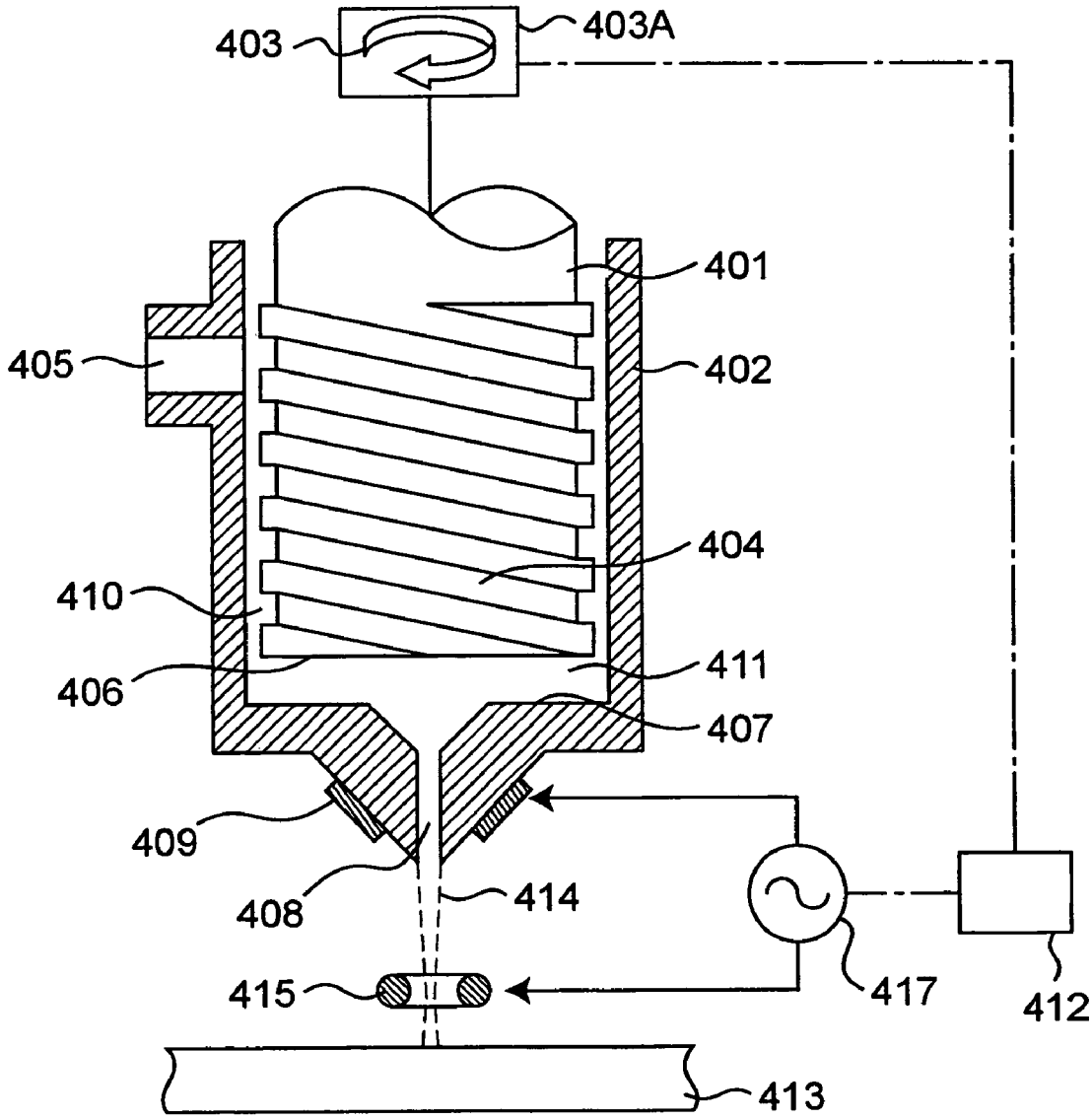
FIGS. 5A and 5B are partial cross-sectional schematic views showing fluid applying apparatuses according to a fourth embodiment of the present invention and a modification thereof, respectively.

FIG. 5A is a partly cross-sectional schematic view showing a fluid applying apparatus capable of carrying out a fluid applying method according to a fourth embodiment of the present invention, showing a case where a counter electrode (hereinafter, referred to as space electrode) is placed in a space between the discharge nozzle and the substrate without making use of the substrate as a counter electrode. That is, a voltage is applied to between the housing-side electrode, which is placed in part or entirety of the housing (dispenser), and the space electrode, by which an electric field is formed. With this constitution, there is no need for forming a conductive film on the substrate side or placing a conductive-substance plate material or the like under the substrate, so that restrictions on application objects can be eliminated. This produces an advantage for drawing ultrafine lines even in the case of, for example, a thick substrate because a large electric field strength can be formed between two electrodes.

Reference numeral 401 denotes a piston, and 402 denotes a housing for housing this piston 401 therein. In the case where the applying material can be treated as a nonconductive one, the housing 402 may be made of either an insulative material or a conductive material. When a conductive material is used for the whole housing 402, the nozzle tip end, which is the closest to the substrate, is the highest in electric field strength, so that the function of electric field control has no obstacles. However, when it is undesirable to apply any high voltage to the whole housing 402 in terms of safety, as a concrete example is shown in FIG. 29, it is appropriate to use an insulative material only for the discharge portion (364 in FIG. 29) where the electrode is to be provided, and to use a conductive material for the other places. Further, the piston 401 may be made of either a conductive material or an insulative material. The piston 401 is housed so as to be rotatable relative to the housing 402, which is the fixed side. The piston 401 is driven into forward and reverse rotation in a rotational direction of arrow 403 by a rotation transmission device 403A such as a motor.

Reference numeral 404 denotes a thread groove formed on a relative movement surface of either an outer peripheral surface of the piston 401 or an inner peripheral surface of the housing 402, e.g., on the outer peripheral surface of the piston 401, 405 denotes an inlet port of an applying fluid, 406 denotes an end face of the piston 401, 407 denotes its fixed-side opposing surface, 408 denotes a discharge nozzle formed at a center portion of the fixed-side opposing surface 407, and 409 denotes a ring-plate shaped housing-side electrode (referred to also as nozzle-side electrode) provided at an outer peripheral portion of the discharge nozzle 408. Numeral 410 denotes an applying fluid which is fed to a space between the thread groove 404 of the piston 401 and the inner peripheral surface of the housing 402 and discharged from the discharge nozzle 408, and 411 denotes a pump chamber formed between the end face 406 of the piston 401 and the fixed-side opposing surface 407 of the housing 402. Numeral 412 denotes a control section for controlling fluid application operation of the fluid applying apparatus, 417 denotes a power supply which is controlled by the control section 412 to apply a voltage to the housing-side electrode 409, 413 denotes a substrate (which is an example of the base material onto which the applying fluid 410 is to be applied), 414 denotes an elongated portion of the meniscus of the applying fluid 410 having flowed out from the discharge nozzle 408, and 415 denotes a ring-plate shaped space electrode which is placed at a space between the tip end of the discharge nozzle 408 and the substrate 413 and through the internal space of which the meniscus 414 of the applying fluid 410 passes.

In the case where the space electrode 415 is provided, the following method is taken in the fluid applying apparatus according to this fourth embodiment with a view to stably forming the meniscus 414. The following explanation is made with reference to FIGS. 6A and 6B.

① Under the control of the control section 412, the switch of the power supply 417 is turned OFF, thereby turning OFF the voltage application to the space electrode 415.

Figure 6A:
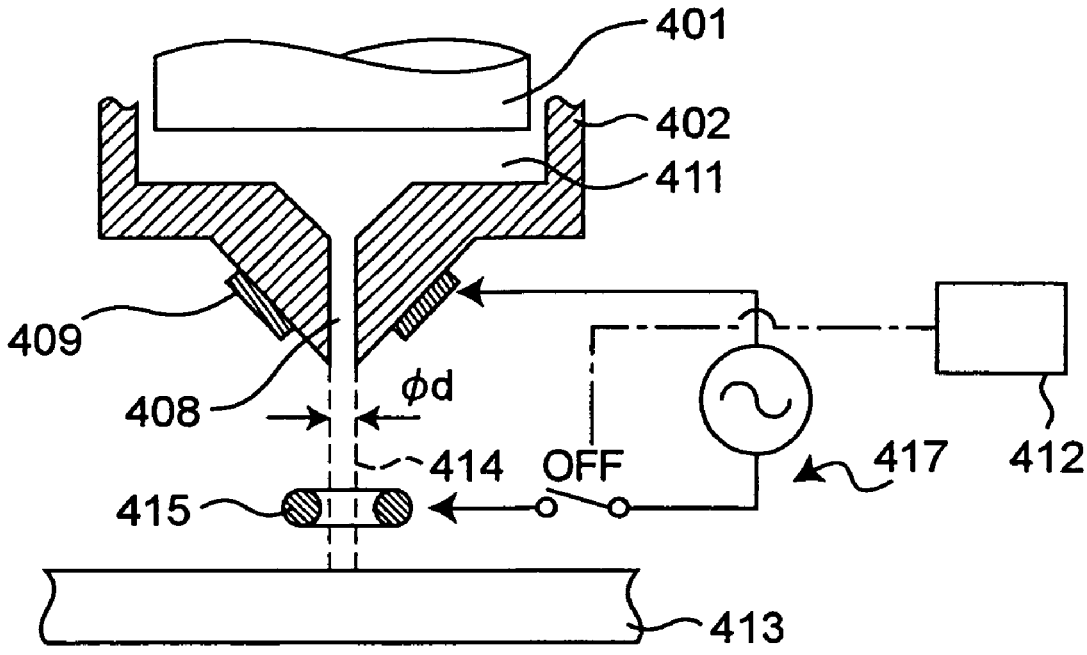
FIGS. 6A and 6B are views showing fluid menisci in a case where an electric field is not applied and another where an electric field is applied in the fluid applying apparatus according to the fourth embodiment, respectively.

② Next, under the control of the control section 412, the thread groove 404 is rapidly rotated by the rotation transmission device 403A, by which a high pumping pressure is generated in the pump chamber 411, thereby making the applying fluid 410 flown from the discharge nozzle 408. This flying state implies a state that water flows out powerfully from the tap of city water, and the line diameter ϕd of the meniscus 414 of the applying fluid 410 that flows out from the discharge nozzle 408 and passes through a center portion of the ring-shaped space electrode 415 is generally constant between the discharge nozzle 408 and the substrate 413 as shown in FIG. 6A.

③ Simultaneously as the applying fluid 410 flies, or with a slight time lag, the switch of the power supply 417 is turned ON under the control of the control section 412, thereby turning ON the voltage application to the space electrode 415. Then, during the passage of the applying fluid 410 through the center portion of the ring-shaped space electrode 415, if the meniscus 414 of the applying fluid 410 is decentered from the axial center and is low in flow speed, then the applying fluid 410 would stick to part of the space electrode 415. However, in the fluid applying apparatus and method according to this fourth embodiment, the applying fluid 410, which has already been flying at high speed, has an inertia force in the axial direction, so that the applying fluid 410 passes through within the ring of the space electrode 415, landing on the substrate 413.

Figure 6B:
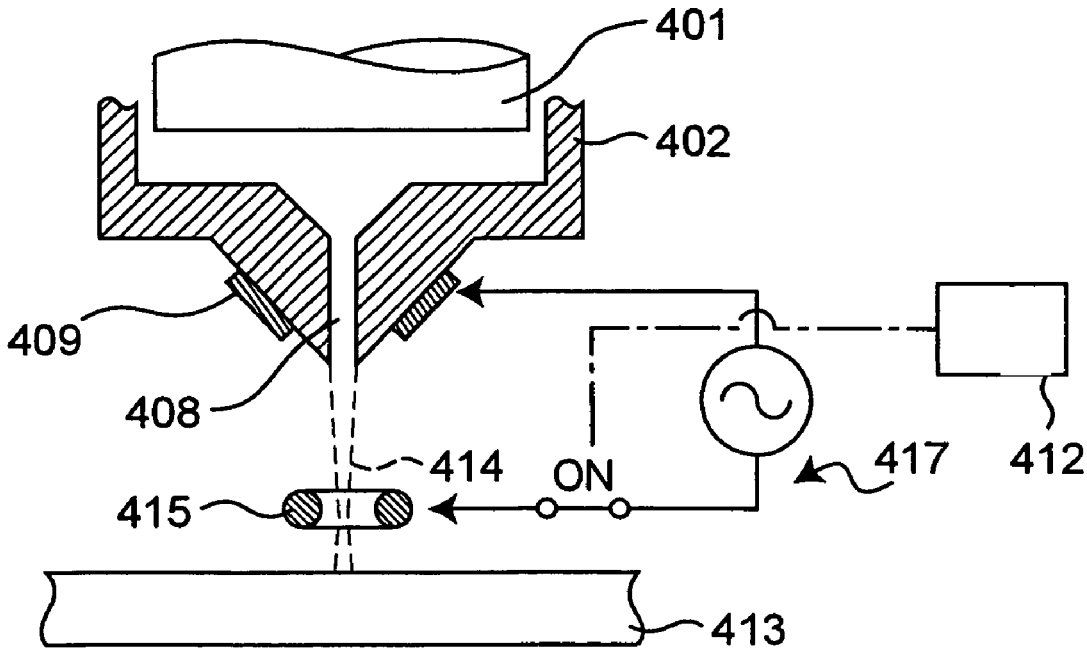

④ Thereafter, by an electric field formed between the housing-side electrode 409 and the space electrode 415, the applying fluid 410 is accelerated, so that the line diameter ϕd is thinned as shown in FIG. 6B.

In the process of above ②, with a small pumping pressure, the applying fluid 410 does not fly, and a fluid mass is formed at the tip end of the discharge nozzle 408. Then, as the fluid mass increases, the surface tension and the gravity of the fluid mass are balanced with each other, so that the meniscus elongated portion 414 is formed. In this case, because of a low speed at which the meniscus 414 is formed, when the applying fluid 410 has come close to the ring-shaped space electrode 415, the applying fluid 410 would stick to part of the space electrode 415 if the meniscus elongated portion 414 is slightly decentered.

In this fourth embodiment, the thread groove pump has been employed as the pressure supply source. However, the pump may be given in any form other than thread groove type, such as gear pump, trochoid pump and mohno pump, or if high pressure can be obtained, the air type pump may also be adopted.

In this fourth embodiment, a voltage is applied to between the housing-side electrode 409, which is placed in part or entirety of the housing (dispenser) 402, and the space electrode 415, by which an electric field is formed. Thus, there is no need for forming a conductive film on the substrate side or placing a conductive-substance plate material or the like under the substrate 413, so that restrictions on application objects can be eliminated. This produces an advantage for drawing ultrafine lines even in the case of, for example, a thick substrate 413 because a large electric field strength can be formed between the two electrodes 409, 415.

Figure 5B:
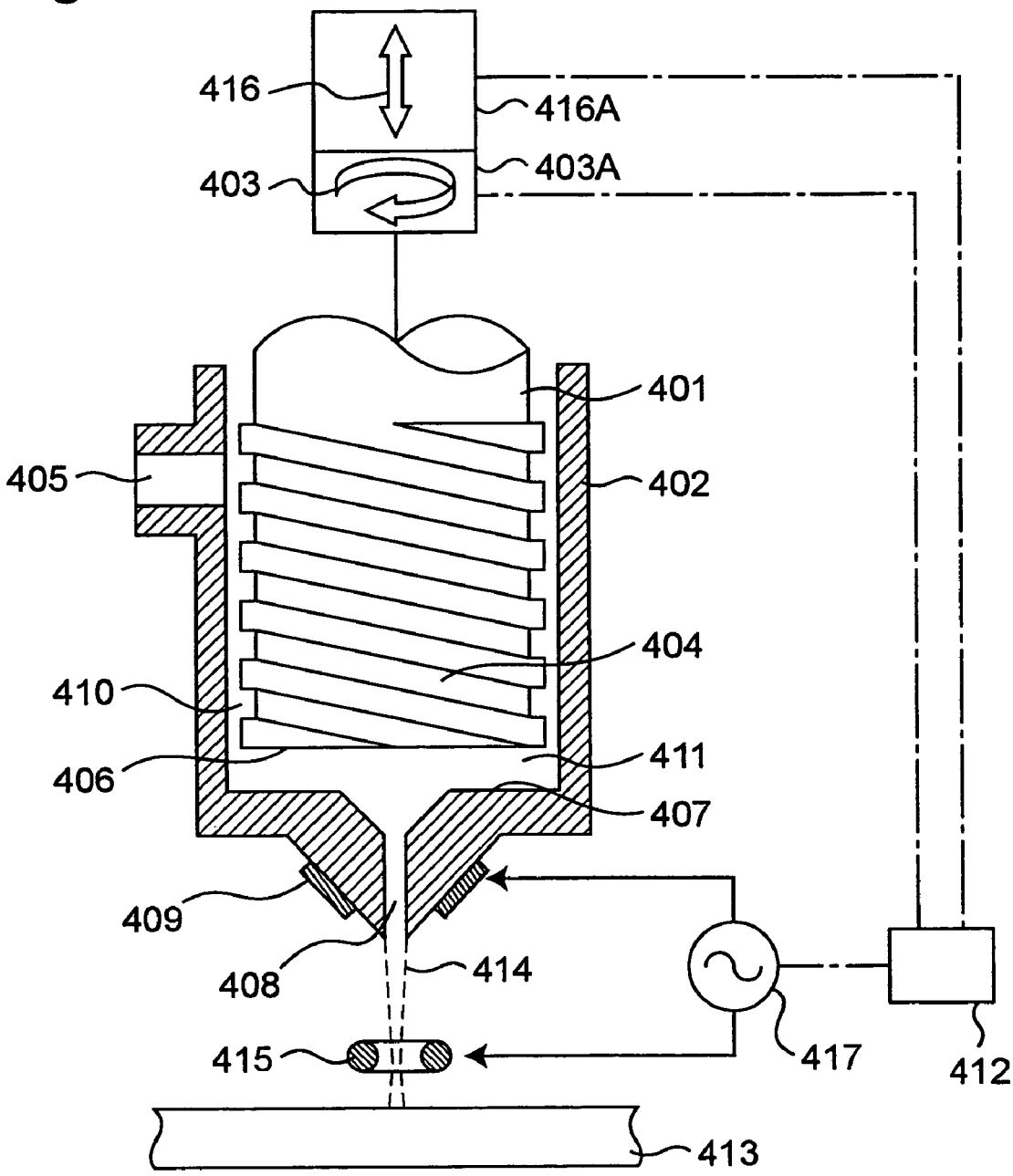

Also, as a modification of the fourth embodiment, the above-described method that uses the space electrode 415 becomes even more effective when the fluid applying apparatus of the fourth embodiment incorporates the dispenser of the two-degree-of-freedom actuator structure applied to the fluid applying apparatuses and methods according to the second and third embodiments as shown in FIG. 5B, or when a structure in which the fluid pump part and the piston part are separated from each other as will be described later in FIGS. 11A and 11B is employed. In the case where the two-degree-of-freedom actuator structure is employed as shown in FIG. 5B, the piston 401 can be driven forward and backward in a direction of arrow 416 by an axial-direction movement device 416A such as an air cylinder independently of rotational motion.

An electro-magnetostriction device (piezoelectric device, ultra-magnetostriction device, etc.) of high response may be used as the axial-direction movement device 416A. In the step of above ②, if the piston 401 is abruptly moved down by the axial-direction movement device 416A simultaneously as the thread groove 404 is rotated by the rotation transmission device 403A under the control of the control section 412, then a high pressure is generated in the pump chamber 411 by a positive squeeze effect. This instantly generated positive squeeze pressure serves as a trigger that causes the high-viscosity fluid, which is the applying fluid 410 to fly. In the state of application interruption, conversely, if the piston 401 is abruptly moved up by the axial-direction movement device 416A, then a negative pressure is generated in the pump chamber 411 by a negative squeeze effect, allowing the meniscus 414 to be sucked to the interior of the nozzle 408. Thus, in the fluid applying apparatus according to the modification of the fourth embodiment employing the two-degree-of-freedom actuator (more specifically, the rotation transmission device 403A and the axial-direction movement device 416A), combinational use of the axial-direction drive of the piston 401 makes it possible to execute the start and interruption of flying application of application lines while the voltage application to the space electrode 415 is maintained ON.

Figure 7:
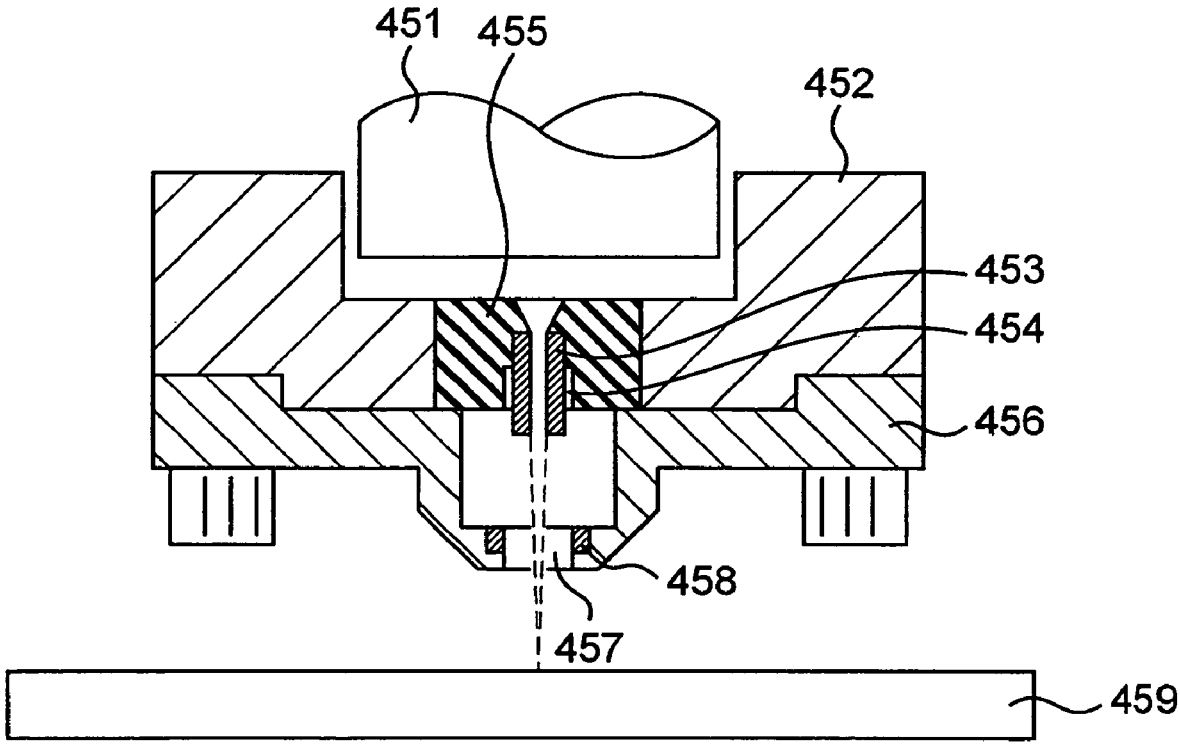
FIG. 7 is a front sectional view showing a more specific structure of a discharge nozzle of the fluid applying apparatus according to the fourth embodiment.

Further, FIG. 7 is a view showing a more specific structure of the discharge nozzle 408 of the above-described fluid applying apparatus according to the fourth embodiment.

Reference numeral 451 denotes a piston (corresponding to the piston 401 of FIG. 5A), and 452 denotes an upper housing (corresponding to the housing 402 of FIG. 5A) for housing this piston 451 therein. Numeral 453 denotes a cylindrical discharge nozzle (corresponding to the discharge nozzle 408 of FIG. 5A), which also serves a role as a nozzle-side electrode (corresponding to the housing-side electrode 409 of FIG. 5A) 454. Numeral 455 denotes a nozzle holding portion which is housed in the upper housing 452 and made of a nonconductive material and which serves to hold the discharge nozzle 453 by the center thereof. Numeral 456 denotes a lower housing fitted at a lower end portion of the upper housing 452, where a second opening 457 is formed on the opposing substrate side.

Also, a ring-shaped space electrode 458 (corresponding to the space electrode 415 of FIG. 5A) is provided at this second opening 457. Preferably, the space electrode 458 is shaped axisymmetric so as to form an axisymmetric and uniform electric field. Numeral 459 denotes a substrate as an example of the application object.

The upper housing 452 may be made of either a conductive material or an insulative material, and moreover the lower housing 456 preferably has insulative property.

With such a structure of FIG. 7, since two members, the upper housing 452 and the lower housing 456, can be fitted integrally, the degree of concentricity between the discharge nozzle 453 and the space electrode 458 can be ensured at high accuracy.

In addition, the method employing the space electrode can be applied also to the intermittent application. As described before, the meniscus of the nozzle tip end can be maintained axisymmetric in shape at all times by forming an electric field between the nozzle-side electrode and the counter electrode placed downstream thereof. Also, the surface tension between the fluid mass sticking to the nozzle tip end and the nozzle is apparently reduced by an action of the fluid projected by the electric field. Since these two actions can be obtained even in the case of the space electrode, ultrafast intermittent application with minute dot diameters becomes implementable.

Fifth Embodiment

Figure 8:
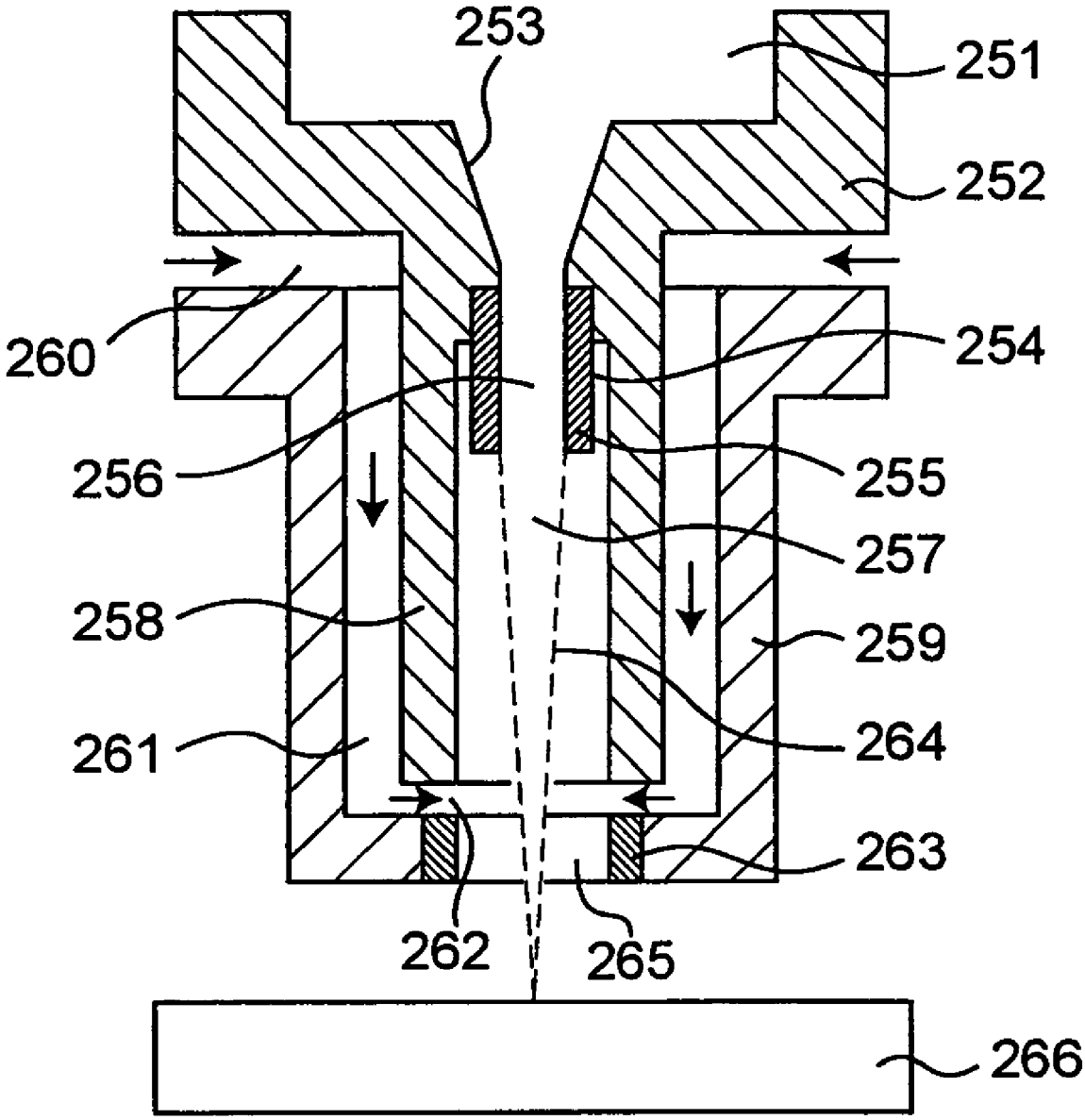
FIG. 8 is a partial cross-sectional schematic view showing a fluid applying apparatus according to a fifth embodiment of the present invention.

FIG. 8 is a partly cross-sectional schematic view of a fluid applying apparatus capable of carrying out a fluid applying method according to a fifth embodiment, where part of the above-described fluid applying apparatus and method according to the fourth embodiment is further improved. That is, an outlet opening of air (second supply fluid) is provided in proximity to the space electrode, thereby making it possible to achieve an even more stable formation of the meniscus.

Reference numeral 251 denotes a pump chamber (which corresponds to the pump chamber 411 of FIG. 5A or 5B and which is a space formed by the piston 401 and the housing 402 of FIG. 5A or 5B), 252 denotes a discharge portion (corresponding to the discharge portion in lower part of the housing 402 of FIG. 5A or 5B), 253 denotes a nozzle opening formed on the pump chamber 251 side of the discharge portion 252, 254 denotes a discharge nozzle (corresponding to the discharge nozzle 408 of FIG. 5A or 5B), which serves also as a nozzle-side electrode 255 (corresponding to the housing-side electrode 409 of FIG. 5A or 5B). Numeral 256 denotes a nozzle flow passage (first discharge passage) through which an applying fluid 257 (first supply fluid) (corresponding to the applying fluid 410 of FIG. 5A or 5B) passes. The discharge portion 252 holds the discharge nozzle 254 at a center portion on the pump chamber side, and its cylindrical portion 258 extends to the downstream side. It is noted that the piston, the housing, and the like are similar to those of the fluid applying apparatus and method according to the fourth embodiment, and so are not shown.

Reference numeral 259 denotes a lower housing which covers the cylindrical portion 258 with a gap therebetween, 260 denotes an inlet port of air (second supply fluid), 261 denotes an air passage formed between the cylindrical portion 258 and the lower housing 259, 262 denotes an air opening, and 263 denotes a space electrode (corresponding to the space electrode 415 of FIG. 5A or 5B) provided in proximity to the air opening 262. Numeral 264 denotes a meniscus of the applying fluid 257, 265 denotes a discharge passage (second discharge passage) of air and the applying fluid 257 positioned on the inner surface of the space electrode 263, and 266 denotes a substrate.

Air that has flowed in from the air inlet port 260 passes through the air passage 261, and is merged at the discharge passage 265 with the applying fluid 257 that has flowed in from the nozzle flow passage 256 (first discharge passage).

In the fluid applying apparatus and method of this fifth embodiment, because of the presence of the air opening 262 in proximity to the space electrode 263, the air forms a cylindrical flow so as to surround the peripheries of the fluid meniscus 264, so that even if the axial center of the fluid meniscus 264 is decentered in proximity to the space electrode 263, the fluid meniscus is restored from the decentered state to the central-side flowing state by the air flow, producing an effect of centering the axial center of the meniscus 264. Therefore, in the case where the pressure of the pump chamber 251 is low and the formation speed of the meniscus 264 is low at a start of application, the meniscus 264 is allowed to elongate while maintaining the axisymmetrical shape without approaching the space electrode 263, so that a stable application ultrafine lines can be started. In addition, the air opening 262, when formed at a center portion of the inner surface of the space electrode 263, becomes more effective.

In the fluid applying apparatus and method according to the fifth embodiment, air is used as the second supply fluid, but of course, other kinds of gases may also be used. Otherwise, when the mixture of fluids does not matter, liquids are acceptable.

According to this fifth embodiment, the meniscus 264 can be formed more stably by providing the outlet opening 262 for air (second supply fluid) in proximity to the space electrode 263.

Figure 9:
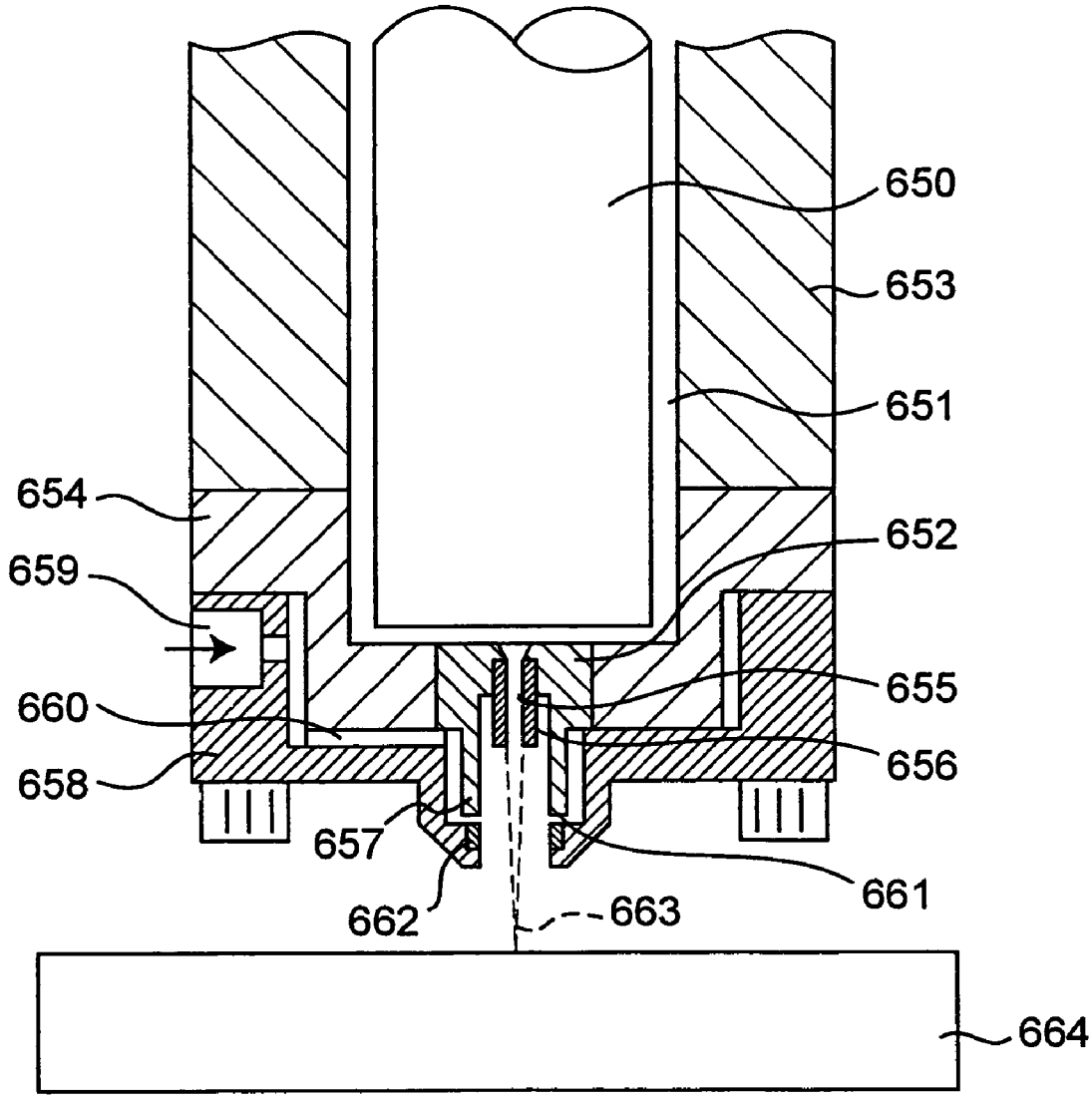
FIG. 9 is a front sectional view showing a specific structure of the discharge nozzle of the fluid applying apparatus according to the fifth embodiment.

FIG. 9 is a view showing a more specific structure of the discharge nozzle of the above-described fluid applying apparatus according to the fifth embodiment.

Reference numeral 650 denotes a piston having a thread groove similar to that of the foregoing embodiment, 651 denotes a pump chamber (corresponding to the pump chamber 251 of FIG. 8), 652 denotes a discharge portion (corresponding to part of the discharge portion 252 of FIG. 8), 653 denotes an upper housing (corresponding to part of the discharge portion 252 of FIG. 8), 654 denotes an intermediate housing (corresponding to part of the discharge portion 252 of FIG. 8), and 655 denotes a discharge nozzle (corresponding to the discharge nozzle 254 of FIG. 8), which also serves a role as a nozzle-side electrode 656 (corresponding to the housing-side electrode 255 of FIG. 8). Numeral 657 denotes a cylindrical portion of the discharge portion 652 (corresponding to the cylindrical portion 258 of FIG. 8), 658 denotes a lower housing (corresponding to the lower housing 259 of FIG. 8), 659 denotes an air inlet port (corresponding to the air inlet port 260 of FIG. 8), 660 denotes an air passage (corresponding to the air passage 261 of FIG. 8), 661 denotes an air opening (corresponding to the air opening 262 of FIG. 8), and 662 denotes a space electrode (corresponding to the space electrode 263 of FIG. 8) provided in proximity to the air opening 661.

Numeral 663 denotes a meniscus (corresponding to the meniscus 264 of FIG. 8) of the applying fluid, and 664 denotes a substrate (corresponding to the substrate 266 of FIG. 8).

With the structure of FIG. 9, since two members, the intermediate housing 654 and the lower housing 658, can be fitted integrally, the degree of concentricity between the discharge nozzle 655 and the space electrode 662 can be ensured at high accuracy.

Other Embodiments etc

FIG. 10 is a sectional view showing a concrete structure of a dispenser which can be used for the fluid applying apparatus and method according to the second embodiment as a modification of the above-described second embodiment of the present invention.

The dispenser shown below has a 'two-degree-of-freedom actuator' that gives relative rotational motion and rectilinear motion at the same time to the piston and a sleeve that houses this piston therein. That is, the dispenser ① rectilinearly drives the piston by a first actuator, so that a positive and a negative abrupt pressure is generated to a discharge-side end face of the piston; and ② rotates the piston, on which a thread groove is formed, by a second actuator that gives rotational motion, so that a pumping pressure is generated to pressure-feed the applying fluid to the discharge side.

In addition to the combination of above ① and ①, an electric field is formed between the dispenser and the substrate, by which the control for fast interruption and fast release of ultrafine application lines has been achieved.

Referring to FIG. 10, reference numeral 201 denotes a first actuator (corresponding to the axial-direction movement device 104A of FIG. 3A), where in the fluid applying apparatus according to the second embodiment is employed an ultra-magnetostriction device which is capable of obtaining high positioning accuracy, has high response, and capable of obtaining large load generation in order to feed a high-viscosity fluid at high speed, intermittently, in very small amounts and with high accuracy. Numeral 202 denotes a main shaft (piston) (corresponding to the piston 101 of FIG. 3A) driven by the first actuator 201. This first actuator 201 is housed in an upper housing 203, and an intermediate housing 204 for housing the main shaft 202 therein is fitted at a lower end portion (front side) of the upper housing 203. Numeral 205 denotes a second actuator (corresponding to the rotation transmission device 103A of FIG. 3A), such as a motor, which gives relative rotational motion to between the main shaft 202 and each housing 203, 204. Numeral 206 denotes a cylindrical-shaped ultra-magnetostriction rod implemented by an ultra-magnetostriction device. Numeral 207 denotes a magnetic field coil for giving a magnetic field along a longitudinal direction of the ultra-magnetostriction rod 206. Numerals 208, 209 denote permanent magnets for giving a bias magnetic field to the ultra-magnetostriction rod 206. Numeral 210 denotes a rear-side yoke which is placed on the rear side of the ultra-magnetostriction rod 206 and which is a yoke member of a magnetic circuit. It is noted that the main shaft 202 is placed on the front side of the ultra-magnetostriction rod 206 and serves also as a yoke member of a magnetic circuit. That is, the ultra-magnetostriction rod 206, the magnetic field coil 207, the permanent magnets 208, 209, the rear-side yoke 210, and the main shaft 202 constitute an ultra-magnetostriction actuator (first actuator 201) capable of controlling the extension and contraction in the axial direction of the ultra-magnetostriction rod with a current fed to the magnetic field coil. Numeral 211 denotes a rear-side sleeve for rotatably housing therein an upper main shaft 212 integrated with the rear-side yoke 210. This rear-side sleeve 211 is also rotatably held to the upper housing 203 by bearings 230.

Reference numeral 213 denotes a bias spring for giving a preload to the ultra-magnetostriction rod 206. Rotational driving force transmitted from the second actuator 205 such as a motor is transmitted to the main shaft 202 by a rotation transmission key (not shown) provided between a central shaft 214 and the main shaft 202. Also, the main shaft 202 is housed so as to be movable in axial and rotational directions by a bearing 215 provided between the main shaft 202 and the intermediate housing 204. Numeral 216 denotes a displacement sensor for detecting axial displacement of the main shaft 202. With this constitution, a 'two-degree-of-freedom, composite-operation actuator' has been implemented in which the main shaft 202 of the apparatus is enabled to simultaneously and independently perform the control for rotational motion and very small-displacement rectilinear motion.

Reference numeral 217 denotes a thread groove shaft fixed to the main shaft 202, 218 denotes a thread groove (corresponding to the thread groove 105 of FIG. 3A) for pressure-feeding the fluid, which is formed on the outside surface of the thread groove shaft 217, to the discharge side, 219 denotes a fluid seal, and 220 denotes a lower housing (corresponding to the housing 102 of FIG. 3A) These thread groove shaft 217 and lower housing 220 defines therebetween a pump chamber 221 (corresponding to the pump chamber 112 of FIG. 3A) for obtaining a pumping action by relative rotation of the thread groove shaft 217 and the lower housing 220. Also, an inlet hole 222 communicating with the pump chamber 221 is formed in the lower housing 220.

Reference numeral 223 denotes a discharge nozzle (corresponding to the discharge nozzle 109 of FIG. 3A) fitted to a lower end portion of the lower housing 220, 224 denotes a nozzle casing for fixing the discharge nozzle 223 to the lower housing 220, and 225 denotes a housing-side electrode (corresponding to the housing-side electrode 110 of FIG. 2) fitted to the tip end of the discharge nozzle.

Taking the advantage that the piston 202 driven by the ultra-magnetostriction device is capable of performing high-speed rectilinear motion simultaneously with rotation, this modification of the second embodiment is intended to solve issues related to starting and terminating ends of application lines by the following method:

With a short rest time T between a continuous application operation and a continuous application operation each having a finite line width, for example, in the case where T=0.3 to 0.5 sec. or less, with a voltage kept applied from the power supply 115 to between the electrode 225 and the substrate (not shown), ① at an end of application, under the control of the control section 116, the piston (main shaft 202) continues to be moved up by the first actuator 201 during the rest time while the thread groove 218 is kept rotated by the second actuator 205; and ② at a start of application, under the control of the control section 116, the piston 202 is moved down by the first actuator 201.

Also, with a long rest time T, for example, in the case where T>0.5 sec.,

① at an end of application, under the control of the control section 116, simultaneously when the piston 202 is moved up by the first actuator 201, the motor, which is an example of the second actuator 205 is stopped from rotating. Further, the motor that is an example of the second actuator 205, after stopped from rotating, is reversely rotated slowly; and ② at a start of application, under the control of the control section 116, simultaneously when the piston (main shaft 202) is moved down by the first actuator 201, the motor that is an example of the second actuator 205 is started being rotated forward.

In this modification of the second embodiment, since the piston 202 is driven by an ultra-magnetostriction device, the responsivity of output displacement relative to an input signal of the piston 202 is of the order of $10^{-3}$ sec. (1000 Hz). The ultra-magnetostriction device is a kind of electro-magnetostriction device like a later-described piezoelectric device, having a high response and a high pressure generation. Since the time lag of a squeeze pressure generation against a change in gap is an insignificant one, a response for the control of starting and terminating ends two-order higher than that of the conventional electric-field jet method in which air pressure is used as an auxiliary pressurization source can be obtained.

Further, FIGS. 11A and 11B are views showing, as another modification of the above-described second embodiment of the present invention, a concrete structure of another mode of a dispenser that can be used for the fluid applying apparatus of the second embodiment, showing a concrete example in which a dispenser having a thread groove and a piston separated from each other is combined with the electric-field jet method.

In the above-described structure of FIG. 10, rotation and rectilinear motion are given to the thread groove shaft independently of each other by a two-degree-of-freedom actuator. In contrast, in FIGS. 11A and 11B, the function of generating a pumping pressure by the thread groove and the function of generating a squeeze pressure by varying the gap between piston end faces are provided separately from each other.

Reference numeral 150 denotes a thread groove pump portion (fluid supply portion), and 151 denotes a thread groove shaft (corresponding to the piston 101 of FIG. 3A), which is housed in the housing 152 so as to be movable in the rotational direction. The thread groove shaft 151 is rotationally driven by a motor which is an example of a rotation transmission device 153. Numeral 154 denotes a thread groove (corresponding to the thread groove 105 of FIG. 3A) formed on a relative movement surface of either an outer peripheral surface of the thread groove shaft 151 or an inner peripheral surface of the housing 152, and 155 denotes an applying-fluid inlet port (corresponding to the inlet port 106 of FIG. 3A). Numeral 156 denotes a piston portion, 157*a* denotes a piston, 158*a* denotes a piezoelectric actuator, which is an axial-direction drive unit of the piston 157*a*, and 159*a* denotes a discharge nozzle. Numeral 160 denotes a lower plate, and 161*a* denotes an applying-fluid flow passage which connects an end portion of the thread groove shaft and an outer peripheral portion of the piston to each other and which is formed between the housing 152 and the lower plate 160.

In the piston portion 156 are placed piezoelectric actuators 158*a*, 158*b*, 158*c* having an identical structure, and pistons 157*a*, 157*b*, 157*c* driven by these piezoelectric actuators 158*a*, 158*b*, 158*c* independently of one another. From the thread groove pump portion 150, fluid is fed through three flow passages 161*a*, 161*b*, 161*c* to the pistons 157*a*, 157*b*, 157*c*, respectively. Numerals 162*a*, 162*b*, 162*c* denote housing-side electrodes (corresponding to the housing-side electrode 110 of FIG. 2) which are provided at tip ends of the discharge nozzles, respectively, and which serve for electric field control. These housing-side electrodes 162*a*, 162*b*, 162*c* as well as the application-object substrate will be referred to an electrode portion 163.

Thus, as shown in FIGS. 11A and 11B, with a structure of the fluid applying apparatus in which the thread groove pump portion 150, which is a fluid supply device, and the piston portion 156 are separated from each other, an application head having multiple nozzles can be implemented by resupplying the applying fluid in branched ways from one set of the thread groove pump portion 150 to a plurality of pistons 157*a*, 157*b*, 157*c*.

The above modification of the second embodiment of the separate type dispenser is so constructed that the thread groove pump portion 150, which is a fluid supply device, and the piston portion 156 are housed inside a common housing. Other than this construction, it is also possible to adopt a construction that the thread groove pump portion 150 and the piston portion 156 are provided as separate units and connected to each other by means of piping.

Figure 12:
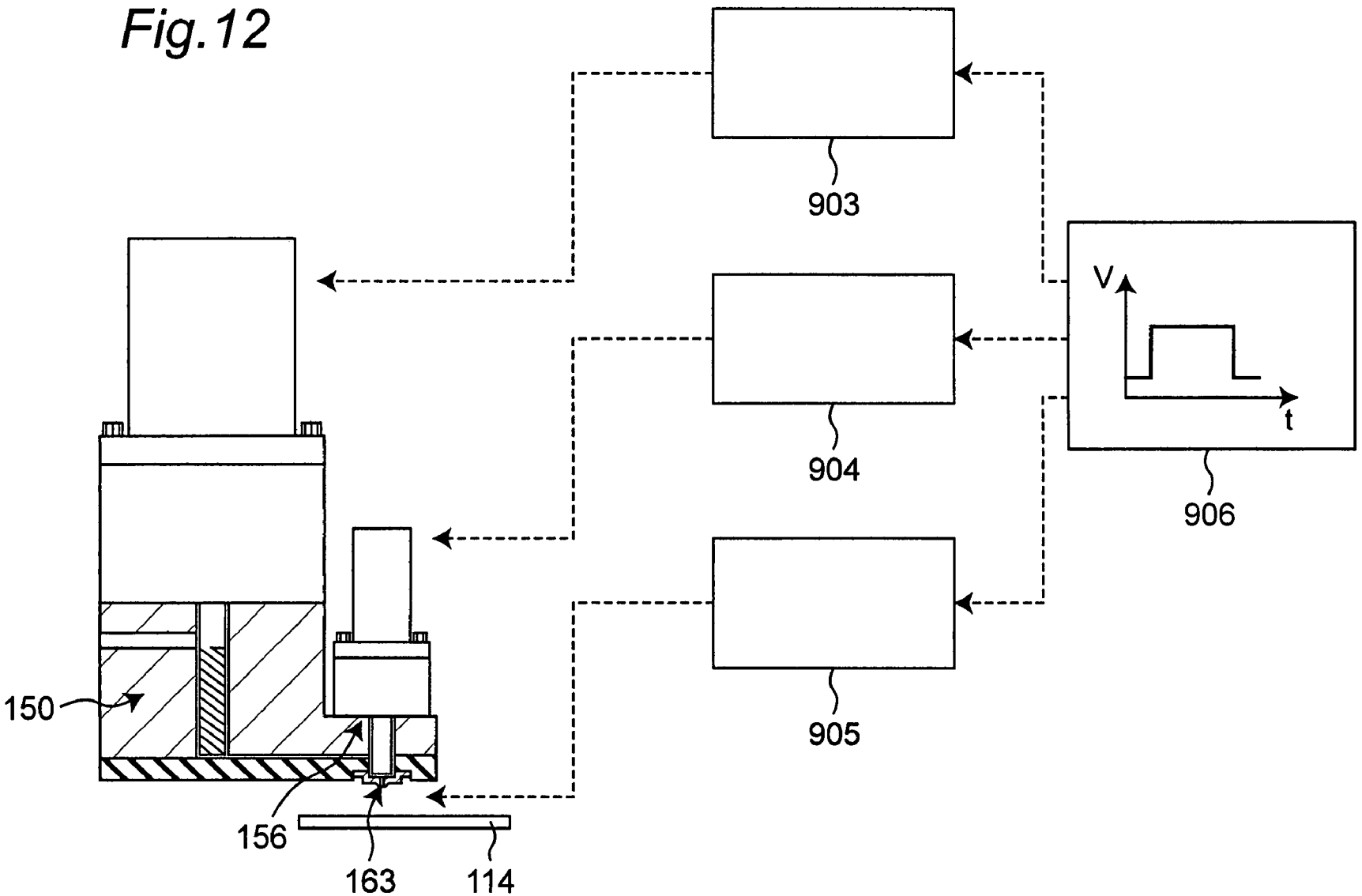
FIG. 12 is a control block diagram in a case where release-and-interruption control over application lines is exerted by using a separate type dispenser with electric field control.

Further, FIG. 12 shows a control block diagram in a case where release-and-interruption control over application lines is exerted by using a separate type dispenser with electric field control of FIGS. 11A and 11B.

Reference numeral 150 denotes a fluid supply portion (corresponding to the thread groove pump portion of FIGS. 11A and 11B), 156 denotes a piston portion (corresponding to the piston portion of FIGS. 11A and 11B), 163 denotes an electrode portion (corresponding to the electrode portion of FIGS. 11A and 11B), 903 denotes a motor power supply section for a motor, which is an example of the rotation transmission device 153, 904 denotes a piston power supply section for the piezoelectric actuators 158*a*, 158*b*, 158*c*, 905 denotes an electrode power supply section for the electrode portion 163, 906 denotes a control section which serves to control fluid application operation of the fluid applying apparatus and which controls the motor power supply section 903, the piston power supply section 904, and the electrode power supply section 905, and 114 denotes a substrate. Application start and interruption of application lines can be performed by controlling the individual power supplies 903 to 905 based on information derived from the common control section 906.

Which is controlled among the rotational speed of the motor, the method of axial-direction movement of the piston, and the electric field, whichever is the best, may be selected by the control section 906 in accordance with applied processes.

Figure 13:
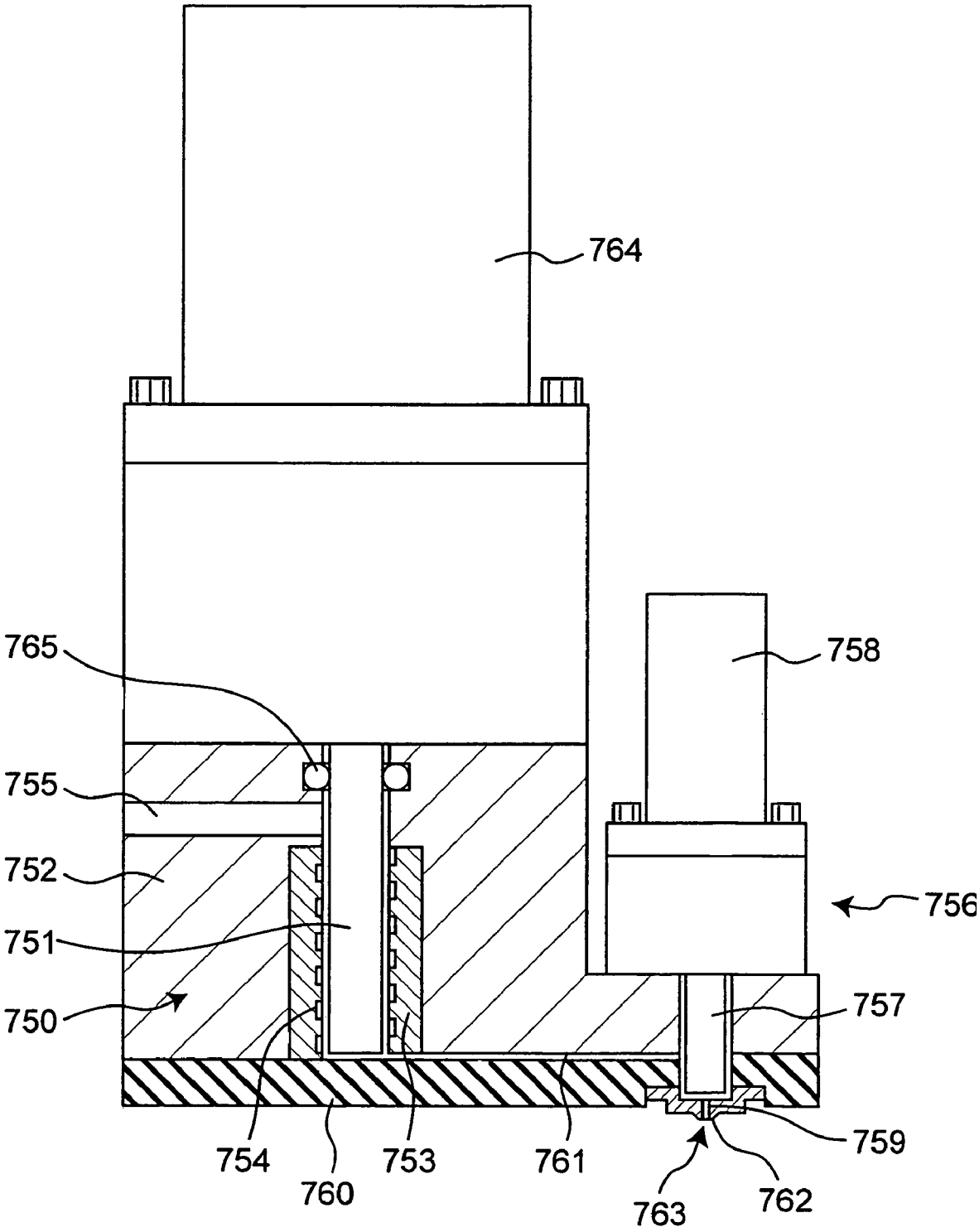
FIG. 13 is a structural view of a dispenser in a case where a separate type dispenser is used to provide electrical insulation between an electrode and each member.

FIG. 13 is an embodiment showing insulation measures on the dispenser side in a case where an electrode material is applied to the substrate by using the fluid applying apparatus or method according to the present invention. In applying a material in which conductive fine particles of silver paste or the like are included, there is a possibility that electrical conduction may occur between the nozzle electrode, to which a high voltage (hundreds V—a few kV) is applied, and the fixed-side main-body housing via the conductive material. In the event of such conduction, it may occur that the control device may be broken by the high voltage, given that the main-body housing of the fluid applying apparatus serves as the ground of the control device. Generally, via narrow gaps of the order of server tens of microns, such a risk potentially exists at all times in the fluid supply portion that generates pressure by relative rotation between a rotating member and a fixed member.

This embodiment of FIG. 13 is intended to solve newly involved issues of the present invention due to the provision of a device for increasing or reducing the fluid pressure in the pump chamber by using a mechanism of rotational motion or rectilinear motion. These issues are not involved in the conventional electric-field jet method.

Reference numeral 750 denotes a thread groove pump portion (fluid supply portion), 751 denotes a rotating shaft, 752 denotes a housing, and 753 denotes a thread groove sleeve press-fitted into the housing 752. A thread groove 754 is formed on the inner surface of the thread groove sleeve 753. Numeral 755 denotes an inlet port for applying fluid, 756 denotes a piston portion, 757 denotes a piston, 758 denotes a piezoelectric actuator which is an axial-direction drive unit of the piston 757, 759 denotes a discharge nozzle, 760 denotes a lower plate, 761 denotes a flow passage for applying fluid, 762 denotes a nozzle-side electrode (corresponding to the housing-side electrode) which is provided at tip end of the discharge nozzle 759 and which serves for electric field control, 763 denotes an electrode portion including the nozzle-side electrode 762, the application-object substrate, or the like, 764 denotes a motor for rotationally driving the rotating shaft 751, and 765 denotes a fluid seal.

In order to provide electrical insulation between the electrode portion 763 and the other members, the electrode portion 763 being composed of the nozzle-side electrode 762 and the counter electrode provided downstream side of the nozzle (the substrate or the space electrode), there are taken measures shown below. The rotating shaft 751, the piston 757, and the lower plate 760 are made of nonconductive ceramics material.

Instead of a thread groove formed on the outer peripheral surface of the nonconductive rotating shaft 751, the thread groove 754 is formed on the inner surface of the thread groove sleeve 753, which is the counter surface of the relative rotation of the rotating shaft 751. It is noted that the thread groove sleeve 753 can be manufactured from a ferrous metal that can be easily treated for high-precision groove machining. The thread groove pump portion (fluid supply portion) 750, whose gap of the relative movement surface is on the order of tens of microns, would be the largest in likelihood of electrical short circuits when made of a material containing conductive-material fine particles. However, the thread groove pump portion 750 can be completely insulated with the above-shown construction.

In the embodiment of FIG. 13, a thread groove pump has been employed as the fluid supply portion 750. However, similar measures can be provided even with any form of pump other than thread groove type, such as gear pump, trochoid pump, and mohno pump. That is, it is appropriate that a nonconductive material is used for the rotating (rotor) part of the pump while a metal material is used on the fixed side that needs high inner-surface precision. Of course, a nonconductive material may be used for both rotational side and fixed side. Even when a conductive material is not used as the applying material, taking insulation measures proposed by the embodiment of FIG. 13 provides enough safety measures.

In any of the various embodiments described hereinabove, the fluid meniscus of the applying fluid that has flowed out from the discharge nozzle maintains constant in its position and shape during the application. Hereinbelow, the method of applying the applying fluid onto the substrate by positively controlling the shape and position of the meniscus is explained.

Figure 14:
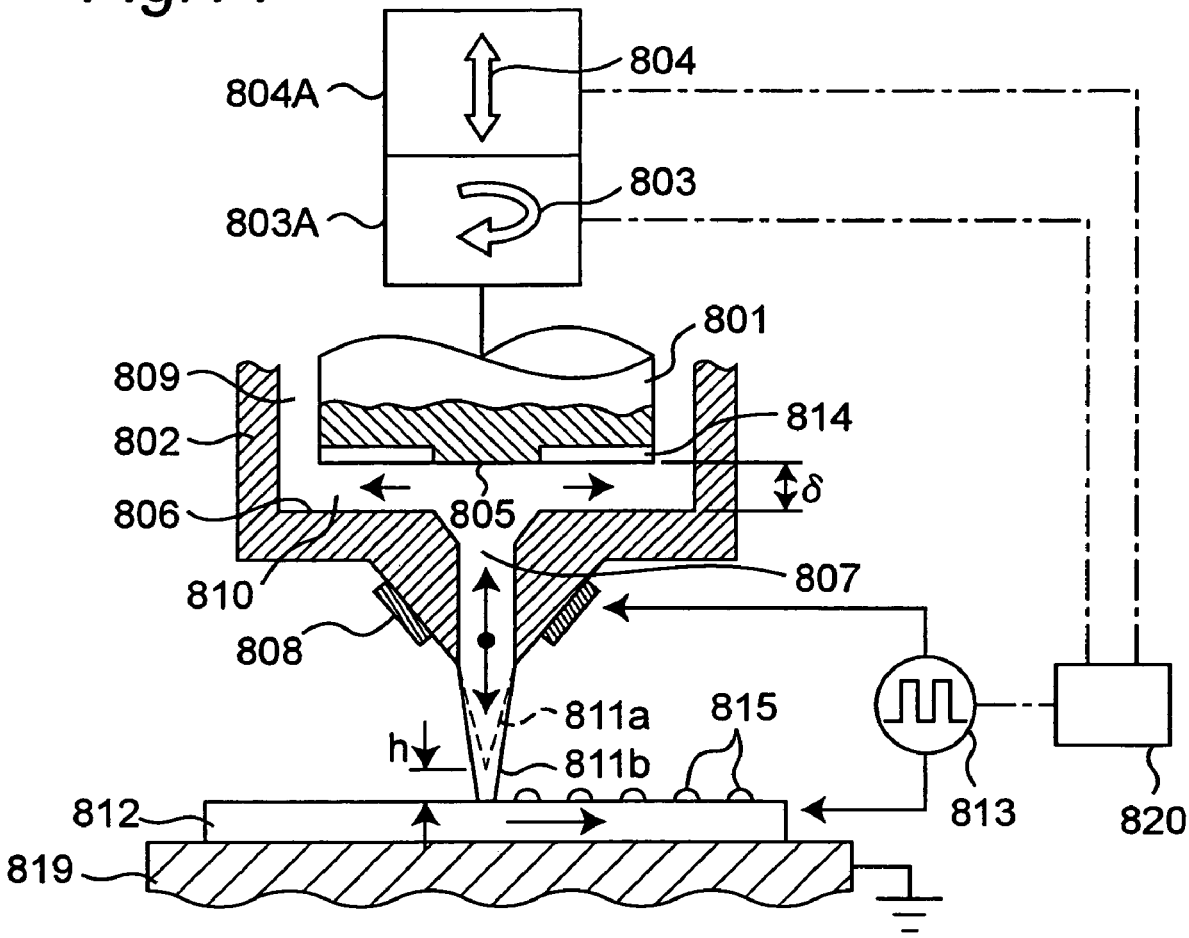
FIG. 14 is a partial cross-sectional schematic view for explaining the principle of control of meniscus shape and position.

FIG. 14 is a partly cross-sectional schematic view for explaining the principle therefor, showing a case where a thrust dynamic seal is used as a device for generating the suction force $f_2$ of tending to return to the interior of the discharge nozzle, as in the third embodiment. The force $f_1$ of projecting the applying fluid from the discharge nozzle is generated by giving an electric field. By these projecting force $f_1$ and suction force $f_2$ being balanced with each other, the distance h between the meniscus tip end position and the substrate is maintained constant, so that the meniscus tip end position can be positioned stably.

In this connection, a method for continuous and intermittent application by projecting a meniscus from a nozzle is disclosed also in a prior-art proposal of the electric-field jet method (Japanese unexamined patent publications No. 2000-246887, No. 2001-137760). However, these patent publications do not disclose a method that a suction force and a force of the meniscus-projecting action due to an electric field are balanced with each other by using a mechanism that positively generates a negative pressure in the pump chamber, as is disclosed in the embodiment according to FIG. 14 and the third embodiment. As an object matter supported at its both ends by a spring can maintain a stable state, the present invention is so devised that two forces (i.e., suction force and meniscus-projecting force due to an electric field) are balanced with each other at the nozzle so as to allow the naturally unstable fluid meniscus to be stably positioned.

In this FIG. 14, the piston shaft of the dispenser used in the foregoing various embodiments is, as in the second embodiment, so structured as to be capable of performing rotational motion as well as rectilinear motion at the same time by the two-degree-of-freedom actuator. A thrust dynamic seal is formed between a discharge-side end face of this piston shaft and its opposing surface. Referring to FIG. 14, reference numeral 801 denotes a piston having a thread groove similar to, for example, the piston 101, and 802 denotes a housing having an inlet port for applying fluid and serving for housing the piston 801 therein like the housing 102. The piston 801 is housed so as to be capable of controlling rotational motion and rectilinear motion independently of each other over the fixed-side housing 802. In the case where the applying material can be treated as a nonconductive one, the housing 802 may be made of either an insulative material or a conductive material. When a conductive material is used for the whole housing 802, the nozzle tip end, which is the closest to the substrate, is the highest in electric field strength, so that the function of electric field control has no obstacles. However, when it is undesirable to apply any high voltage to the whole housing 802 in terms of safety, as a concrete example is shown in FIG. 29, it is appropriate to use an insulative material only for a discharge portion (364 in FIG. 29) where the electrode is to be provided, and to use a conductive material for the other places. Further, the piston 801 may be made of either a conductive material or an insulative material. The piston 801 can be driven for rotational motion in a direction of arrow 803 by the rotation transmission device 803A such as a motor, while the piston 801 can be driven back and forth for rectilinear motion in a direction of arrow 804 by the axial-direction movement device 804A such as an air cylinder. Numeral 805 denotes an end face of the piston 801, 806 denotes its fixed-side opposing surface, 807 denotes a discharge nozzle formed at a center portion of the fixed-side opposing surface 806, and 808 denotes a ring-plate shaped housing-side electrode (referred to also as nozzle-side electrode) provided at an outer peripheral portion of the discharge nozzle 807. Numeral 809 denotes an applying fluid which is fed to between the thread groove of the piston 801 and the inner peripheral surface of the housing 802 and discharged from the discharge nozzle 807, 810 denotes a pump chamber formed between the end face 805 of the piston 801 and the fixed-side opposing surface 806 of the housing 802, 811*a* denotes a fluid meniscus which has flowed out from the discharge nozzle 807 and which is shown by dotted line in a state that the elongated portion of the meniscus has moved up with its tip end to be away from a substrate 812, and 811*b* denotes a fluid meniscus which has flowed out from the discharge nozzle 807 and which is shown by solid line in a state that the elongated portion of the meniscus has moved down with its tip end to be brought into contact with the substrate 812. Numeral 812 denotes a substrate which is an example of the application object placed on, for example, a grounded conductive base plate 819. To between the housing-side electrode 808 and the substrate 812, a specified voltage V is applied by power supply 813 controlled by a control section 820 that controls the fluid application operation of the fluid applying apparatus. Numeral 814 denotes a groove portion of a thrust dynamic seal (corresponding to the groove portion 614 of the thrust dynamic seal of FIGS. 4A and 4B) formed on a relative movement surface of either the end face 805 of the piston 801 or its fixed-side opposing surface 806 (end face 805 in FIG. 14). Further, numeral 815 denotes an applying fluid intermittently applied in the form of dots on the substrate 812. The control section 820 controls the fluid application operation of the fluid applying apparatus and controls the voltage application operation such as turn-ON and -OFF of the power supply 813, the rotational motion performed by the rotation transmission device 803A, and the rectilinear motion performed by the axial-direction movement device 804A.

Figure 15:
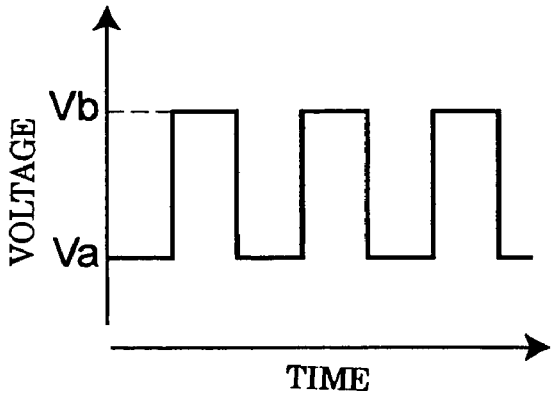
FIG. 15 is a chart showing a voltage waveform with time elapse.

FIG. 15 shows a waveform of the voltage applied from the power supply 813 to between the housing-side electrode 808 and the substrate 812. Given a voltage $V_a$, if the suction force $f_2$ by the thrust dynamic seal is constant, the force $f_1$ of projecting the applying fluid 809 from the discharge nozzle by an electric field is decreased so as to be smaller than the suction force $f_2$, causing the applying fluid 809 to be sucked up, so that the elongated portion of the meniscus is put into an moved-up state 811*a*. Meanwhile, given a voltage $V_b$, which is larger than $V_a$, the projecting force $f_1$ is increased so as to be larger than the suction force $f_2$, causing the applying fluid 809 to be projected, so that the elongated portion of the meniscus is put into a moved-down state 811*b*, where the applying fluid 809 is discharged, and transferred, onto the substrate 812. Absolute value and stroke of the meniscus tip end position can be adjusted by the control section 820 by changing the magnitude of the center value of the applied voltage and its voltage amplitude. Otherwise, the control can be achieved by adjusting the gap δ of the thrust dynamic seal, the rotational speed N of the piston, or the like instead of controlling the electric field. By the method shown in this embodiment, dots of ultrasmall diameters which are of any arbitrary magnitude can be applied stably with high speed. Further, continuous application is also implementable, and the line width of drawing lines can be changed during the application. Although a dynamic seal is used for making a negative pressure in the pump chamber in the embodiment of FIG. 14, yet other methods are adoptable. For example, the thread groove may be slowly reverse rotated, or with a negative-pressure generation source and the pump chamber communicated with each other, the pressure of the negative-pressure generation source may be controlled.

Otherwise, as explained in the second embodiment, the gap between the piston and its opposing surface may be increased and decreased. While the gap is increasing, the pump chamber can be maintained at a negative pressure, so that the tip end of the meniscus is separated from the substrate, causing the application to be interrupted. Conversely, decreasing the gap causes the tip end of the meniscus to land on the substrate, allowing the application to be started. With the use of a dispenser employing a two-degree-of-freedom actuator or a separate type dispenser, and with the use of a thread groove pump as a fluid supply source, the average flow rate can be set securely by the rotational speed of the thread groove, thus making it implementable to achieve application of high flow-rate precision.

II. Concrete Applicative Examples to Displays

The present invention can be applied also to, for example, electrode formation of PDP front-face plates.

(1) Structure of Plasma Display Panels

FIG. 3G shows an example of the structure of a plasma display panel (hereinafter, referred to as PDP). A PDP is composed roughly of a front-face plate 1800 and a back-face plate 1801. On a first substrate 1802, which is a transparent substrate forming the front-face plate 1800, a plurality of sets of linear transparent electrodes 1803 are formed. Also, on a second substrate 1804, which forms the back-face plate 1801, a plurality of sets of linear electrodes 1805 perpendicular to the linear transparent electrodes 1803 are provided so as to be parallel to one another. The two substrates 1802 and 1804 are opposed to each other via bias ribs 1806 on which fluorescent substance layers are formed, and dischargeable gas is filled and sealed in the bias ribs 1806. When a voltage equal to or higher than a threshold value is applied to between the electrodes 1803 and 1805 of the two substrates 1802 and 1804, there occurs discharge at positions at which the two electrodes 1803 and 1805 perpendicularly cross each other, causing the dischargeable gas to emit light, where the light emission can be observed through the transparent first substrate 1802. Then, an image can be displayed on the first substrate by controlling the discharge position (discharge point). For implementing color display with the PDP, fluorescent substances that develop desired colors at individual discharge points by ultraviolet rays radiated upon discharge are formed at positions (partition walls of the barrier ribs) corresponding to the individual discharge points. For implementing full color display, RGB fluorescent substances are formed, respectively.

The front-face plate 1800 is explained in more detail. As to the front-face plate 1800, a plurality of sets of linear transparent electrodes 1803, each one set comprising two electrodes, are formed from ITO or the like, parallel to one another, on the inner surface side of the first substrate 1802 formed of a transparent substrate such as a glass substrate. Bus electrodes 1807 for reducing the line resistance value are formed on the inner-side surfaces of these linear transparent electrodes 1803. A dielectric layer 1808 for covering those transparent electrodes 1803 and bus electrodes 1807 is formed all over the inner surface of the front-face plate 1800, and an MgO layer 1809 serving as a protective layer is formed all over the surface of the dielectric layer 1808.

On the other hand, on the inner surface side of the second substrate 1804 of the back-face plate 1801, a plurality of linear address electrodes 1805 which perpendicularly cross the linear transparent electrodes 1803 of the front-face plate 1800 are formed in parallel from silver material or the like. Also, a dielectric layer 1810 for covering those address electrodes 1805 is formed all over the inner surface of the back-face plate 1801. On the dielectric layer 1810, the address electrodes 1805 are isolated and moreover the barrier ribs (partition walls) 1806 of a specified height are formed so as to protrude between the individual address electrodes 1805 for the purpose of maintaining the gap distance between the front-face plate 1800 and the back-face plate 1801 constant. With these barrier ribs 1806, rib gap portions 1811 are formed along the individual address electrodes 1805, and fluorescent substance layers 1812 of respective R, G, and B colors are successively formed in the inner surfaces of the rib gap portions 1811. The fluorescent substance layers 1812 to be formed on the rib wall surfaces are thickly deposited generally to about 10 to 40 μm for better color developing property. For the formation of the fluorescent substance layers 1812 for the respective R, G, and B colors, a fluorescent-substance-use coating liquid is filled into the individual rib gap portions and then dried, thereby having its volatile components removed, by which thick fluorescent substance layers 1812 are formed on the rib wall surfaces, and at the same time, spaces into which the dischargeable gas is to be filled are created. With a view to forming such a thick fluorescent substance pattern, it has conventionally been practiced that coating materials containing the fluorescent substances are prepared into a high-viscosity pasty fluid (fluorescent-substance paste) of several thousands mPas to several tens of thousands mPas with the solvent content reduced, and applied onto the substrate by screen printing or photolithography.

(2) Applicative Example to Electrode Formation of PDP Front-Face Plate

Below described in detail is an example in which the dispenser according to the foregoing embodiment of the present invention is used for the above-described formation of electrodes including the bus electrode portion and the terminal portions of the front-face plate of the PDP.

Figure 16:
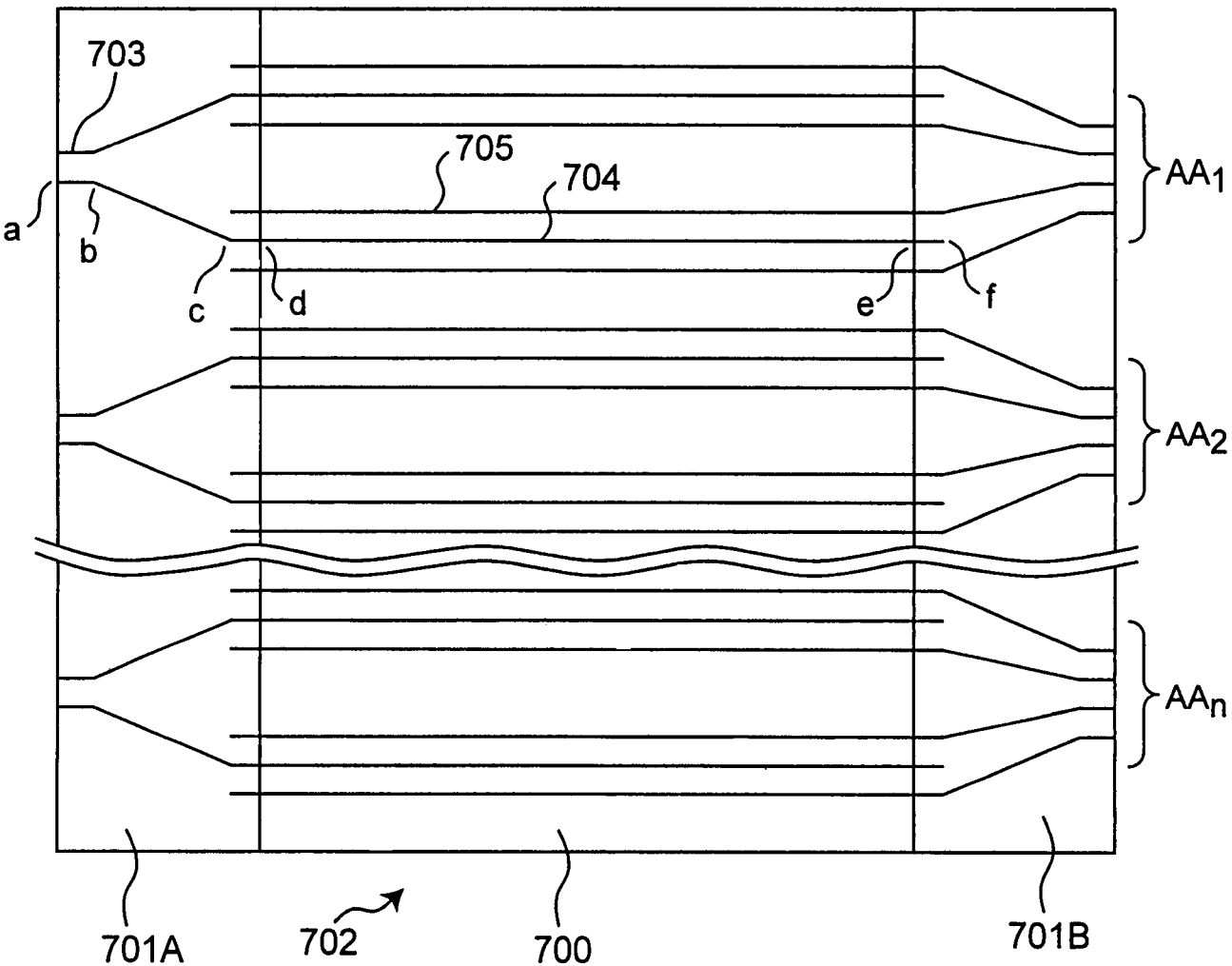
FIG. 16 is a view showing an example of the PDP front-face plate.
Figure 30:
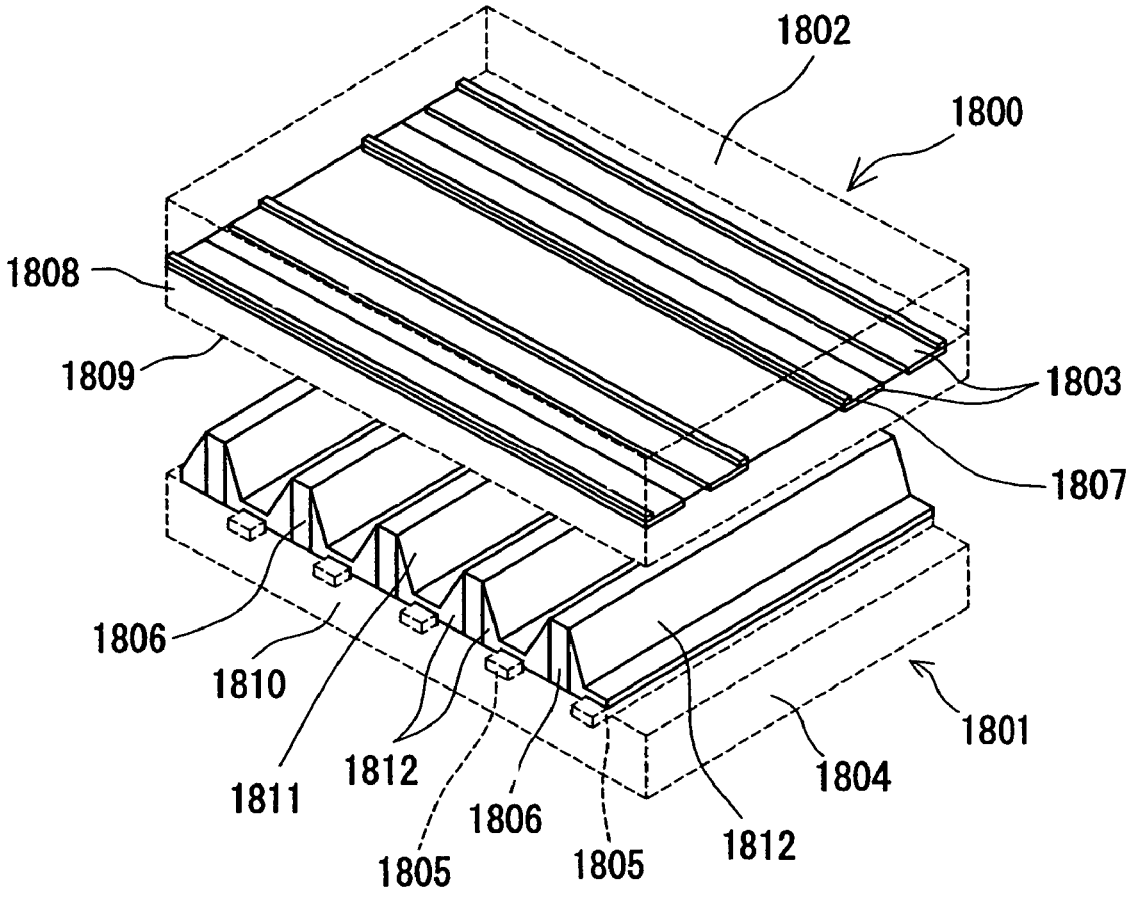
FIG. 30 is a view showing an example of the structure of the plasma display panel.

FIG. 16 schematically shows an example of the PDP front-face plate, where reference numeral 700 denotes a bus electrode portion (corresponding to the bus electrodes 1807 of FIG. 30), and 701A, 701B denote terminal portions. The bus electrode portion 700, the terminal portion 701A and the terminal portion 701B constitute a PDP front-face plate 702 formed of a glass substrate (corresponding to the front-face plate 1800 of FIG. 30). Numeral 703 denotes a tab junction portion.

Now, in order to explain how is the pattern with which electrode lines of the bus electrode portion 700, the terminal portion 701A, and the terminal portion 701B, respectively, of the PDP front-face plate 702 are formed, let us focus on an electrode line 704, and do tracing with a starting point (or a terminating point when the pattern is reversely formed) given by a point 'a' located at a left end portion of the PDP front-face plate 702 of FIG. 16. The electrode line 704, which takes this point 'a' as the starting point, changes its direction at a point 'b', then proceeds obliquely downward, and changes in direction again at a point 'c' in the terminal portion 701A. Further, passing through the terminal portion 701A, the electrode line 704 enters the bus electrode portion 700 at a point 'd.' Still further, the electrode line that has passed the bus electrode portion 700 enters the right-side terminal portion 701B at a point 'e', immediately thereafter stopping at a point 'f.' That is, the point 'f' in the terminal portion 701B becomes a terminating point (or a starting point when the pattern is reversely formed) of the electrode line 704. An electrode line 705 adjacent to the electrode line 704 is formed with its starting and terminating points left-and-right reversed to the electrode line 704. Like this, in the PDP front-face plate 702 of the embodiment of FIG. 16, electrode lines having stop points at the left-and-right terminal portions 701A, 701B are formed so as to be alternately changed. The electrode line 704, although continuously extending from the point 'a' to the point 'f', yet differs in line width depending on places. An example of dimensional specifications at individual positions of each electrode line 704 is shown in Table 1 below. Within the bus electrode 700, a group of electrode lines 'd'-'e' (referred to as main electrode lines) to be formed in a plural number and parallel to one another at a narrow pitch are required to have the thinnest and the highest line width accuracy (Table 1) and thickness accuracy (4.5 μm±1.5 μm):

TABLE 1

| No. | Electrode lines | Area | Dimensional specifications of line widths |
|---|---|---|---|
| 1 | a-b | Terminal portion 701A | 0.3 mm |
| 2 | b-c | Terminal portion 701A | 0.10 mm |
| 3 | c-f | Terminal portions 701A, 701B + bus electrode portion 700 | 0.075 mm ± 0.005 mm |

Figure 17:
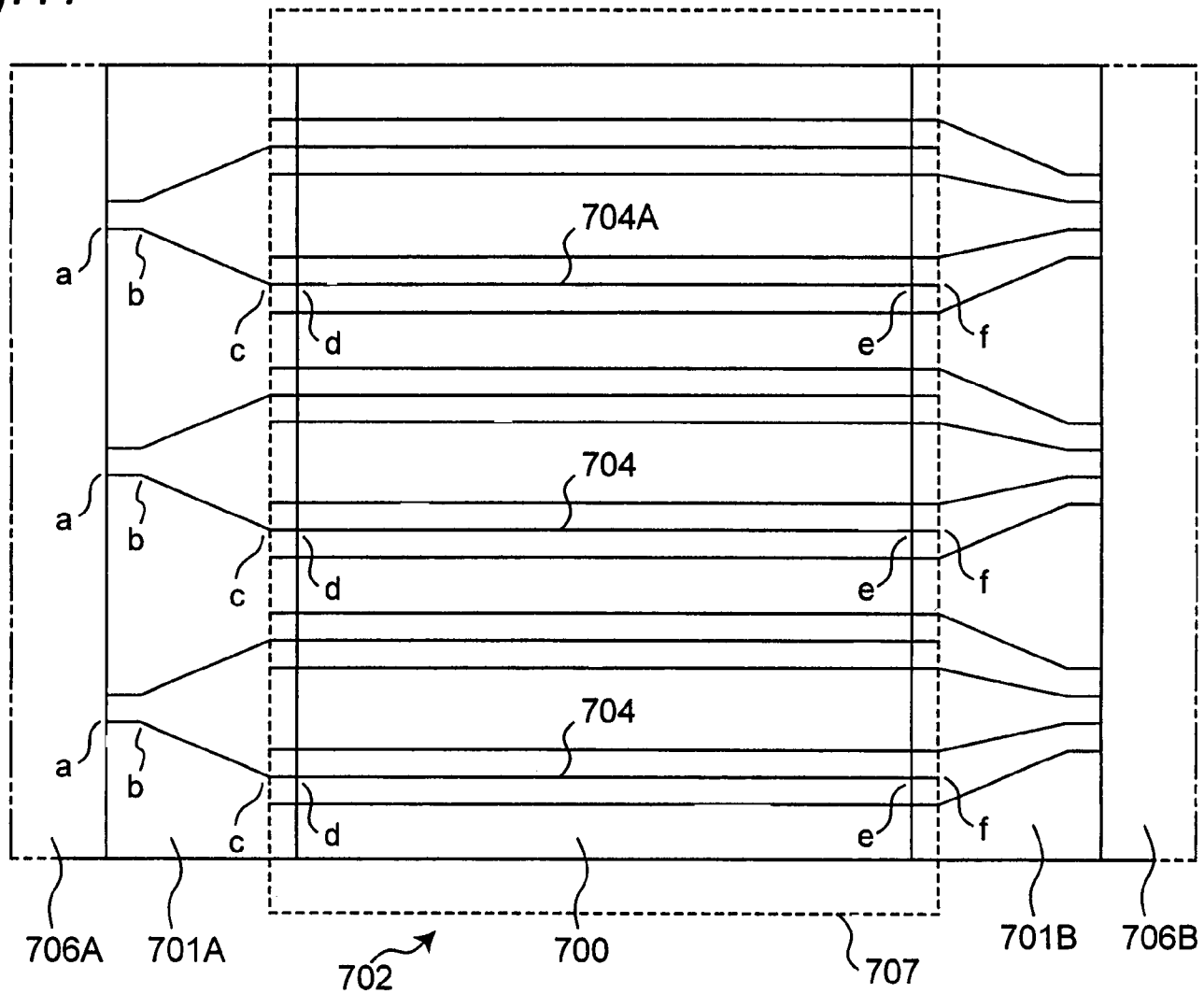
FIG. 17 is a view showing an imaginary area for paste application on the PDP front-face plate.

FIG. 17 shows an imaginary area for paste application. It is assumed here that the bus electrode portion indicated by 700 is referred to as "effective display area," and the terminal portions 701A, 701B are referred to as "quasi-effective display area." Reference numerals 706A and 706B denote imaginary areas (two-dot chain lines) for use of paste application, which are provided at both ends of the PDP front-face plate 702 and will be referred to as "non-effective display area." An imaginary area 707 (chain line) set so as to cover the entirety of the bus electrode portion 700 and part of the terminal portions 701A, 701B will be referred to as "extended effective display area."

At first, a concrete example (I) of the applying method is explained. In the first embodiment aimed at the electrode formation of the PDP front-face plate, all electrode lines are formed in the following order.

At step S1, main electrode lines are formed.

At step S2, electrode lines of terminal portions including the bus electrode portion are formed.

In this method, since an applying apparatus having as many as possible discharge nozzles can be used in the step of forming the main electrode lines at step S1, there is produced an advantage in terms of production cycle time.

Figure 18:
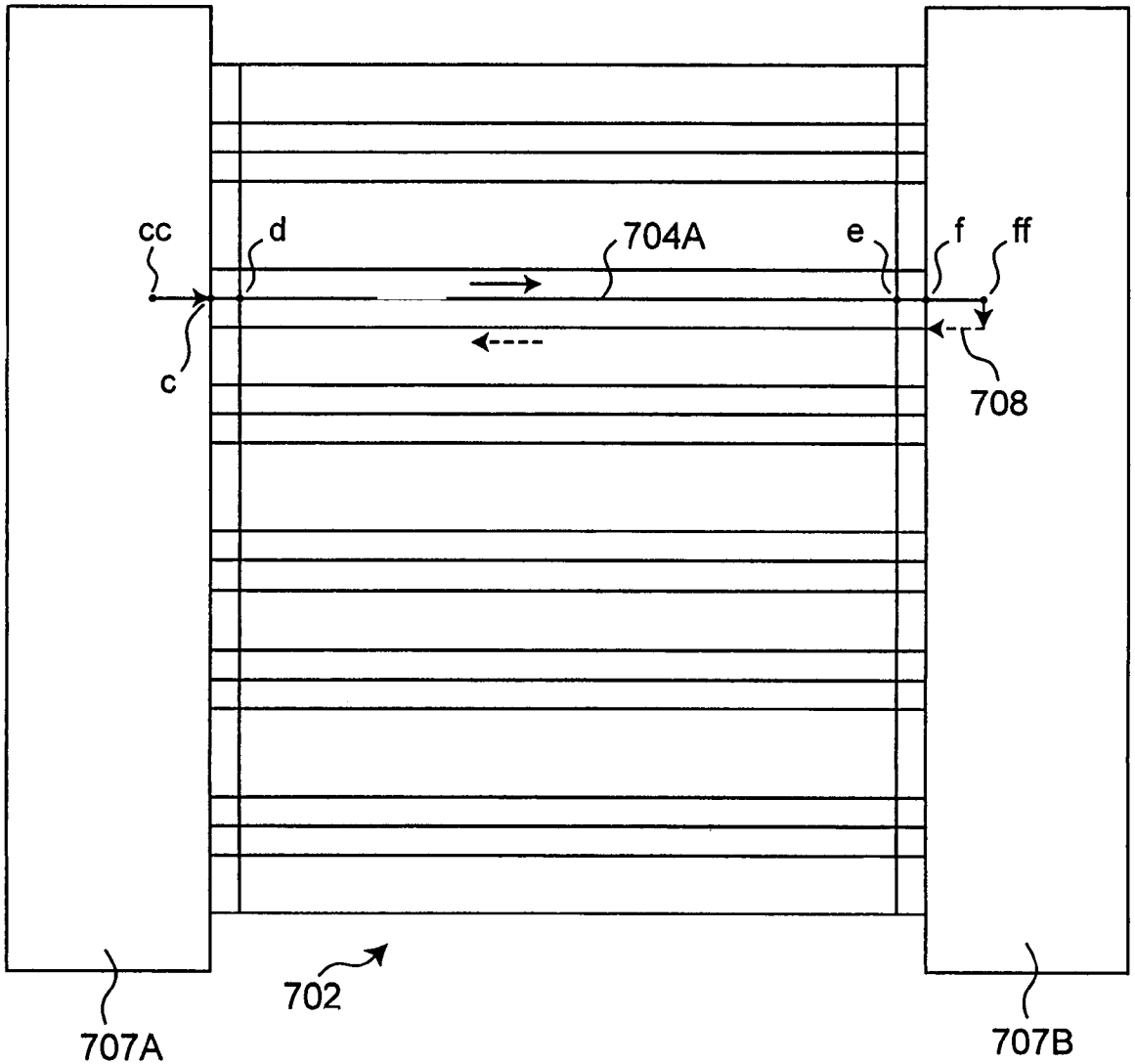
FIG. 18 is a view showing a formation method of main electrode lines.

FIG. 18 shows a formation method of main electrode lines (step S1). Thin mask sheets 707A, 707B are preliminarily placed on the left and right of the PDP front-face plate 702 excluding the extended effective display area 707. In this state, application of the applying fluid, which is the electrode material such as silver material, is started from a point cc on the mask sheet 707A. After the bus electrode portion 700 is applied without a break, the application of the applying fluid, which is the electrode material such as silver material, is ended at a point 'ff' on the mask sheet 707B.

In this case, as the dispenser to be applied, as an example is shown in FIGS. 11A and 11B, a dispenser in which, for example, the thread groove pump and a plurality of pistons are combined together may be used as a sub-unit (i.e., fluid applying unit). This sub-unit is further combined in a plural number to provide a fluid applying apparatus for the application and formation of the main electrode lines. In U-turn zones (zones in which the dispenser runs through the mask sheet 707B) of end faces of the PDP substrate, it is preferable that the discharge amount of fluid can be completely interrupted. This is because this complete interruption makes it possible to reduce the probability that the nozzle may be dirtied by deposition of the fluid on the mask sheet 707B.

It is also possible to use a dispenser which has a plurality of nozzles corresponding to the total number (e.g., 1921) of application lines and in which the applying material, i.e. applying fluid, is pressurized by air pressure so as to be fed to the plurality of nozzles, respectively, with a view to drawing the total number of application lines without a break. In this case, since high responsivity is not required to the control of the application lines at their starting and terminating ends, there is no need for fast-response control of the starting and terminating ends. In either case of those methods, for the purpose of thinning the lines, a high voltage may be applied to between the electrodes, which are provided on the nozzle side, and the substrate (transparent electrode), thereby providing electric-field control.

Figure 19:
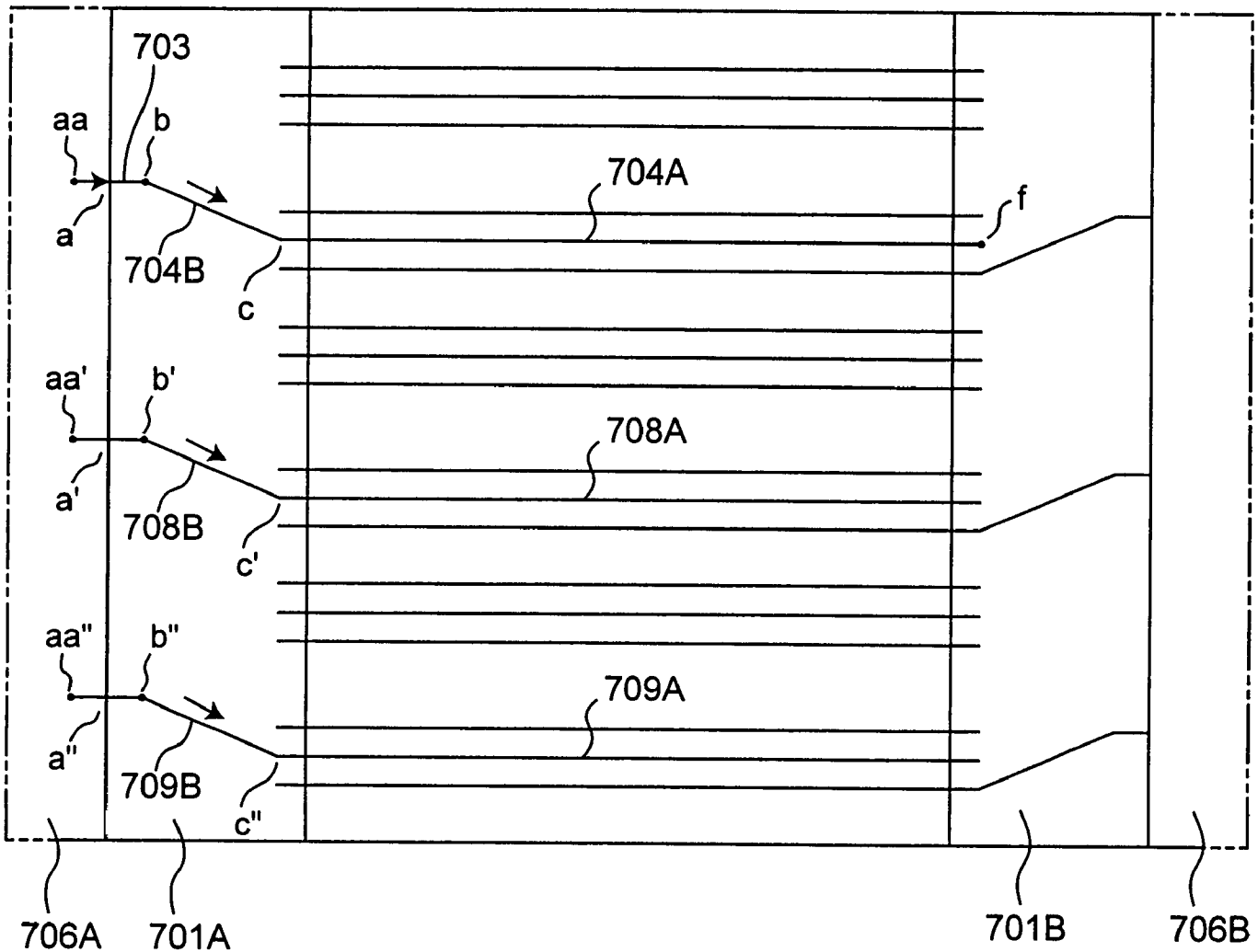
FIG. 19 is a view showing a formation method of electrode lines of a terminal portion.

Next, a method of forming electrode lines of the terminal portions including the bus electrode portion (step S2) is shown in FIG. 19. In the quasi-effective display areas (terminal portions 701A and 701B), because of differences in inclination angle among the individual electrode lines, it is difficult to simultaneously execute the application on adjacent electrode lines within the quasi-effective display areas with multiple heads disposed at a parallel pitch. Therefore, the application is executed by the following method.

In the quasi-effective display areas, it is assumed that groups of electrode lines each composed of electrode lines whose inclination angles are different from one another are $AA_1$-$AA_n$ (FIG. 16). It is noted here that, out of the electrode-line groups $AA_1$-$AA_n$, electrode lines drawn within the two quasi-effective display areas (within the terminal portions 701A and 701B) are referred to as "terminal-portion electrode lines" (e.g., 704B). These terminal-portion electrode line groups are formed in plural sets because two quasi-effective display areas are present in the front-face plate of a PDP. Therefore, electrode lines having an identical inclination angle (the number of these electrode lines is assumed as K) are selected from among the plurality of groups $AA_1$-$AA_n$ and assumed as a group BB. The group BB is, for example, a group of the electrode lines 704B, 708B, and 709B in FIG. 19. With respect to the electrode lines 704B, 708B, and 709B of the group BB, moving the nozzles and a stage (see, e.g., the mount plate 50 and the X-Y stage 50*x* in FIG. 26), on which the PDP front-face plate is to be placed and held, relative to each other along the inclination angle of the electrode lines allows a plurality of electrode lines 704B, 708B, and 709B having an identical inclination angle to be simultaneously formed through the application process. One embodiment of the fluid applying apparatus may be implemented by using a number of dispensers each having one set of an applying-fluid supply source pump, a piston, and a discharge nozzle, the number of dispensers corresponding to the number of electrode lines (K sets in this case).

For example, in the case of the electrode line 704B, application of the applying fluid is started with a point 'aa' in the non-effective display area 706A taken as a starting point. As an example, it is assumed that relative speed between the discharge nozzle and the stage is V=300 mm/sec. and that the distance between the discharge nozzle and the substrate is $\delta$=1.5 mm.

Figure 20:
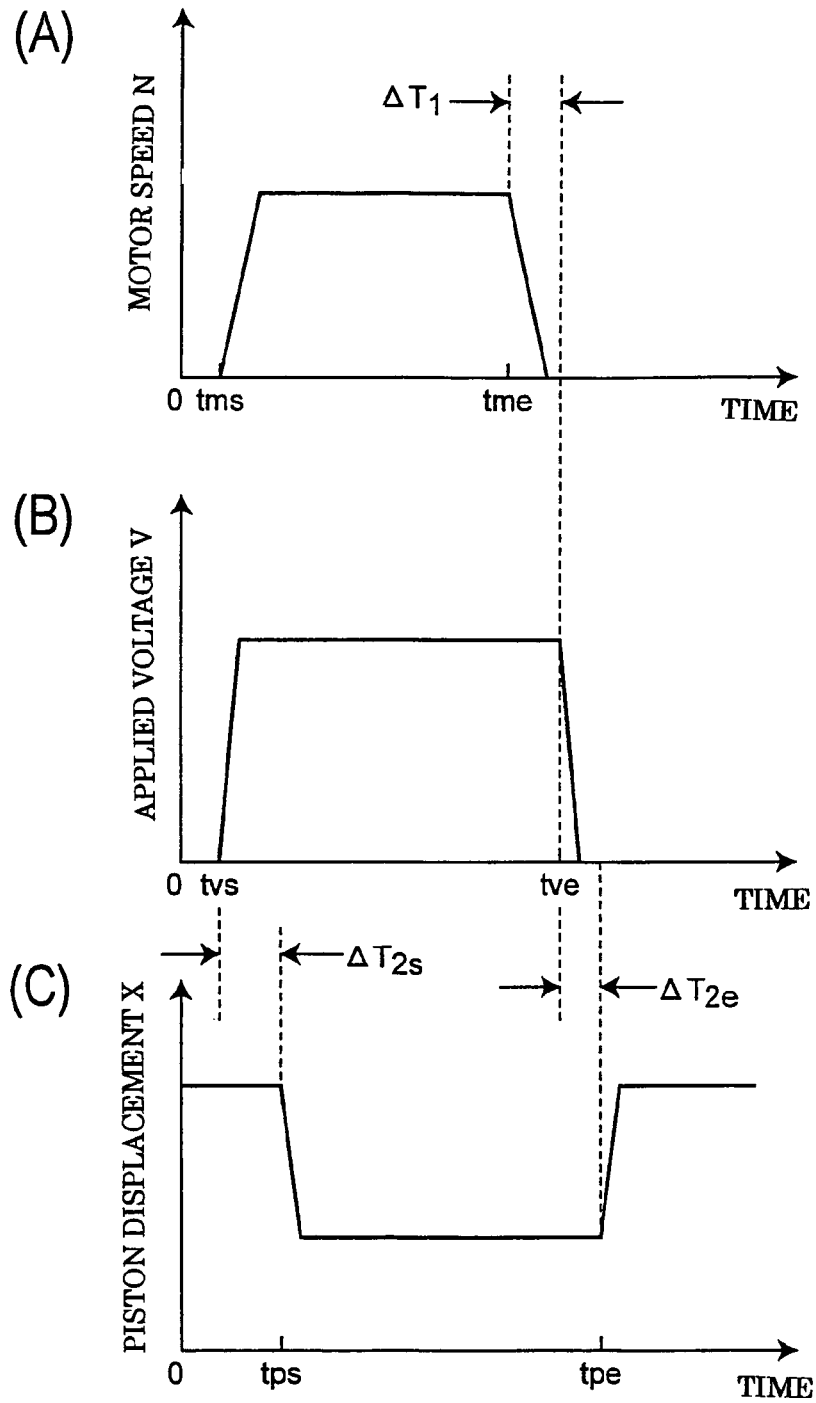
FIG. 20 is a view showing time charts, where part (A) shows motor rotational speed versus time, (B) shows applied voltage for forming an electric field between nozzle and substrate versus time, and (C) shows piston displacement versus time.

In FIG. 20, (A) shows a time chart of motor rotational speed versus time, (B) shows a time chart of applied voltage for forming an electric field between nozzle and substrate versus time, and (C) shows a time chart of piston displacement versus time. The motor rotation is started at $t=t_{ms}$. At a time after $t=t_{ms}$ or at $t=t_{vs}$, which is the same time as $t=t_{ms}$, a voltage for electric field control is applied. As an example, it is assumed that the motor rotation, the operation start, and the voltage application are of the nearly same time ($t=t_{ms}=t_{vs}$). With a time delay of $\Delta T_{2s}$ from the time of the voltage application (i.e., the time of $t=t_{vs}$), the piston is moved down. Upon passage through the tab junction portion 703 (point a-point b), since the line width is larger than that of the other places as shown in Table 1, either one of the following ① or ② is selected:

① the relative speed between the discharge nozzle and the stage is made smaller than that of the other places; and ② the rotational speed of the thread groove pump (thread groove pump portion 150 of FIG. 11B) is raised.

At a terminating point 'c' of the inclined line 704B in the quasi-effective display area 701A, the application is interrupted so that the line crosses the main electrode line 704A that has already been drawn at step S1.

In this case, conditions for application interruption are of great importance because tip ends of the two electrode lines 704B and 704A need to cross each other without any excess or shortage. As a result of many trial-experiments and discussions, it has been found that controlling the motor rotational speed, the voltage for electric field control, or the piston displacement by the control section at the timing described below, allows preferable results to be obtained.

Figure 21:
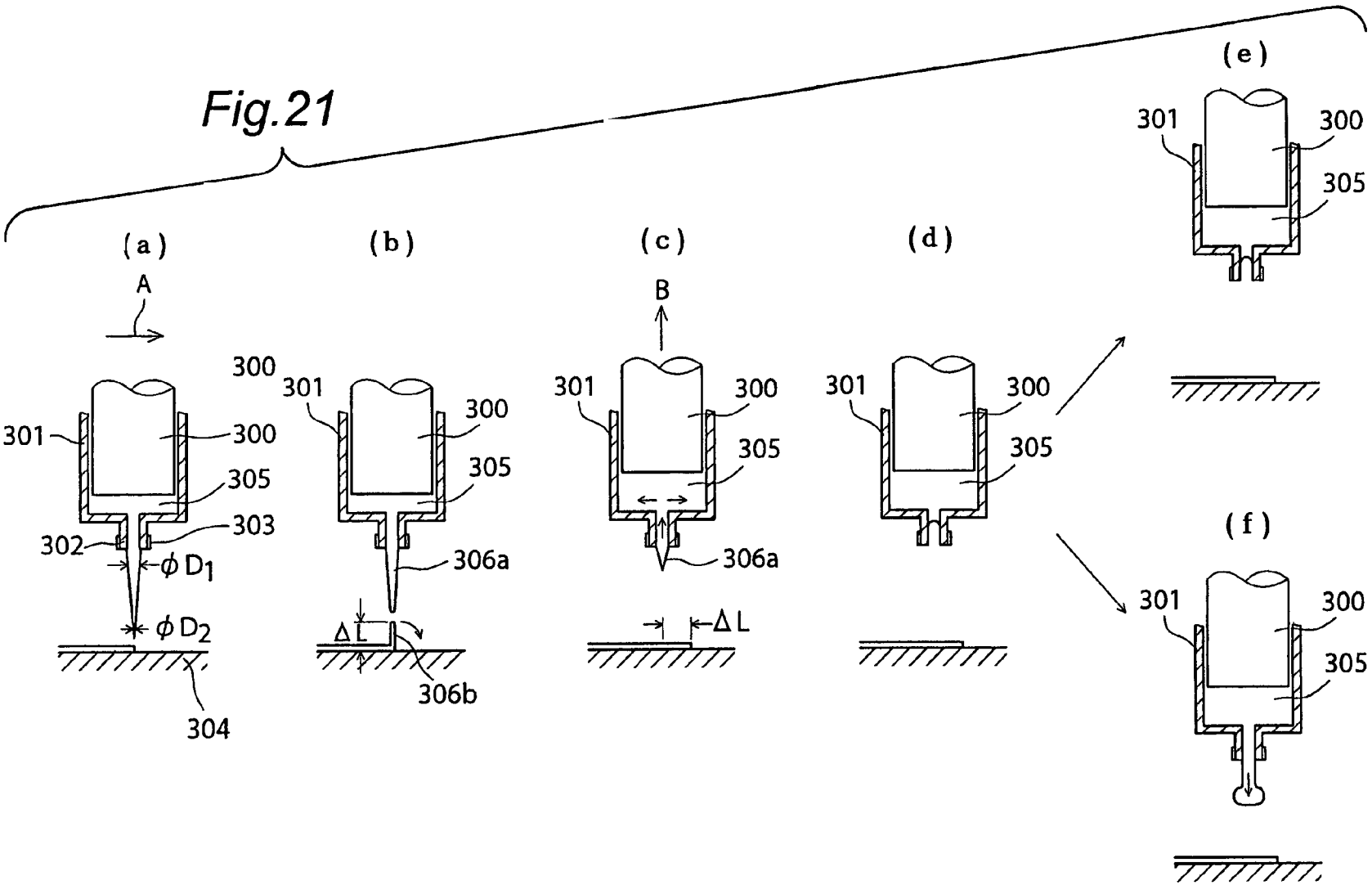
FIG. 21 is a view showing state changes of a meniscus of the applying fluid at the nozzle tip end.

Hereinbelow, the method for application interruption is explained by referring a comparison between the timing chart (FIG. 20) and the state change of the applying-fluid meniscus at the nozzle tip end (FIG. 21).

Referring to FIG. 21, reference numeral 300 denotes a piston (corresponding to the thread groove shaft 151 of FIG. 11B) having a thread groove similar to, for example, the piston 101, 301 denotes a housing (corresponding to the housing 152 of FIG. 11B) having an inlet port for applying fluid and serving for housing the piston 300 therein like the housing 102, 302 denotes a discharge nozzle (corresponding to the discharge nozzle 109 of FIG. 3A, e.g., the discharge nozzle 159*a* of FIG. 11B), 303 denotes a nozzle-side electrode (corresponding to the housing-side electrode 109 of FIG. 3A, e.g., the housing-side electrode 162*a* of FIG. 11B), 304 denotes a substrate (corresponding to the substrate 114 of FIG. 3A), and 305 denotes a pump chamber (discharge chamber) (corresponding to the pump chamber 112 of FIG. 3A). As shown in FIG. 21 (*a*), the applying fluid is in a state of flowing out from the discharge nozzle 302. Numeral 306 denotes an elongated portion (corresponding to the elongated portion 113 of the applying fluid 111 FIG. 3A) of the applying fluid having flowed out from the discharge nozzle 302. Also, the discharge nozzle 302 and the substrate 304 are moving relative to each other in a direction of arrow A. In this case, since a high voltage is applied from a power supply (corresponding to the power supply 115 of FIG. 3A) to between the nozzle-side electrode 303 and the substrate 304, the applying fluid (e.g., a dielectric material for formation of electrode lines) is accelerated by an electric field, so that the flow line of the applying fluid is thinned in diameter. That is, if the flow line diameter in the vicinity of the discharge nozzle is $\Phi D_1$ and the flow line diameter in the vicinity of the substrate is line diameter $\Phi_2$, then $\Phi D_1 > \Phi D_2$.

① At first, the control section (corresponding to the control section 116 of FIG. 3A) issues a command for stopping the rotation of the motor (corresponding to the rotation transmission device 103A of FIG. 3A), which is rotationally driving the piston 300, at $t=t_{me}$ to the power supply (corresponding to the power supply 115 of FIG. 3A). Because of a low responsivity of the motor, the applying fluid keeps being fed from the thread groove pump portion to the discharge nozzle 302 awhile after the command for the stop of the motor rotation;

② Next, the control section issues a command for nullifying the applied voltage at $t=t_{ve}$, which sets a time difference of $\Delta T_1$ after the command for motor rotation stop, to the power supply. The value of $\Delta T_1$ is set within such a range that the width of application lines is not thinned because of flow rate insufficiency in the vicinity of the terminating ends and that the interruption by the next applied voltage and piston displacement control is not affected. As an example, if the value is selected within a range of $0.1<\Delta T_1<0.5$ sec, then preferable results can be obtained. Because of an extremely high responsivity from turn-OFF of applied power supply to turn-OFF of electric field, the continuous flow line of the applying fluid that is flying from the discharge nozzle 302 is divided into a discharge-nozzle side flow line 306*a* and a substrate-side flow line 306*b* in the space as shown in FIG. 21 (*b*).

③ Further, with a time difference of $\Delta T_{2e}$ from $t=t_{ve}$, the piston 300 is moved up by the axial-direction movement device (corresponding to the axial-direction movement device 104A of FIG. 3A) as shown by arrow B of FIG. 21 (*c*). By an abrupt negative pressure generated to the pump chamber 305 immediately after this, the discharge-nozzle side flow line 306*a* is sucked to the interior of the discharge nozzle 302 as shown in FIG. 21 (*d*). In this case, performing mere control for turning OFF the electric field causes the discharge-nozzle side flow line 306*a* to be put into a midair-floating state, making it difficult to achieve high-grade application. Meanwhile, since the substrate-side flow line 306*b* has a velocity component of the arrow A direction, the application is done on the substrate side in the arrow A direction to an extent of the length ΔL as shown in FIG. 21 (*c*). As a result of this, the terminating end position of the application line becomes longer than at a position just under the discharge nozzle 302 by ΔL. In this connection, since ΔL becomes constant on condition that the application amount, the speed of the stage (see, e.g., the mount plate 50 and the X-Y stage 50*x* in FIG. 26), the operation timing of the electric field and the piston 300 are constant, it is appropriate to set the terminating point of application by the control section with this length ΔL preliminarily counted.

As an example, in a range of $0<\Delta T_{2e}<3$ msec., starting the piston 300 to be moved up by the axial-direction movement device makes it possible to achieve high-grade interruption of application lines. In the case of $\Delta T_{2e}<0$, i.e., when the piston 300 is moved up by the axial-direction movement device earlier than when the electric field is turned OFF, the action of pulling out the fluid from the discharge nozzle is effectuated by the electric field even after the fluid is sucked into the discharge nozzle, thus causing the grade of application to be a little deteriorated.

For comparison' sake, FIG. 21 (*e*) shows a case (similar to FIG. 21 (*d*)) where a command for motor rotation stop is issued as in the above ① from the state shown in FIG. 21 (*c*), and FIG. 21 (*f*) shows a case where, converse to that, the motor keeps the rotating state from the state of FIG. 21 (*c*). In the latter case, if the time $T_s$ from an application end until a succeeding application start is short enough, only two operations of the turn-OFF of the electric field and the move-up of the piston 300 allows the step to move to the succeeding application start even while the motor remains rotating. However, if the time $T_s$ is long, for example, if the distance from the application end position to the succeeding application start position is long and the stage move time is long, then the motor rotational speed control is essential as described above because a fluid mass is generated and grown at the discharge-nozzle tip end as shown in FIG. 21 (*f*).

Figure 22:
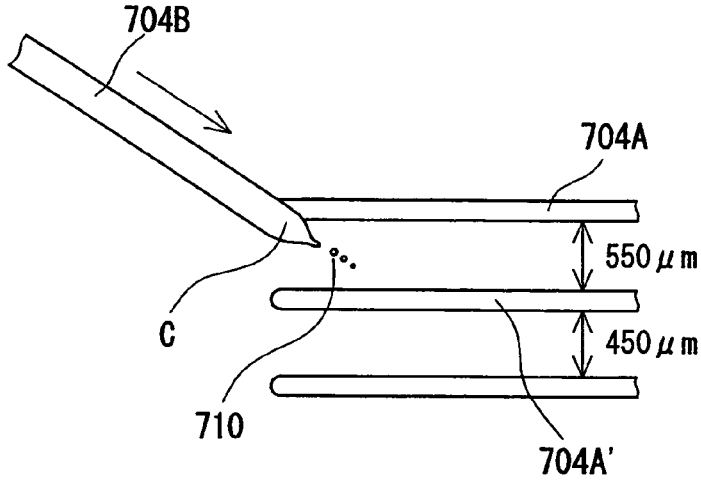
FIG. 22 is a view showing a state that a terminal-portion electrode line and main electrode lines cross each other.

FIG. 22 shows a case in which interruption control at the terminating end of the drawing line 704B is not effectively done in the concrete example (I). The drawing line 704B does not end at a point where the drawing line should be interrupted, but at a proximity 710 of its terminating end, the fluid mass is scattered toward a neighboring main electrode line 704A'. In a worst case, the drawing line 704B and the main electrode line 704A' are short-circuited. As an example, the distance between the drawing line 704B and the main electrode line 704A' is about 550 μm.

Figure 23:
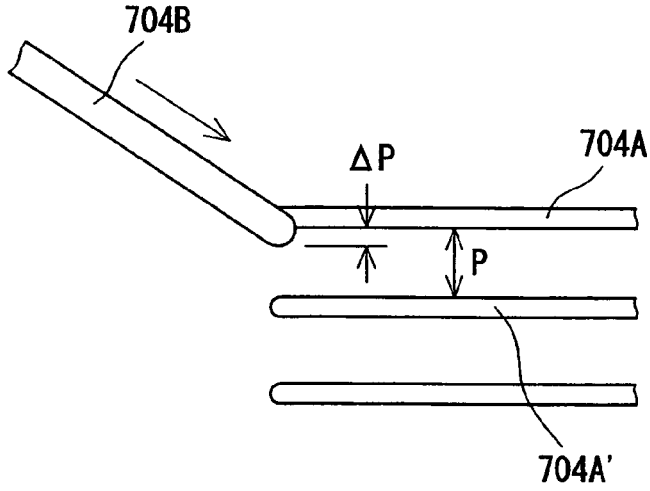
FIG. 23 is a view showing a state that a terminal-portion electrode line and main electrode lines cross each other.

FIG. 23 shows a state that the terminating end of the terminal-portion electrode line 704B and the terminating end of the main electrode line 704A cross each other by the interruption control of the foregoing embodiment of the present invention. Let us assume a pitch P between the main electrode lines 704A and 704A' and a distance ΔP of a portion to which the terminating end of the terminal-portion electrode line 704B protrudes from the main electrode line 704A. As an example, if the relative speed between the discharge nozzle and the stage is V, then the dispenser technique of the foregoing embodiment of the present invention is capable of achieving a relation that $(\Delta P/P)<(1/3)$ under the condition that $200<V<500$ mm/sec.

Figure 24:
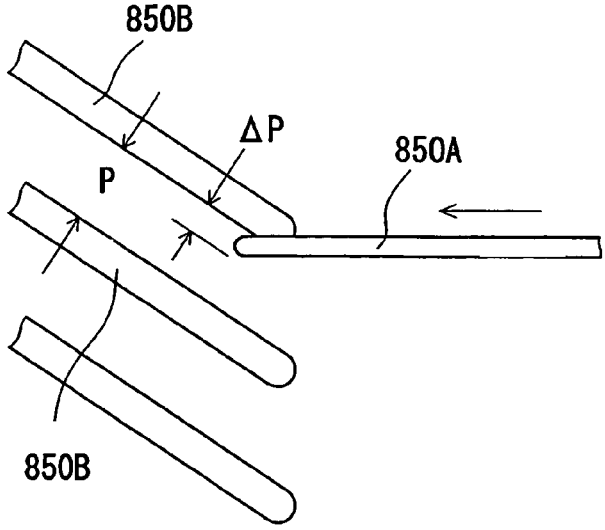
FIG. 24 is a view showing a state that terminal-portion electrode lines and a main electrode lines cross each other.

FIG. 24 shows a case in which the order of the formation of the main electrode line and the formation of the terminal-portion electrode line is reversed. In this case, likewise, the pitch between the terminal-portion electrode lines 850B and 850B' in the vicinity of the main electrode line is P. If the distance of the portion to which the terminating end of the main electrode line 850A protrudes from the terminal-portion electrode line 850B is ΔP, then there can be obtained a relation that $(\Delta P/P)<(1/3)$.

Next, a concrete example (II) of the applying method is explained.

Although the process of drawing the main electrode line and the terminal-portion electrode lines is divided into two steps to perform the application in the concrete example (I), yet the concrete example (II) shows a method of drawing the main electrode line and the terminal-portion electrode lines without a break. In this case, a number of dispensers each having one set of a supply source pump, a piston, and a discharge nozzle, the number of dispensers corresponding to the number of electrode lines having an identical inclination angle, is for example, K. As described before, the number K is the number of electrode lines having an identical inclination angle in the terminal portions 701A, 701B.

Referring to FIG. 19, application of the terminal-portion electrode line is started with a point 'aa' in the non-effective display area 706A, and then, without interrupting at a point 'c', the main electrode line 704A may be drawn in succession to the terminal-portion electrode lines, continuing being drawn up to a point 'f' without a break. For the adjustment of the line width of application lines at individual places, as described before, the relative speed between the discharge nozzle and the stage (see, e.g., the mount plate 50 and the X-Y stage 50*x* in FIG. 26) or the rotational speed of the thread groove pump may be controlled by the control section. The interruption of the application line at the point 'f' may be performed by using the method used in the concrete example (I).

As another method for changing the line width of application lines, the gap δ between the discharge-nozzle tip end and its opposing-surface substrate may be changed by the control section (for example, the gap δ is changed by controlling the up-and-down device (see a Z-direction conveyance unit 52*z* of FIG. 26) for moving up and down the whole fluid applying apparatus along the up-and-down direction or other device by the control section). In order to obtain more ultrafine lines, there are needs for a high electric-field strength and a long elongated portion (e.g., the elongated portion 306 of FIG. 21 (*a*)). In the case of the PDP front-face plate, as shown in Table 1, the electrode lines of the terminal portions are larger in line width than the electrode lines of the bus electrode portion. Accordingly, for the formation of the electrode lines of the terminal portions, the gap δ may be set larger than that for the electrode line of the bus electrode portion and the electric field strength (magnitude of the voltage) may be set rather weak, by the control section.

Figure 26:
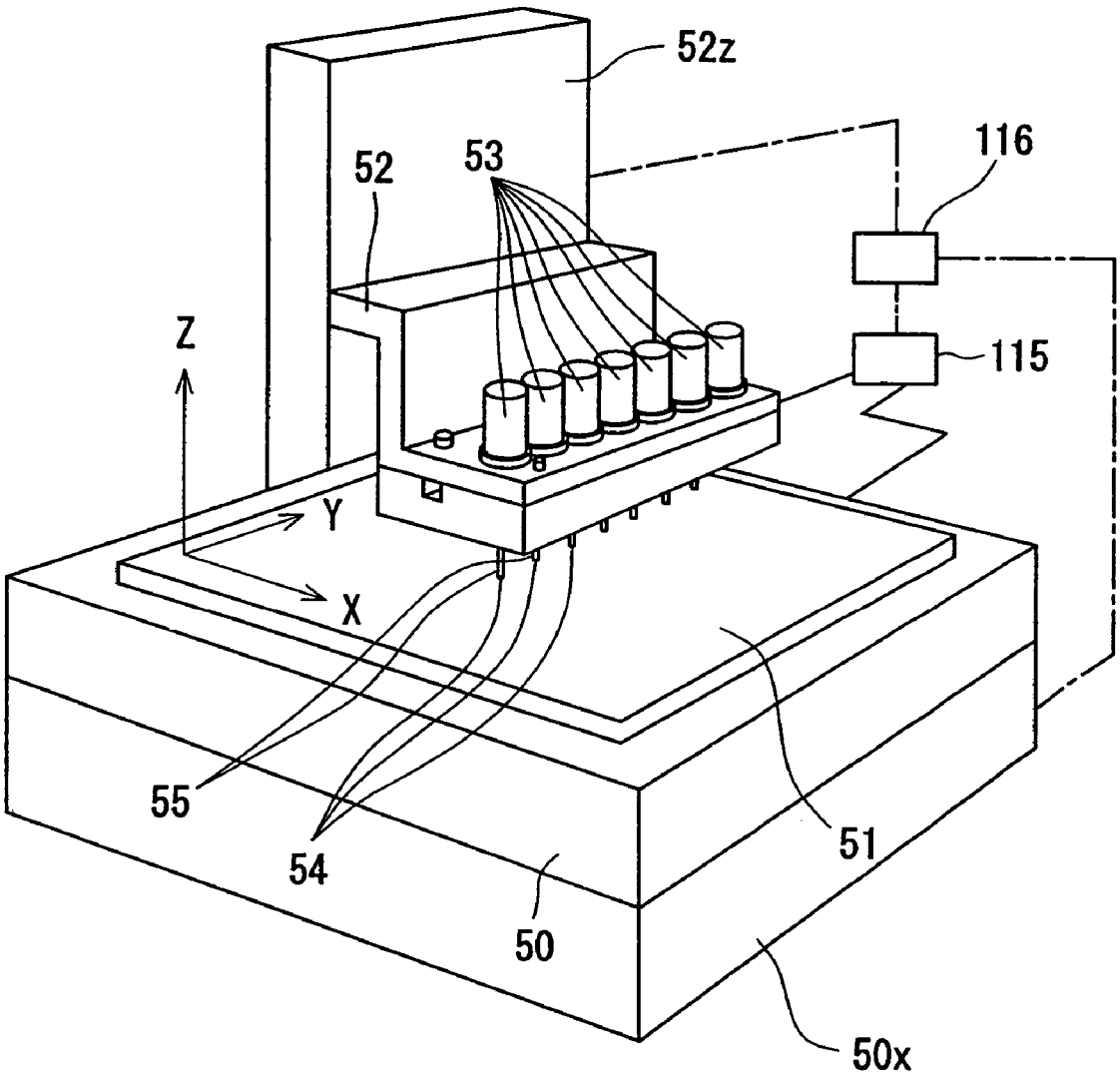
FIG. 26 is a schematic perspective view in a case where the fluid applying apparatus according to the foregoing embodiment of the present invention is applied to a fluorescent substance-layer formation apparatus for PDP substrates.

Although the present invention is not limited to the electrode formation of PDP front-face plates, effects of the present invention implemented by a combination of the control of the piston driven by an electro-magnetostriction device and the control of electric field become more noticeable with increasing relative speed $V_s$ between the discharge nozzle and the stage (see, e.g., the mount plate 50 and the X-Y stage 50*x* in FIG. 26). This relative speed $V_s$ directly affects the production cycle time for mass production.

The responsivity for application interruption in the conventional air type is at most 0.05 to 0.1 sec. For example, when the continuous application is interrupted during a run at a stage move speed $V_s$=300 mm/sec., the length of a line that is excessively drawn since the issuance of an interruption command signal until an end of the application line can be approximated as $\Delta L_1=0.05\times300=15$ mm.

In contrast to this, when the piston is driven by an electro-magnetostriction device in the fluid applying apparatus according to the foregoing embodiment of the present invention, the responsivity of pressure waveform of the pump chamber is about 0.0005 sec. For example, at the same stage, the length of a line that is excessively drawn since the issuance of an interruption command signal until an end of the application line is $\Delta L_2=0.0005\times300=0.15$ mm. Thus, it holds that $\Delta L_2<<\Delta L_1$, and the effects of the present invention is apparent. Also, as explained about concrete example (I) of the electrode-line applying method, it has been found that control by the control section in view of the timing of piston displacement up and electric-field interruption makes it possible to further reduce the above $\Delta L_2$.

(3) Applicative Example of Fluorescent-Substance Screen Stripe Formation

Below described is an example in which the fluid applying method and apparatus according to the foregoing embodiment of the present invention are applied to a fluorescent substance-layer formation method and formation apparatus for display panels. This example, although being a case where fluorescent-substance screen stripes (continuous application lines) on the PDP back-face plate, is similar to the case where fluorescent substance layers are formed, for example, on a CRT (color flat panel).

Figure 25:
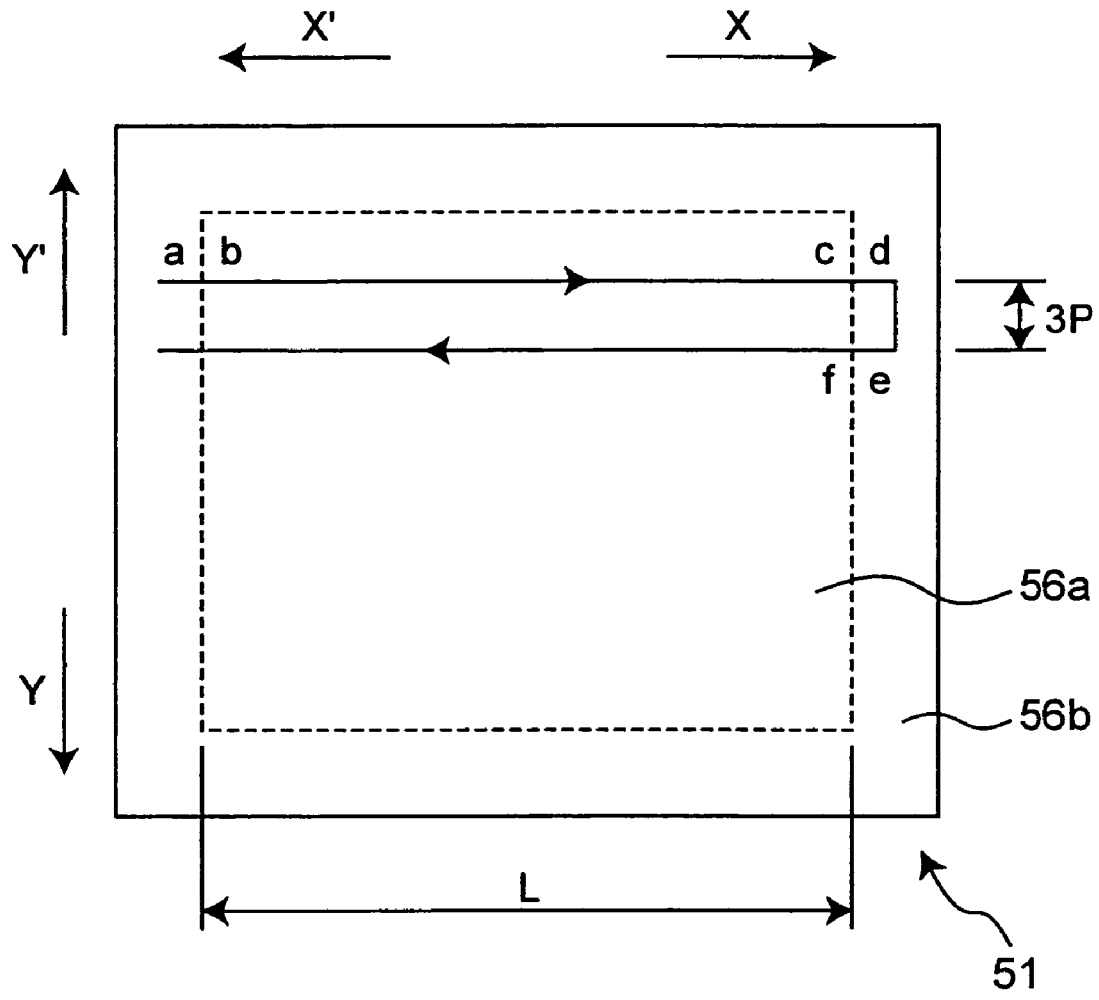
FIG. 25 is a view showing an effective display area and a non-effective display area for paste application on the PDP back-face plate.

As shown in FIG. 25, the PDP substrate has an effective display area 56*a* where fluorescent substance layers are formed, and a non-effective display area 56*b*, where no fluorescent substance layers are formed, on the outer periphery of this effective display area. FIG. 26 shows a concrete form of the fluid applying apparatus on which dispensers are mounted.

Reference numeral 50 denotes a mount plate for mounting and holding thereon a PDP substrate (substrate for use of a plasma display panel) 51. The mount plate 50 can be moved to any arbitrary position in orthogonal two directions, X-axis direction and Y-axis direction, by an X-Y stage 50*x* connected to lower part of the mount plate 50. Numeral 52 denotes an application head, which is a housing on which dispensers 53 are removably mounted, and the housing 52 can be moved to any arbitrary position in the Z-axis direction by the Z-direction conveyance unit 52*z* such as a driving mechanism which moves up and down the housing 52 screwed to a ball screw in the Z-axis direction by forward and reverse rotating the ball screw by a Z-axis motor. On the housing 52, a plurality of dispensers 53 are removably mounted. In this embodiment, dispensers 53 of a two-degree-of-freedom actuator structure (corresponding to, e.g., the dispenser of FIG. 10) are used. Numeral 54 denotes discharge nozzles of the dispensers 53 (corresponding to the discharge nozzle 223 of FIG. 10 and the discharge nozzle 109 of FIG. 3A), and 55 denotes dispenser-side electrodes (housing-side electrodes) fitted to the tip ends of the discharge nozzles 54 (corresponding to the housing-side electrode 225 of FIG. 10 and the housing-side electrode 110 of FIG. 3A). A voltage for controlling an electric field between these dispenser-side electrodes 55 and the PDP substrate 51 is applied from a power supply 115 (corresponding to the power supply 115 of FIG. 3A) while controlled by the control section 116 (corresponding to the control section 116 of FIG. 3A). It is noted that the control section 116 (corresponding to the control section 116 of FIG. 3A) also controls operations of the X-Y stage 50*x* and the Z-direction conveyance unit 52*z*.

By this fluid applying apparatus, electrode lines or fluorescent substance layers are formed on the PDP substrate 51 for use of a PDP. Each dispenser 53 is supplied with a pasty material as an example of the applying fluid from a material supply source placed outside.

This PDP substrate 51 is mounted and fixed to a specified position of the mount plate 50. For example, in the case of a 42-inch PDP substrate, ribs (corresponding to the bias ribs 1806 of FIG. 30) having a length of L=560 mm, a height of H=100 μm, and a width of W=50 μm are previously formed at a quantity of 1921 with intervals of a pitch P in parallel to a direction of arrow X-X' in the effective display area 56*a* of the PDP substrate 51. Since these 1921 ribs form 1920 grooves, red, green, and blue fluorescent substances are applied to 640 (=1920/3) grooves, respectively, thus their respective fluorescent substance layers (corresponding to the fluorescent substance layers 1812 of FIG. 30).

At first, by the control of the control section 116, the dispensers 53 are relatively moved upon an R fluorescent-substance application start position (actually, the X-Y stage 50*x* is moved relative to the dispensers 53, thereby moving the PDP substrate 51, so that the dispensers 53 are positioned above the R fluorescent-substance application start position), and tip ends of the discharge nozzles 54 are positioned to a specified height relative to the PDP substrate 51 by the Z-axis motor of the Z-direction conveyance unit 52*z*.

Next, by the control of the control section 116, R fluorescent substance is started to be discharged from the discharge nozzles 54, and simultaneously the discharge nozzles 54 are moved in the direction of arrow X (actually, the X-Y stage 50*x* is driven relative to the dispensers 53 (discharge nozzles 54) so that the PDP substrate 51 is moved in the direction of arrow X' reverse to the direction of arrow X), by which fluorescent-substance application is started. The discharge nozzles 54 draw application lines by a length L of one rib (FIG. 25) and the tip ends of the discharge nozzles 54 move from the effective display area 56*a* into the non-effective display area 56*b*, where the discharge of the fluorescent substance from the discharge nozzles 54 is stopped by the control of the control section 116.

Next, by the control of the control section 116, while the discharge of the fluorescent substance from the discharge nozzles 54 is kept stopped, the discharge nozzles 54 are moved in a direction of arrow Y by an extent of three pitches (actually, the X-Y stage 50*x* is driven relative to the discharge nozzles 54 so that the PDP substrate 51 is moved in a direction of arrow Y' reverse to the direction of arrow Y). Once again, by the control of the control section 116, the discharge of R fluorescent substance from the discharge nozzles 54 is started, and simultaneously the discharge nozzles 54 are moved in the direction of arrow X' (actually, the X-Y stage 50*x* is driven relative to the discharge nozzles 54 so that the PDP substrate 51 is moved in the direction of arrow X reverse to the direction of arrow X'), by which the fluorescent-substance application is resumed. These steps are integrated, and upon reach to the application number of 640, then the work by red fluorescent substance is completed.

The method for starting and stopping the discharge of the fluorescent substance by the control of the control section 116, as will be described later, is performed by the axial-direction control of the piston (corresponding to the piston 202 of FIG. 10 and the piston 101 of FIG. 3A) and the rotational-speed control of the motor (corresponding to the second actuator 205 such as a motor of FIG. 10 and the rotation transmission device 103A of FIG. 3A) while the voltage for controlling the electric field applied from the power supply 115 to between the housing-side electrodes 55 and the PDP substrate 51 is kept constant. It is noted that a transparent ITO film (conductive film) is preliminarily formed on the surface of the PDP substrate 51 in order to directly apply the voltage to between the portion on the PDP substrate 51, where the fluorescent substance layers are to be formed, and the housing-side electrodes 55.

For application of the remaining green-color fluorescent substance and blue-color fluorescent substance, the PDP substrate 51, on which the red-color fluorescent substance layer has been formed, may be sequentially transferred to separately installed mount plates for the green-color fluorescent substance and the blue-color fluorescent substance. Otherwise, it may be arranged that three kinds (for use of red-color, green-color, and blue-color fluorescent substance application) of dispensers 53 may be set on one application head 52 for the same mount plate 50, or that three kinds of application heads 52, i.e., a red-color fluorescent substance application head 52, a green-color fluorescent substance application head 52, and a blue-color fluorescent substance application head 52, are prepared and changed in use so that fluorescent substances of their respective colors are applied.

It is noted that the control by the control section 116 for the positions of the starting and terminating ends of the discharge nozzles 54, the timings of application start and end, and the application quantity synchronized with the stage speed is performed based on preliminarily programmed starting-end and terminating-end positional information and displacement and speed information derived from the X-Y stage 50*x*. Thus, when the formation work for the R, G, and B fluorescent substance layers along the inner-face configuration of the grooves between the ribs is completely ended, the tip-end positions of the discharge nozzles 54 of the dispensers 53 return to predetermined home positions (origins). Now after the application process for the screen stripes has been ended and then, the PDP substrate is conveyed, thereafter followed by a fluorescent substance-layer drying process.

The application process, although having been outlined above, is again focused on the behavior of one discharge nozzle 54.

The nozzle 54, which has run over the "effective display area" of the PDP substrate 51 at high speed while performing continuous application, slows down through a speed-reducing section as the nozzle 54 approaches the end face of the PDP substrate 51, entering the "non-effective display area." After a U-turn at this non-effective display area, the nozzle 54, passing through a run-up section, steadily runs again in the effective display area. That is, the relative speed between the nozzle 54 and the PDP substrate 51 changes to a large extent before and after the U-turn section. In this case, the dispenser 53 desirably has the following functions:

① Capability of changing the flow rate in accordance with the relative speed between the nozzle 54 and the PDP substrate 51;

② Capability of completely interrupting the discharge amount in the U-turn section (a section in which the dispenser runs through the non-effective display area) of the end face of the PDP substrate 51; and ③ Over the U-turn section, there occurs no 'thinning' or 'cut' or the like at the starting point of the application line upon a start of the application. Likewise, there occurs no 'thickening' or 'gathering' or the like at the terminating point of the application line upon an end of the application.

If the above ① cannot be implemented, for example, if the discharge amount cannot be reduced irrespective of a reduction in the relative speed between the nozzle 54 and the PDP substrate 51 as compared with that of the steady running, line width and thickness of the fluorescent application lines would go beyond prescribed specifications.

The more the production cycle time is increased, the more the rise time and fall time have to be made short and the more the rate of change of the relative speed has to be made large. That is, the dispenser 53 is required to have even higher response of flow rate control.

The necessity of the above ② is as follows. When the nozzle 54 runs over the U-turn section (non-effective display area) of the end face of the PDP substrate 51, the relative speed between the nozzle 54 and the PDP substrate 51 becomes zero and an extremely low one therearound. If the material has flowed out from the nozzle 54 in this section, the material would be deposited on the PDP substrate 51 even with a very small flow rate because a plurality of stripes overlap one another. As a result of this, it becomes more likely that the deposited material may be deposited on the tip end of the nozzle 54. When the application is restarted in this state, the fluid mass deposited on the tip end of the discharge nozzle 54 would be dissipated discontinuously onto the surface of the PDP substrate 51, giving rise to such troubles as considerably impairing the accuracy of the drawing lines. That is, in the U-turn section of the end face of the PDP substrate 51, the dispenser 53 is preferably enabled to completely shut off the discharge amount.

The above ① and ② are essential conditions when fluorescent substance layers are formed on, for example, a CRT. As to the reason of this, in the case of CRTs, the concave-shaped bottom face has the effective display area and its outer periphery is covered with a high wall surface, with the result that the non-effective display area is only an extremely narrow place, and that the U-turn needs to be done at this narrow place.

The above ③ is an essential condition for the dispenser method to ensure quality equivalent to or superior to that of conventional methods, for example, the screen printing method.

In summary of the above description, in order to form fluorescent-substance screen stripes or electrode lines on the surface of a PDP substrate with high production efficiency by using a dispenser, it is desirable that the dispenser has a function of being enabled to freely perform fluid interrupt and release as well as high flow-rate control responsibility and high flow-rate accuracy.

However, there is no detailed description of this point in, for example, Japanese examined patent publication No. S57-21223 or Japanese unexamined patent publication No. H10-27543, each of which is a prior art example of the dispenser method. Also, in a prior art example of the electric-field jet method (Japanese unexamined patent publication No. 2001-137760), there can be seen no description on the point how the starting and terminating ends of drawing lines are formed at high speed and high grade.

Now, in the above embodiment of FIG. 10, taking the advantage that the piston 202 driven by an electro-magnetostriction device is capable of simultaneously performing high-speed rectilinear motion and rotation, issues related to the starting and terminating ends of fine application line are to be solved by the following method in a state that an electric field is applied to between the nozzle 54 and the PDP substrate 51:

① At a start of application, simultaneously when the piston 202 is moved down, the motor 205 is started to be rotated.

② At an end of application, simultaneously when the piston 202 is moved up, the motor 205 is stopped from rotating.

In the embodiment of FIG. 10, since the piston 202 is driven by an electro-magnetostriction device, the responsivity of output displacement versus an input signal of the piston 202 is of the order of $10^{-3}$ sec. (1000 Hz). Since the time lag of a squeeze pressure generation against a change in gap is an insignificant one, a response one- to two-order higher than that in the case where the rotational speed control is performed by a motor can be obtained.

When the dispenser of the two-degree-of-freedom actuator structure of FIG. 10 is used, the piston 202 corresponds to the main shaft 202. Also, when the separate type dispenser of FIG. 11B is used instead of the dispenser of the two-degree-of-freedom actuator structure of FIG. 10, the piston corresponds to the pistons 157*a*-157*c* driven by piezoelectric devices. With the use of this separate type, it becomes easier to implement multiple heads. In the case where the time needed for the U-turn is short, the motor may be maintained rotated at all times.

While the discharge nozzle is running over the U-turn section, the fluid mass that has flowed out from the discharge nozzle to form a meniscus does not need to be completely sucked to the inside of the discharge nozzle. As described in the second embodiment, if the suction force due to a negative pressure generated in the pump chamber and the action of fluid projection due to an electric field are maintained balanced with each other in the U-turn section, the distance h between the tip end of the meniscus and the substrate (see FIG. 3B) can be maintained constant. As an effect of this, the application can be started without occurrence of 'thinning' or 'cut' or the like at starting points of application lines. Also, the configuration of the application lines at the starting points can also be made uniform.

As shown in the embodiment for the electrode formation of a PDP substrate, combinational use of the voltage control for forming an electric field in addition to the piston displacement and the motor rotational speed is more effective. Also, for the timing of release and interruption in this case, use of the method embodied in the electrode formation is even more effective.

In the above various embodiments, a dispenser-side electrode (housing-side electrode) is placed at the tip end of the discharge nozzle, and the PDP substrate is used as a counter electrode. Other than this method, a space electrode may be used as the counter electrode as described in the fourth and fifth embodiments.

As the form of the applicative dispenser, thread groove type or air type dispensers in combination with the electric-field jet type may also be adopted when so strict production cycle time is not required, other than the above-described two-degree-of-freedom actuator type and the separate type.

III. Other Supplementary Explanations

Figure 27:
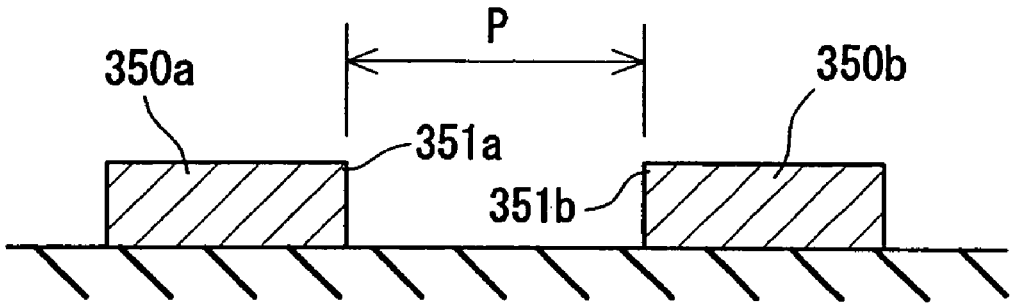
FIG. 27 is a view showing a cross-sectional shape of an application line in a conventional printing technique.
Figure 28:
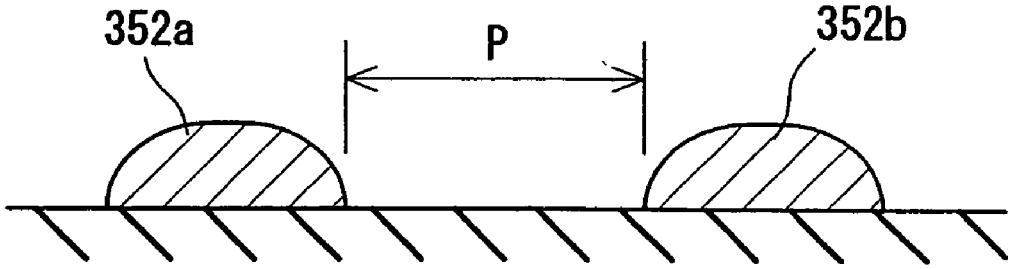
FIG. 28 is a view showing a cross-sectional shape of an application line applied with a technique using a dispenser according to the foregoing embodiment of the present invention, i.e., in a fluid applying method using a dispenser.

The cross-sectional shape of formed application lines largely differ between the technique by the dispensers of the foregoing various embodiments of the present invention and conventional printing techniques. In the case of the conventional printing technique shown in FIG. 27, cross sections of electrode lines 350*a*, 350*b* are generally rectangular shaped. In the case of the dispenser technique of the various embodiments of the present invention shown in FIG. 28, cross sections of electrode lines 352*a*, 352*b* become generally semicircular shaped by the action of surface tension. In the case of the above-described PDP electrode lines, it is known that this difference in cross-sectional shape largest affects the withstand voltage performance of electrodes. That is, in the above embodiments, the pitch P between electrode lines is P=500 to 600 μm, and the voltage difference generated among the electrode lines has to be estimated as about 100 V. In the conventional technique, since the electric field strength comes to a peak in edge portions 351*a*, 351*b* of cross sections of the electrode lines 350*a*, 350*b*, it is highly likely that sparks occur between the two electrodes. In contrast to this, in the dispenser technique of the foregoing various embodiments of the present invention, it is known that since the cross section is semicircular shaped, the electric field strength distribution becomes gentle, sparks are generated only slightly and the reliability of withstand voltage is greatly improved.

Further, for electrode formation, in many cases, the electrode lines are required to be low in electric resistance. In the case of electrodes of a PDP substrate, with the conventional printing technique, silver paste to be used as an electrode material contains photosensitive resin necessary for exposure process of the printing technique. This photosensitive resin makes the specific resistance of the electrode material to be increased. In contrast to this, in the case of application by the dispenser of the above embodiment, this photosensitive resin is unnecessary, so that the specific resistance of the electrode material becomes substantially a half, compared with the printing technique. As a result, regardless of a difference in shape, whether rectangular or semicircular, electrode lines of sufficiently low electric resistance can be formed by the application with the above dispenser if the electrode lines are of the same thickness.

Also, in the case of the separate type dispenser in which the thread groove pump portion (fluid supply portion) 150 and the piston portion 156 are separated from each other, a positive pressure and a negative pressure for the control of starting and terminating ends can effectively be generated by providing a throttle on the flow passage near the piston portion (156 in the case of FIGS. 11A and 11B).

FIG. 29 is an enlarged sectional view of the piston portion 156 in this case. Reference numeral 157*a* denotes a piston, and this piston 157*a* is driven to move forward and reverse along a direction of arrow 361 by an electro-magnetostriction actuator 158*a*, which is an example of the axial-direction driving device. Numeral 160 denotes a lower plate, 363 denotes an end face of the piston 157*a*, 364 denotes a discharge portion manufactured of nonconductive resin, 365 denotes its fixed-side opposing surface, 159*a* denotes a discharge nozzle formed at a center portion of the fixed-side opposing surface 365, and 162*a* denotes a housing-side electrode (conductive) provided at an outer peripheral portion of the discharge nozzle 159*a*. Numeral 368 denotes an applying fluid (nonconductive), 369 denotes a pump chamber, 370 denotes a substrate (application object), and 371 denotes a conductive plate placed at a lower portion of the substrate 370. To between the housing-side electrode 162*a* and the conductive plate 371, a voltage is applied by the power supply 905 controlled by a control section 906 that controls the fluid application operation of the fluid applying apparatus.

Numeral 161*a* denotes a flow passage which connects the thread groove pump portion (fluid supply portion) 150 and the pump chamber 369 to each other, and which is formed between the housing 152 and the lower plate 160. Numeral 375 denotes a throttle provided in proximity to the piston 157*a* of the flow passage 161*a*. This throttle 375 has such a cross-sectional configuration (flow passage width and flow passage depth) that the fluid resistance becomes smaller enough than that of the flow passage 161*a*. When the flow passage 161*a* is long or when the total capacity of the flow passage 161*a* is increased due to multiple heads, the compressibility of the fluid causes the responsivity of the system (time response characteristic of pressure change with respect to piston displacement) to lower. However, the effect of the compressibility can be reduced by providing the throttle 375 in proximity to the piston 157*a* and on the way of flow passage that connects the pump chamber 369 and the flow passage 161*a* to each other, as shown in FIG. 29. For example, when the piston 157*a* is rapidly moved up to interrupt the application line, the fluid is not easily resupplied from the flow passage 161*a* side to the pump chamber 369 due to the fluid resistance of the throttle 375. Thus, the pump chamber 369 can maintain a high negative pressure state. In this case, the effect of the compressibility of the fluid in transient response can be restricted only to the capacity of the pump chamber 369 in FIG. 29. In addition, the throttle may be formed not on the flow passage 161*a* side but between the outer peripheral portion of the piston 360 and the lower plate 160.

When a mechanical pump such as thread groove type is not used as the fluid supply portion 150, i.e., when applying material filled in a syringe (container) is pressure-fed only by high-pressure air, the above-described throttle is indispensable. The reason of this is that in this case, there is no fluid resistance (same function as the throttle) corresponding to the internal resistance of the thread groove pump. Accordingly, in the case of the dispenser structure in which the applying material is pressure-fed only by high-pressure air, the flow passage 161*a* may be connected directly to the syringe filled with the applying material.

In the case where the applying material may be treated as a nonconductive one, it is appropriate that only the discharge section 364 is made of a nonconductive material such as resin or ceramics, while the housing-side electrode is placed at or near the discharge nozzle tip end, as described before. With such a structure, even with the use of a mechanical type dispenser, general steel material may be used for main component parts.

Generally, to perform the electric field control, electrodes are disposed on the discharge nozzle side (housing side) and its opposing-surface substrate side. The electrode to be provided on the substrate side, as described before, may be given by using an electrode which has previously been provided on the substrate (for example, address electrode, ITO film, etc. in the case of a PDP) Otherwise, when the substrate is a thin one, the base plate (which is made of conductive material in many cases) of the transfer stage set at the lower face of the substrate or the like may be used. In order that the application lines are formed as ultrafine lines, there are needs for setting an appropriate applied voltage (e.g., 0.5 to 3.0 kV) and an appropriate interelectrode gap between the discharge nozzle side and the substrate side (e.g., δ=0.5 to 2.5 mm). However, it is known that even when the interelectrode gap δ can only be set to a large value far beyond the above range, applying a high voltage to the discharge nozzle side allows the application grade to be dramatically improved. The reason of this is that if the ground side is installed at a distance, the discharge nozzle tip end becomes concentratedly large in electric field strength, so that the meniscus of the nozzle tip end is enabled to maintain an axisymmetrical configuration at all times as described before. Also, the surface tension between the fluid mass sticking to the nozzle tip end and the nozzle is apparently reduced by an action of the fluid projected by the electric field. As a result of this, the fluid that has flowed out from the discharge nozzle can be prevented from 'jutting upward to the outer surface of upper portion of the discharge nozzle at a start and an end of the application.

Accordingly, in the present invention, the control of starting and terminating ends of continuous application lines as well as high-speed intermittent application can be achieved with high grade by a combination of a dispenser, which contains a mechanism for increasing and decreasing the pressure of the discharge chamber, and the electric field control.

In the embodiments of the present invention, a thread groove pump is used as the fluid supply portion. For implementation of the present invention, although pumps of types other than the thread groove type are applicable, yet adopting the thread groove type is advantageous in that the maximum pressure $P_{max}$, the maximum flow rate $Q_{max}$, and the internal resistance $R_s$ ($=P_{max}/Q_{max}$) can be freely selected by changing various parameters (radial gap, thread groove angle, groove depth, groove-to-ridge ratio, etc.) of the thread groove. Since the rotational speed and the flow rate are in direct proportion to each other, the flow rate setting is easy to do. Also, since flow passages can be made up in a completely noncontact fashion, it is advantageous in treating powder and granular material.

Further, in the thread groove type, as described above, since the flow rate is basically independent of viscosity, a stable ultrafine-line application with the flow rate less dependent on environmental temperature changes or the like can be achieved in combination with the electric-field jet type.

In addition, the form of the pump as the fluid supply portion in the present invention is not limited to the thread groove type, and other type pumps are also applicable. For example, the mohno type called snake pumps, the gear type, the twin screw type, or the syringe type pumps, or the like are applicable.

Referring to the structure of FIGS. 11A and 11B, the pump of above-described other forms may be placed instead of the thread groove pump portion 150.

Otherwise, although the stability of flow rate is sacrificed, a high-pressure air source may be used instead of using a mechanical pump. For example, in FIGS. 11A and 11B, it is so constructed that the fluid is fed from the thread groove pump portion 150 through three flow passages 161*a*, 161*b*, 161*c* to the piston portions 156, respectively. With this thread groove pump portion 150 removed, it may be so constructed that the applying fluid pressurized by the high-pressure air source is fed to the flow passages 161*a*, 161*b*, 161*c*.

The pump of this embodiment for working with micro-small flow rates only needs piston strokes on the order of several tens of microns at most, in which case stroke limits do not matter even if an electro-magnetostriction element such as ultra-magnetostriction element or piezoelectric element is used. The electro-magnetostriction element, having a frequency responsibility of several MHz or higher, is capable of putting the piston into rectilinear motion at high responsibility. Therefore, the discharge amount of a high-viscosity fluid can be controlled at high response with high precision. The piston and the housing that accommodates this piston therein, which have cylindrical inner configurations, are used in the embodiments. Other than this method, for example, it is allowable that a bimorph type piezoelectric element, which is used in ink jet printers or the like, is used to make up relatively moving two surfaces, where the applying fluid is supplied to a pump chamber defined between these two surfaces.

If the responsibility is sacrificed, a moving-magnet type or moving-coil type linear motor, or an electromagnetic solenoid, or the like may be used as the axial-direction driving device that drives the piston. In this case, constraints on the stroke are dissolved.

The piston or the main shaft is an example of the moving member, and the axial-direction driving device or the rotation transmission device is an example of the moving-member driving device.

When the present invention is applied to, for example, fluorescent substance-layer formation or electrode formation of display panels, only setting numerical values of substrate specifications makes it possible to form paste layers of ultrafine lines for any arbitrary sizes of substrates with high precision, and to easily meet specification changes of substrates, without using conventional screen masks.

Further, it becomes possible to perform the screening by a single apparatus without the need for enlarging the scale of manufacturing processes or manufacturing lines. Moreover, display panels can be manufactured with increased mass-production effect for their production of small batches of a variety of products, and the screening performed by a single apparatus allows automated lines to be operated with a small-scale machine. The present invention can be widely applied not only to displays of PDPs, CRTs, organic ELs, liquid crystals, and the like, but also to circuit formation and the like, hence its effects enormous.

Thus, according to the present invention, in production processes of such fields as displays, electronic components, and household electrical appliances, draw ultrafine lines and ultrasmall dots can be drawn with various kinds of powder and granular material such as fluorescent substances, electrode materials, adhesives, solder paste, paints, hot melts, chemicals, and foods without involving clogging, and discharge interruption and start can be implemented at high speed.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A fluid applying apparatus comprising:

a housing having a suction port for sucking an applying fluid and a discharge nozzle at an end of the housing, the discharge nozzle defining a discharge port for discharging the applying fluid;

a moving member which forms a pump chamber for the applying fluid in combination with the housing, the moving member being rotationally or rectilinearly movable relative to the housing;

a moving-member driving device for driving the moving member to make the housing perform the rotational motion or rectilinear motion so that applying-fluid pressure inside the pump chamber is increased or reduced;

a housing-side electrode provided at an outer peripheral portion of the discharge nozzle at the end of the housing; and a power supply for applying a voltage to the housing-side electrode.

2. The fluid applying apparatus according to claim 1, further comprising a counter electrode placed on a substrate or in proximity to the substrate, wherein the voltage can be applied from the power supply to between the housing-side electrode and the counter to thereby generate an electric field.

3. The fluid applying apparatus according to claim 2, wherein the counter electrode is placed between the housing-side electrode and the substrate.

4. The fluid applying apparatus according to claim 3, wherein the counter electrode is hollow and axisymmetric.

5. The fluid applying apparatus according to claim 2, further comprising:

a cylindrical portion for storing therein the applying fluid having flowed out from the discharge port, which defines a discharge passage having a mean passage inner diameter larger than a passage inner diameter of the discharge port; and a lower housing which covers the cylindrical portion with a gap, thereby defining a flow passage which communicates with the discharge passage and which is used for a supply fluid other than the applying fluid, wherein the counter electrode is placed in proximity to the discharge passage.

6. The fluid applying apparatus according to claim 5, wherein the supply fluid is a gas.

7. The fluid applying apparatus according to claim 1, wherein a thread groove is provided on a relative movement surface of the moving member and the housing, and the applying fluid is sucked through the suction port into the thread groove and fed into the pump chamber by the rotational motion of the moving member.

8. The fluid applying apparatus according to claim 7, wherein the moving member and the housing constitute a thread groove pump.

9. The fluid applying apparatus according to claim 1, wherein the moving member is a piston, and the piston is inserted in the housing, and the moving-member driving device is a piston-axis-direction driving device for driving the piston into the rectilinear motion within the housing so as to increase or decrease the pump chamber defined between the piston and the housing, and thereby the fluid pressure inside the pump chamber is increased or decreased.

10. The fluid applying apparatus according to claim 1, wherein either one of the moving member or the housing is made of a nonconductive material.

11. The fluid applying apparatus according to claim 1, wherein the moving member is a piston, and the piston is inserted in the housing, and the moving-member driving device is an electro-magnetostriction device for putting the piston into rectilinear motion in its axial direction.

* * * * *